US007896485B2

(12) United States Patent
Lafleche et al.

(10) Patent No.: US 7,896,485 B2
(45) **Date of Patent: *Mar. 1, 2011**

(54) LIGHT CURE OF CATIONIC INK ON ACIDIC SUBSTRATES

(75) Inventors: John E. Lafleche, Tolland, CT (US); Russell F. Croft, Tolland, CT (US); Charles H. Doodley, Stanford, CT (US)

(73) Assignee: Gerber Scientific International, Inc., South Windsor, CT (US)

( * ) Notice: Subject to any disclaimer, the term of this patent is extended or adjusted under 35 U.S.C. 154(b) by 840 days.

This patent is subject to a terminal disclaimer.

(21) Appl. No.: 11/556,512

(22) Filed: Nov. 3, 2006

(65) Prior Publication Data

US 2007/0109382 A1 May 17, 2007

Related U.S. Application Data

(63) Continuation-in-part of application No. 11/274,409, filed on Nov. 16, 2005.

(51) Int. Cl.
*B41J 2/01* (2006.01)

(52) U.S. Cl. ..... 347/102; 347/101

(58) Field of Classification Search ..... 347/102, 347/101, 17

See application file for complete search history.

(56) References Cited

U.S. PATENT DOCUMENTS

| | | | |
|---|---|---|---|
| 2,970,965 | A | 2/1961 | Switzer |
| 3,734,872 | A | 5/1973 | Wakimoto et al. |
| 4,137,042 | A | 1/1979 | Defago et al. |
| 4,620,197 | A | 10/1986 | Miyamoto et al. |
| 4,926,190 | A | 5/1990 | Laver |
| 5,320,898 | A | 6/1994 | Yoshida et al. |
| 5,515,093 | A | 5/1996 | Haruta et al. |
| 5,672,424 | A | 9/1997 | Malhotra et al. |
| 5,683,793 | A | 11/1997 | Malhotra et al. |
| 5,709,976 | A | 1/1998 | Malhotra |
| 5,885,678 | A | 3/1999 | Malhotra |
| 5,897,961 | A | 4/1999 | Malhotra et al. |
| 5,908,723 | A | 6/1999 | Malhotra et al. |
| 5,922,625 | A | 7/1999 | Haruta et al. |
| 6,129,785 | A | 10/2000 | Schliesman et al. |

(Continued)

FOREIGN PATENT DOCUMENTS

DE 4038989 A1 6/1992

(Continued)

OTHER PUBLICATIONS

Stevenson, Alex, "Hexographic Ultraviolet Inks", *FLEXO*, vol. 22 p. 10, Oct. 1997 pp. 46-48.

(Continued)

*Primary Examiner* — Manish S Shah
(74) *Attorney, Agent, or Firm* — Crowell & Moring LLP

(57) ABSTRACT

This invention is an advance in coating chemistry, curing technology, related apparatus and the products made thereby. The invention encompasses a substrate bonded to a coating cured, at least in part, cationically by a light having a wavelength in a range of 100 nm to 1200 nm and intensity in a range of 0.0003 W/cm$^2$/nm to 0.05 W/cm$^2$/nm. Methods and systems for coating substrates and curing the coated products are encompassed. The invention encompasses apparatus and ink jet printers utilizing this curing technology. The invention also includes providing a "moving shadow" from ultraviolet light that is uniformly distributed over a print zone defined by a path of carriage motion illuminated by the light.

29 Claims, 23 Drawing Sheets
(2 of 23 Drawing Sheet(s) Filed in Color)

U.S. PATENT DOCUMENTS

| | | | | |
|---|---|---|---|---|
| 6,319,591 | B1 | 11/2001 | Malhotra | |
| 6,358,596 | B1 | 3/2002 | Mehta et al. | |
| 6,443,568 | B1 | 9/2002 | Askeland et al. | |
| 6,607,813 | B2 | 8/2003 | Washburn et al. | |
| 6,713,550 | B2 | 3/2004 | Schliesman et al. | |
| 6,814,793 | B2 | 11/2004 | Akers et al. | |
| 6,846,074 | B2 | 1/2005 | Hirai | |
| 7,137,696 | B2 | 11/2006 | Siegel | |
| 2003/0018101 | A1 | 1/2003 | Botros et al. | |
| 2003/0162009 | A1 | 8/2003 | Cuch et al. | |
| 2003/0222960 | A1* | 12/2003 | Takabayashi | 347/102 |
| 2004/0036753 | A1* | 2/2004 | Hirai | 347/102 |
| 2004/0065230 | A1 | 4/2004 | Katoh et al. | |
| 2004/0095658 | A1 | 5/2004 | Buretea et al. | |
| 2004/0104989 | A1 | 6/2004 | Hoshino | |
| 2004/0111812 | A1 | 6/2004 | Yamaguchi et al. | |
| 2004/0152819 | A1 | 8/2004 | Cuch | |
| 2004/0201659 | A1* | 10/2004 | Watanabe | 347/102 |
| 2004/0233465 | A1 | 11/2004 | Coyle et al. | |
| 2004/0247804 | A1 | 12/2004 | Kim et al. | |
| 2005/0068397 | A1 | 3/2005 | Yokoyama | |
| 2005/0136210 | A1 | 6/2005 | Boettcher | |
| 2005/0215657 | A1 | 9/2005 | Nishizeki et al. | |
| 2005/0225620 | A1 | 10/2005 | Nishino | |

FOREIGN PATENT DOCUMENTS

| | | | |
|---|---|---|---|
| EP | 0280650 | B1 | 8/1988 |
| EP | 0681623 | B1 | 5/1997 |
| EP | 0614766 | B1 | 9/1997 |
| EP | 0631006 | B1 | 1/1998 |
| EP | 0613058 | B1 | 6/1999 |
| EP | 1270254 | A2 | 1/2003 |
| EP | 0796947 | B1 | 6/2003 |
| EP | 1378545 | A1 | 1/2004 |
| EP | 1407892 | A2 | 4/2004 |
| EP | 1090776 | B1 | 6/2004 |
| EP | 1086825 | B1 | 9/2004 |
| GB | 882837 | | 11/1961 |
| GB | 1510721 | | 5/1978 |
| JP | 59-052689 | | 3/1984 |
| JP | 61-014979 | | 1/1986 |
| JP | 61-163886 | | 7/1986 |
| JP | 03-218885 | | 9/1991 |
| JP | 05-117571 | | 5/1993 |
| JP | 06-025584 | | 2/1994 |
| JP | 06-191139 | | 7/1994 |
| JP | 07-026473 | | 1/1995 |
| JP | 07-026474 | | 1/1995 |
| JP | 09-249835 | | 9/1997 |
| JP | 11-227324 | | 8/1999 |
| JP | 2000-006515 | | 1/2000 |
| JP | 2000-280607 | | 10/2000 |
| JP | 2002-067491 | | 3/2002 |
| JP | 2002-356052 | | 12/2002 |
| JP | 2003-103900 | | 4/2003 |
| JP | 2003-103901 | | 4/2003 |
| JP | 2004-114536 | | 4/2004 |
| JP | 2004-154979 | | 6/2004 |
| WO | WO 90/01699 | | 2/1990 |
| WO | WO 90/15857 | | 12/1990 |
| WO | WO 91/10140 | | 7/1991 |
| WO | WO 91/12310 | | 8/1991 |
| WO | WO 92/09661 | | 6/1992 |
| WO | WO 92/09934 | | 6/1992 |
| WO | WO 93/15124 | | 8/1993 |
| WO | WO 93/20440 | | 10/1993 |
| WO | WO 94/03774 | | 2/1994 |
| WO | WO 94/11450 | | 5/1994 |
| WO | WO 94/20532 | | 9/1994 |
| WO | WO 94/24306 | | 10/1994 |
| WO | WO 98/42799 | | 10/1998 |
| WO | WO 98/57179 | | 12/1998 |
| WO | WO 99/54145 | | 10/1999 |
| WO | WO 00/64953 | | 11/2000 |
| WO | WO 03/031191 | A2 | 4/2003 |
| WO | WO 03/096016 | A1 | 11/2003 |
| WO | WO 2004/022637 | A2 | 3/2004 |
| WO | WO 2004/081222 | A2 | 9/2004 |
| WO | WO 2004/089640 | A2 | 10/2004 |

OTHER PUBLICATIONS

International Search Report and Written Opinion of the International Searching Authority of Jun. 14, 2007 for PCT/US06/43004 (mailing date of ISR Jul. 30, 2007).

* cited by examiner

LIGHT CURE OF CATIONIC INK ON ACIDIC SUBSTRATES

RELATED APPLICATIONS

This application is a continuation-in-part of pending U.S. patent application Ser. No. 11/274,409, filed on Nov. 16, 2005.

FIELD OF INVENTION

The present invention relates generally to light curing printing ink on a substrate, and particularly relates to curing cationic ink used in an ink jet printer.

BACKGROUND

Known free radical curing systems involve high intensity, heat-generating lamps. Free radical systems historically generate heat with a mercury light source. This limits their use with heat sensitive substrates. Further, such systems can require water heat sinks and/or dichroic filters to prevent infrared (IR) radiation from reaching and distorting or discoloring the substrate. Such measures increase the complexity and cost of processing a substrate making the use of such systems undesirable.

Known ultraviolet light (UV) free radical cure technology is inadequate, e.g., having oxygen inhibition, poor flexibility, and poor adhesion of cured coatings. The failings of known technology include inadequate or difficult curing and cure rates and unsatisfactory substrate throughput rates. Further, known technology is unable to properly coat multidimensional, curved or shaped articles. Known methods are also incapable of properly coating objects having dark areas, or areas having limited light exposure.

Known jet printing technology can utilize a mercury vapor 100 Watt (W) per inch (W/in) or other high-intensity heat-generating curing light source.

BRIEF SUMMARY OF THE INVENTION

This invention advances coating technology and encompasses light cure, dark cure and dual cure techniques. The invention can coat all shapes of surfaces including, but not limited to, flat, curved, multidimensional (3-Dimensional (3D)) and complex shapes. The invention allows for the coating and cure of coatings of surfaces having portions which shadowed from light, dark areas not exposed to light, and portions exposed to a lower intensity of light than the level which is found perpendicular to the light source used for curing. This invention also includes techniques to bond the coating composition to a substrate or surface through the formation of covalent and noncovalent bonding. This invention also includes the coating and cure of heat sensitive substrates and articles having heat sensitive components. One or more coatings can be applied to simple and complex shaped articles. The invention can produce a broad variety of finishes including, but not limited to, wrinkle, standard matte, high-gloss, and/or other desired surface finish. This invention encompasses coatings having one, or more, cationic coating or ink. The coating can be printed or coated on a substrate. The substrate which is to be coated can be acidic or acid containing. Cure of coatings and a coating's adhesion to a substrate can be obtained over a broad range of print rates. This invention also advances the technology of ink jet printing technology. The invention encompasses the apparatus systems, process, methods, control systems, quality control techniques and products related to the application and cure of coatings and inks described herein.

Herein, endpoints of ranges are recognized to incorporate within their meaning other values within the knowledge of a person having ordinary skill in the art, including, but not limited to, values which are insignificantly different from the respective endpoint(s) as related to this invention (in other words, endpoints of ranges indicated herein are to be construed to incorporate values "about" or "close" or "near" to each respective endpoint). The range and ratio limits, recited herein, are combinable. For example, if ranges of 10-2000 and 50-1500 are recited for a particular parameter, it is understood that ranges of 10-50, 10-1500, 50-2000, or 1500-2000 are also contemplated.

One embodiment of the invention is a composition of matter, having a substrate bonded to a coating which is cured at least in part cationically by a light having a wavelength in a range of 100 nm to 1200 nm and intensity in a range of 0.0003 $W/cm^2/nm$ to 0.05 $W/cm^2/nm$.

The invention can utilize light having a value which is from a broad range of light wavelengths, as well as from a broad range of light intensities. One embodiment utilizes light having a light wavelength ("light wavelength", also "wavelength") in a range of about 100 nm to about 1200 nm and a light intensity ("light intensity"; also "intensity") of about 0.0003 $W/cm^2/nm$ to about 0.05 $W/cm^2/nm$. Another embodiment utilizes light having a light wavelength in a range of about 100 nm to about 1200 nm and a light intensity of about 0.0003 $W/cm^2/nm$ to about 0.02 $W/cm^2/nm$. Yet another embodiment utilizes light having a light wavelength in a range of about 100 nm to about 1200 nm and a light intensity of about 0.0003 $W/cm^2/nm$ to about 0.01 $W/cm^2/nm$. A still further embodiment utilizes light having a light wavelength in a range of about 100 nm to about 1200 nm and a light intensity of about 0.0003 $W/cm^2/nm$ to about 0.008 $W/cm^2/nm$.

The range of wavelengths emitted (e.g., the spectral width, or bandwidth) by a light source which can be utilized in this invention can vary greatly. The number of spectral peaks of emission from a light source can vary from one peak to many peaks. Table 1, below, provides a non limiting selection of wavelength ranges and values of light which can be used in this invention. Each range and value of light should be construed to encompass a range of values above and below a given value to include wavelength ranges which can exist about the peaks produced by a light source.

Further, light intensity can have values, for example, of up to about 5.0 $W/cm^2/nm$. Accordingly, light intensity values of about 0.005 $W/cm^2/nm$, 0.0075 $W/cm^2/nm$, 0.009 $W/cm^2/nm$, 0.01 $W/cm^2/nm$, 0.015 $W/cm^2/nm$, 0.02 $W/cm^2/nm$, 0.025 $W/cm^2/nm$, 0.03 $W/cm^2/nm$, 0.035 $W/cm^2/nm$, 0.04 $W/cm^2/nm$, 0.045 and higher can be employed as well as values above, below or between these values. Light intensity values of about 0.05 $W/cm^2/nm$, about 0.075 $W/cm^2/nm$, about 1.0 $W/cm^2/nm$, about 3.0 $W/cm^2/nm$, about 4.0 $W/cm^2/nm$, about 5.0 $W/cm^2/nm$, about 1.0 $W/cm^2/nm$, or even higher can be employed. These embodiments of intensity are nonlimiting.

A broad variety of combinations of wavelength and intensity can be utilized with this invention. Accordingly, combinations of values of wavelength and intensity as set forth herein are not limited.

An entire amount, one portion, or more than one portion of the coating can be cured at least in part by a chemical reaction not requiring, free of, or independent of, exposure to light. A covalent bond can be formed between a substrate molecule and a coating molecule. A noncovalent bond can formed between a substrate molecule and a coating molecule. In some embodiments both covalent bonding and noncovalent bonding can occur between the substrate and the coating composition.

Curing of a cationic coating composition can result in a polymer molecule which is a product of cationic polymerization. Herein flexibility values are in units of % of engineering strain (% engineering strain is "%" when discussing flexibility). Coating and curing by the present invention can result in the cured coating having flexibility in a range of from 1% to 500% of engineering strain free of cracking of the coating. Greater flexibilities up to 1000% of engineering strain can be achieved. Even higher flexibilities are possible. Other embodiments can respectively have 50%, 100%, 200%, 300% or 400% of engineering strain substantially free of cracking of the coating. Values above, below and between these values can be achieved.

The coating compositions, cured coatings and articles of this invention can have one or more coatings and can contain pigments, colors, or be a clearcoat A broad variety and many variations of the coating and curing process are included in the scope of this invention. In one embodiment, the inventive process for coating a substrate, includes the steps of providing a cationic coating composition, providing a substrate, providing a light having a wavelength in a range of 100 nm to 1200 nm (nanometer) and an intensity in a range of 0.0003 $W/cm^2/nm$ to 0.05 $W/cm^2/nm$ (Watts/centimeter$^2$/nanometer), applying an amount of said cationic coating composition to at least a portion of said substrate forming a coated portion, and curing at least a first portion of said amount of cationic coating composition through exposure to said light. In one embodiment the process includes a further step of curing at least a portion of the coating composition by a reaction not requiring exposure to the light. Drying of the coating without exposure to light is utilized in another embodiment.

A coating can be cured using various rates and speeds of curing. As Example 15 provides, the present invention can cure an amount of the coating which is equal to or less than about 100 micron (also herein) thick in a time which is equal or less than about 1 minute. In another embodiment cure of an amount of coating composition which is equal to or less than 50 micron can be achieved in a time which is equal or less than 5 minutes. In another embodiment, a coating which is greater than about 100 microns thick or less is cured in a time which is equal or less than 5 minutes. In yet another embodiment, a coating which is 50 microns thick or less in a time which is equal or less than 2.5 minutes.

The invention encompasses coating and curing processes in which the step of curing a portion of an amount of cationic coating composition is achieved at least in part by an exposure to a light which is of different intensity than the exposure of another portion. The number of portions of a coating receiving different curing methods is not limited on the same object, surface or layer of a coating.

In some embodiments the process includes the step of producing a covalent bond between a molecule of the coating composition and a molecule of the substrate. In other embodiments, the process includes the step of producing a noncovalent bond between a molecule of the coating composition and a molecule of the substrate. In yet other embodiments, the process forms both covalent and noncovalent bonds between substrate molecules and coating molecules.

Additives, photoinitiators, and photosensitizers can be utilized in the coatings, inks and processes of this invention. In one embodiment, at least one photosensitizer is added to the coating composition and can be activated by exposure to light as discussed herein. In another embodiment, at least one photoinitiator is added to the coating composition and can be activated by exposure to light as discussed herein.

This invention encompasses dual cure processes. In one embodiment, the process includes the step of reacting at least a portion of the cationic coating composition before, during, or after, the curing step free of exposure to light.

The invention also encompasses the use of an acidic substrate onto which a coating is applied, as well as non-acidic substrates utilized in conjunction with an applied acid during the coating process (either before, or in conjunction with the application of the coating). In one embodiment, the method for coating includes the step of reacting in an acid functional group of the substrate. The method for coating can also utilize the substrate comprising a first surface portion which is acidic prior to the applying step and a second surface portion which is not acidic prior to the applying step. In some embodiments, one or more acid substrates, or acid(s), are used on at least one portion, but at least one other portion is not acidic and/or does not have acid applied. An acid can be applied to a substrate surface. In one embodiment, the process includes the step of applying an amount of acid to a first surface portion prior to applying an amount of a first cationic coating composition and applying an amount of a second cationic coating composition to a second surface portion which is free of the acid and/or a second portion which is not acidic. In yet other embodiments acid can be applied concurrently, close in time with or after application of a cationic coating.

The invention broadly encompasses the use of multiple coating compositions, formation of laminates and the production of multiple coating layers. In one embodiment, the first coating composition is different from the second coating composition. In another embodiment the first coating composition is the same as the second coating composition. There is tremendous variation possible in the combinations of coatings or layers available by the processes, methods and apparatus of this invention.

This invention also encompasses the processes, methods and apparatus for differential cure, as well as the articles and products manufactured by differential cure techniques. In one embodiment, the curing process includes the step of performing a differential cure of at least a portion of an amount of cationic coating composition.

The invention allows for the production of a variety of finishes to coated articles. It encompasses the processes, methods, apparatus and products produced by the invention and having a broad variety of finishes. In one embodiment, the method for curing includes the step of producing a wrinkle coat.

The invention encompasses a tremendous variety of products which can be coated by the processes, methods and apparatus disclosed herein. In one embodiment the invention includes a coated article, having a substrate with a coating cured at least in part cationically by a light having a wavelength in a range of 100 nm to 1200 nm and an intensity of 0.0003 $W/cm^2/nm$ to 0.05 $W/cm^2/nm$. Other non-limiting examples of these products include, but are not limited to one or more of the following: a printed graphic, an outdoor durable printed graphic, a printed label, a printed sticker and a printed document. An article with a surface having printing, as well as articles with one or more multidimensional, 3D and/or shaped surfaces having coating or printing and are broadly encompassed by this invention.

Additionally, an article having at least a portion cured by differential cure can be produced. Further, an article can have at least a portion cured by dual cure. This invention comprises articles which are produced by one method of cure, as well as articles produced by the invention including multiple types of cures and curing methods.

The invention includes not only the process, methods and articles of production, but also the apparatus, computer technology, control systems and quality control systems for utilizing the invention. The apparatus for using this invention is widely varied in nature, type and design and is able to print on a broad variety of materials, apply coatings and chemicals, as well as to cure the printed products and articles of manufacture.

This invention broadly includes any apparatus having an applicator adapted to apply an amount of a coating composition to a substrate, a first light source producing a light having a wavelength in a range of 100 nm to 1200 nm and an intensity in a range of 0.0003 $W/cm^2/nm$ to 0.05 $W/cm^2/nm$ and arranged to expose at least a portion of said coating composition to said light.

In one embodiment the invention includes an apparatus which includes an ink jet printer, having an applicator adapted to apply an amount of a coating composition to a substrate, a first light source producing a light having a wavelength in a range of 100 nm to 1200 nm and an intensity in a range of 0.0003 $W/cm^2/nm$ to 0.05 $W/cm^2/nm$ and arranged to expose at least a portion of said coating composition to said light.

The ink jet printer can have a number of light sources each producing a light having a wavelength in a range of 100 nm to 1200 nm and intensity in a range of 0.0003 $W/cm^2/nm$ to 0.05 $W/cm^2/nm$ arranged in an array. In one embodiment, an ink jet printer can have first and second light sources, having a first light source provided on a first side of a print carriage and a second light source provided on a second side of the print carriage. In one embodiment, an ink jet printer has a light source positioned perpendicular to a direction of motion of a substrate onto which an amount of coating is applied.

In one embodiment, the ink jet printer has an applicator and is designed for printing by drop-on-demand and is adapted to apply a drop volume in a range of about 3 to about 50 pico-liters with a firing frequency in a range of 2 to 100 kilohertz ("kHz") and with a drop velocity in a range of about 4 m/s to about 50 m/s ("meters/second"). In some embodiments, the applicator is an ink jet printing head. Smaller and larger drop volumes can be used for ink-jet printing including, but not limited to, 1, 5, 10, 20, 75 and 100 pico-liters.

Ink jet printers can print in a variety of manners encompassed by this invention. An ink jet printer can be drop-on-demand. In another embodiment, the ink jet printer can provide a continuous application of coating composition. In yet another embodiment, the ink jet printer can provide a semi-continuous application of coating composition. An ink jet printer can utilize any one, or more, of these application methods.

In some embodiments the ink jet printer can have and/or be operated by a computer control system. The ink jet printer can also have feedback and control mechanisms. Feedback mechanisms can include, but are not limited to, one or more of an optical feedback of nozzle status an optical feedback of image quality.

The invention also includes a broad variety of printing and media handling functionalities. The apparatus can be an ink jet printer adapted to roll-to-roll media handling and/or flat-bed printing. The printing can be achieved on a rigid media or a non-rigid media. The printer can print on a broad and wide range of sizes of media. In one embodiment an ink jet printer is adapted to printing of 10 foot wide media at a rate equal to or less than 3000 $ft^2$/hour. Very tiny sizes and very large sizes of articles and media are encompassed by this invention.

In one embodiment, the ink jet printer is adapted to auto head registration. The ink jet printer can also be adapted to print-to-route operation. The ink jet printer can be adapted to print-to-cut operation.

Feedback control and computer control systems can be utilized at any point in the coating, printing, curing or materials handling process of this invention.

One embodiment includes, an ink jet printer having a feedback and control system of lamp wavelength. Another embodiment includes, an ink jet printer having a feedback and control system of lamp intensity.

In another embodiment, curing the composition on a substrate includes an ink jet printer having two light sources producing a light having a wavelength in the ultraviolet range of about 100 nm to about 1200 nm. In one embodiment, the light sources are symmetrical with each other and positioned parallel to an axis in the direction of print carriage motion. Depending on the embodiment, the first and second light sources can be disposed on opposite sides relative to a print carriage for illuminating a print surface. The print carriage provides a "moving shadow" from the ultraviolet light that is uniformly distributed over a print zone. This moving shadow has many advantages, including, but not limited to, allowing the composition applied to the substrate enough workable time to be applied or remain wet before it cures without allowing the UV light to reach the print heads and cause curing on the ink jet nozzles.

A reflector can also be utilized to provide uniform ultraviolet light intensity within the print zone. Also a positionable light block can be positioned over an edge of rigid media to prevent ultraviolet light from reaching the underside of the print carriage. This light block deters premature ink curing on the ink jet nozzle plate.

Another object of the invention is to utilize the heat produced from the first and second light sources to lower humidity within a print zone for allowing curing of cationic ink in environments with a relative humidity above 60%. The heat produced from the first and second light sources can be kept low enough to keep surface temperature of a heat sensitive rigid media from deforming. This control of heat prevents an ink jet print head from striking a heat sensitive rigid media during printing due to deformation of the media.

Depending on the embodiment, the intensity of the light sources can be adjusted. The ultraviolet light intensity can be adjusted to produce both gloss and matte finishes on flexible or rigid print media.

The patent or application file contains at least one drawing executed in color. Copies of this patent or patent application publication with color drawing(s) will be provided by the Office upon request and payment of the necessary fee.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The present invention will be understood and appreciated more fully from the following detailed description taken in conjunction with the drawings in which.

DETAILED DESCRIPTION OF THE INVENTION

Figure 1:
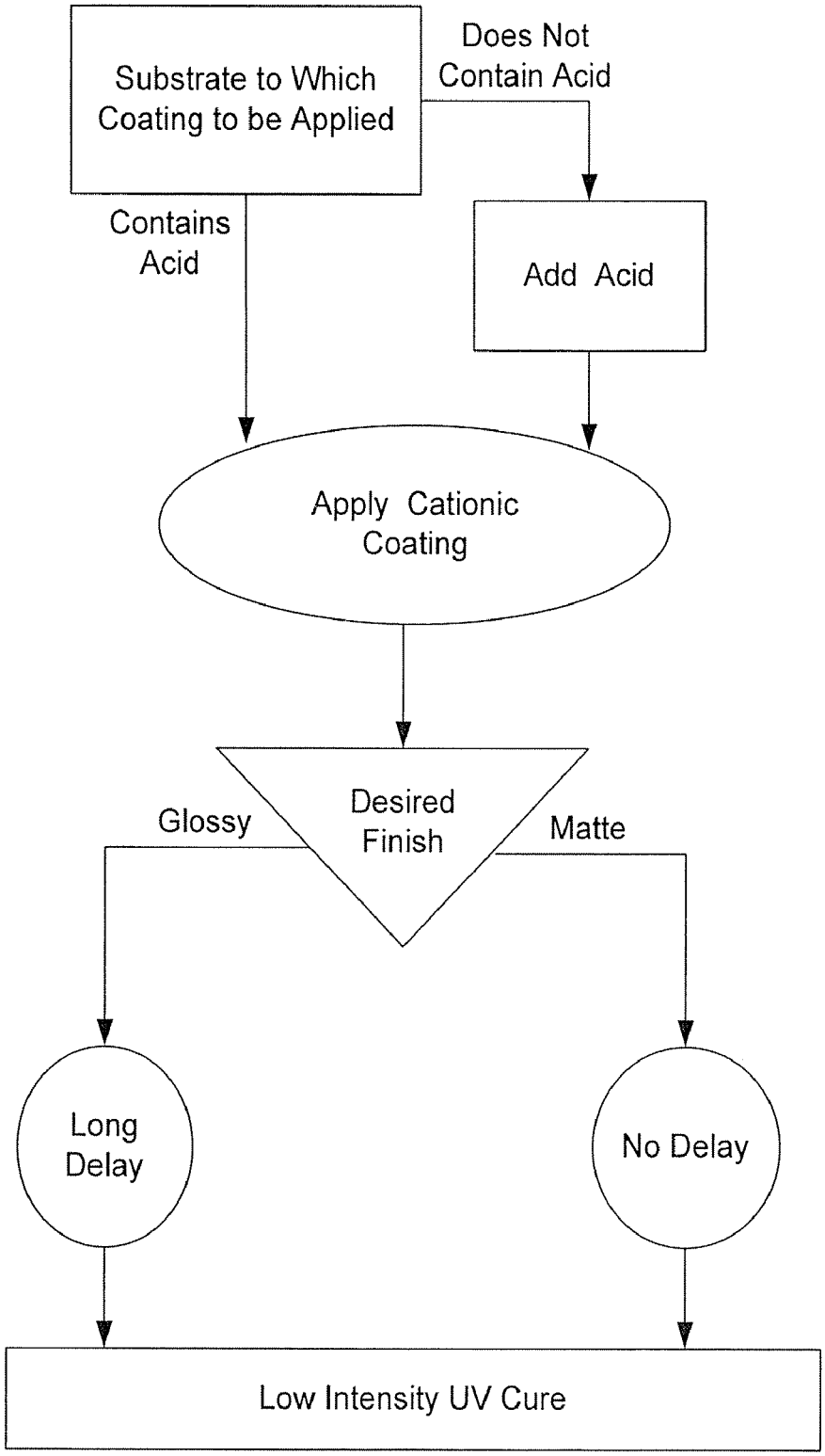
FIG. 1 Process Flow Diagram.

A variety of curing processes can be achieved with the invention including, but not limited to light cure, dark cure, dual cure, differential cure and cure techniques involving combinations of, but not limited to, the curing methods disclosed herein. This invention provides advantages which can include, but are not limited, to one or more of print rates in a range of from very slow, e.g., almost zero $ft^2$/hr ("foot$^2$/hour") through about 6400 $ft^2$/hr, or higher. The invention can employ cationic coating compositions and low intensity light to achieve low energy cure, energy efficient cure. The invention is low in heat generation and can be utilized with heat sensitive substrates, including but not limited to those with thermal expansions that lead out of plane deformation during curing, color changes or undesired temperature dependant changes. The apparatus employed can use light sources which can have a long light life, e.g., greater than 500 hours.

Definitions set forth below are employed in this disclosure.

"Pressure", as used herein, refers to the force acting per unit area within various vessels, tubes and pipelines constituting the process and equipment. Pressure herein is expressed as pounds per square inch ("psig"). All references herein to pressure are in units of pounds per square inch gage, psig, unless otherwise indicated. Ambient pressure references are also referred herein in psig unless otherwise indicated.

"Temperature" as used herein is in degrees Celsius ("° C.", or "C") unless otherwise stated.

A "Coating" includes any amount, or layer, of any substance applied to, and/or spread over any surface, substrate, other material, or composition.

A coating can be of any phase including but not limited to, liquid, solid, semi-solid, amorphous, crystalline, plastic, polymer, salt, multiphase, continuous phase, discontinuous phase, colloidal, anodized, vapor deposited and gas deposited.

"Coalesce", (also, "coalescing" or, "coalesced") are terms which include the transition which a coating can experience as the coating approaches and reaches a final state (e.g., state of reduce change, low energy state, reactions substantially complete, drying processes substantially complete). Initially, a coating can be applied to a substrate and has a physical and chemical composition. In the embodiment of an aqueous dispersion and/or non-aqueous dispersion, atomization of the coating results is droplets on the substrate. These droplets can remain partially coalesced when little or no flow occurs. Factors which influence the flow, or no flow (also including slow flow or little flow) cases include, but are not limited to, viscosity, wetting or non-wetting of the substrate as a function of surface tension, drying due to evaporation of solvents and/or electrostatic repulsion in the case of electrostatic coating processes where charge dissipation is prevented. "Coalesce" includes the transition of flow and leveling of the applied coating from an initial physical structure and chemical nature to its resting, final or equilibrated physical and chemical nature.

FIG. 1 is a process flow diagram illustrating one embodiment of the invention having a curing process for cationic coatings on a surface. A cationic coating can be applied to a substrate. A "substrate" includes any surface capable of receiving an amount of a cationic coating. The substrate can be acidic, or not acidic. An additional step of adding acid to the surface can be included, or the process can be executed without adding acid to the surface. The substrate coated with an amount of cationic coating can be exposed, at least in part, to a light having a wavelength in a range of 100 nm to 1200 nm and intensity in a range of 0.0003 W/cm$^2$/nm to 0.05 W/cm$^2$/nm. Exposure to such a light can achieve curing of all, or a portion, of the coating.

As discussed above, this invention can use light to cure cationic coatings. "Light" includes all varieties of electromagnetic energy which can interact with the coatings, coating systems and their components and constituents. The definition of "light" encompasses "Actinic light" which is light which produces an identifiable or measurable change when it interacts with matter. "Light" or "radiation" includes photochemically active radiation of the forms like particle beams accelerated particles, i.e., Electron beams, and electromagnetic radiation, i.e., UV radiation, visible light, UV light, X-rays, gamma rays. "Light Intensity" is a measurable characteristic relating to the energy emitted by an light source reported in units of Watts (W) or miliWatts (mW). In one embodiment a light has a wavelength in a range of about 100 nm to about 1200 nm and an intensity in a range of about 0.0003 w/cm$^2$/nm to 0.05 w/cm$^2$/nm.

A wide range of light and light sources can be utilized. Light having a wavelength in a range of about 100 nm to about 1200 nm and intensity in a range of about 0.0003 W/cm$^2$/nm to 0.05 W/cm$^2$/nm can be used.

The invention can utilize light having a value from a broad range of light wavelengths, as well as from a broad range of light intensities. As stated above one embodiment utilizes light having a light wavelength in a range of about 100 nm to about 1200 nm and a light intensity of about 0.0003 W/cm$^2$/nm to about 0.05 W/cm$^2$/nm. Another embodiment utilizes light having a light wavelength in a range of about 100 nm to about 1200 nm and a light intensity of about 0.0003 W/cm$^2$/nm to about 0.02 W/cm$^2$/nm. Yet another embodiment utilizes light having a light wavelength in a range of about 100 nm to about 1200 nm and a light intensity of about 0.0003 W/cm$^2$/nm to about 0.01 W/cm$^2$/nm. A still further embodiment utilizes light having a light wavelength in a range of about 100 nm to about 1200 nm and a light intensity of about 0.0003 W/cm$^2$/nm to about 0.008 W/cm$^2$/nm.

The range of wavelengths emitted (i.e., the spectral width, or bandwidth) by a light source which can be utilized in this invention can vary greatly. The number of spectral peaks of emission from a light source can vary from one to many.

Light sources which can be used in this invention include, but are not limited to: a light bulb, fluorescent light source, LED, natural light, amplified light, electromagnetic radiation, a lamp, a gas lamp. A nonlimiting example of a gas lamp includes, a UV Systems TripleBright II lamp which is a type of gas discharge lamp utilizing a pair of electrodes, one at each end, and is sealed along with a drop of mercury and lamps having inert gases inside a glass tube. Light can originate from one source and/or location, a number of light sources and/or locations, or from an array of light sources. One or more types of lights, light sources, locations, configurations, orientations, intensities and wavelengths can be used in combination contemporaneously, sequentially, mixed, or timed without limitation.

The spectral output of a light source can be a function of one or more of the following nonlimiting factors: an atomic structure of one or more gas molecules, a temperature of a gas or gases, the pressure of a gas vapor in a light source. In some embodiments the output of phosphors (if optionally used) which are placed on the inside of the glass tube can affect the output of a light source.

In a nonlimiting example, a 254 nm bulb can have a peak at 253.7 nm. In this example the 254 nm bulb does not utilize phosphors and the output is primarily due to the absorption lines of mercury atoms. This can generate several emission lines of an extremely narrow bandwidth and a wavelength range of approximately 10 nm about the dominant lamp peak. Such wavelength ranges about peaks produced by light source are a result of the physics of light sources. Thus all values of wavelength should be construed to encompass ranges above and below the stated value for a respective light source.

In another nonlimiting example, a 306 nm bulb without phosphors can have a peak at 312 nm. In other nonlimiting examples, a 352 nm bulb having phosphors on the inside of the glass bulb and a 368 nm bulb having phosphors on the inside of the glass bulb can generate a light with a wavelength range of approximately 30-100 nm about a dominant lamp peak.

Light sources which can be used in cationic curing can have wavelengths including, but not limited to, the following respective peaks 395/400 nm, 385 nm, and 365 nm, and 270 nm. These sources can generate light having a wavelength range of about 10-80 nm about the dominant lamp peak. Table 1 provides a nonlimiting selection of wavelength ranges and wavelength values of light which can be used in this invention.

TABLE 1

| Select Light Wavelength Ranges And Select Values | | |
|---|---|---|
| 100 nm-1200 nm | 254 nm-306 nm | 254 nm |
| 100 nm-500 nm | 240 nm-330 nm | 306 nm |
| 200 nm-450 nm | 240 nm-260 nm | 352 nm |
| 220 nm-320 nm | 300 nm-320 nm | 368 nm |

The values of wavelength and ranges provided in Table 1 are examples and values above, below or in between these values can be used.

Further, light intensity can have values, for example, of up to about 5.0 W/cm$^2$/nm. Accordingly, light intensity values of about 0.005 W/cm$^2$/nm, 0.0075 W/cm$^2$/nm, 0.009 W/cm$^2$/nm, 0.01 W/cm$^2$/nm, 0.015 W/cm$^2$/nm, 0.02 W/cm$^2$/nm, 0.025 W/cm$^2$/nm, 0.03 W/cm$^2$/nm, 0.035 W/cm$^2$/nm, 0.04 W/cm$^2$/nm, 0.045 and higher can be employed as well as values above, below or between these values. Light intensity values of about 0.05 W/cm$^2$/nm, about 0.075 W/cm$^2$/nm, about 1.0 W/cm$^2$/nm, about 3.0 W/cm$^2$/nm, about 4.0 W/cm$^2$/nm, about 5.0 W/cm$^2$/nm, about 10.0 W/cm$^2$/nm, or even higher can be employed.

A broad variety of combinations of wavelength and intensity can be utilized with the invention. Accordingly, combinations of values of wavelength and intensity as set forth herein are not limited.

The term "fluorescence" includes a physical phenomenon whereby an atom of a material (typically phosphors) absorbs a photon of light and immediately emits a photon of longer wavelength.

The term "fluorescent Lamp" includes any lamp utilizing an electric discharge through low pressure mercury vapor to produce ultraviolet (UV) energy. In one nonlimiting embodiment of a fluorescent lamp, UV energy excites phosphor materials applied as a thin layer on the inside of a glass tube which makes up the structure of the lamp. The phosphors transform the UV energy from shorter wavelength energy to longer wavelength energy.

The term "compact fluorescent lamp" (CFL) includes any fluorescent lamp which is single-ended and which has smaller diameter tubes which are bent to form a compact shape. In some nonlimiting embodiments, some CFLs have integral ballasts and medium or candelabra screw bases for easy replacement of incandescent lamps.

The term "bulb" is to be broadly construed to include any light bulb, but also lamps and any sources of light within the scope of the invention described herein. Broadly, "bulb" includes any source from which light is emitted.

In some embodiments, light is emitted by a "Light Emitting Diode" (LED). LEDs broadly include any semiconductor material that directly converts electrical energy into light and can be used in this invention.

In one embodiment, the invention provides for a cationic coating and process for curing including a light having a wavelength in a range of 100 nm to 1200 nm and intensity in a range of 0.0003 W/cm$^2$/nm to 0.05 W/cm$^2$/nm. In this embodiment the light can cure a cationic coating composition on an acidic substrate having a pH of 7.0 or lower, or on an acid containing substrate. Acidic substrates can contain materials that impart a pH of 7.0 or lower and/or photolabile, or process labile, materials which upon activation impart a pH of 7.0 or lower for cure and adhesion to (or reaction with) a substrate. The coating composition utilized can be catonic in nature. A broad variety of photocuring materials can be employed. A cationic coating composition includes, but is not limited to, coatings, inks, powders, solutions, adhesives, emulsions, dispersions, sol-gel, slurries and other mixtures and compositions.

Examples of organic materials polymerizable by cationic polymerization and suitable for the hardenable compositions according to the invention are of the following types, which can be used by themselves, or as mixtures of at least two components:

Ethylenically unsaturated compounds polymerizable by a cationic mechanism. These include, but are not limited to: Monoolefins and diolefins, for example isobutylene, butadiene, isoprene, styrene, alpha-methylstyrene, divinylbenzenes, N-vinylpyrrolidone, N-vinylcarbazole and acrolein;

Vinyl ethers, for example include, but are not limited to, methyl vinyl ether, isobutyl vinyl ether, trimethylolpropane trivinyl ether and ethylene glycol divinyl ether; and cyclic vinyl ethers, for example 3,4-dihydro-2-formyl-2H-pyran (acrolein dimer) and the 3,4-dihydro-2H-pyran-2-carboxylic acid ester of 2-hydroxymethyl-3,4-dihydro-2H-pyran;

Vinyl esters, for nonlimiting example include, but are not limited to, vinyl acetate and vinyl stearate.

Heterocyclic compounds polymerizable by cationic polymerization, for example ethylene oxide, propylene oxide, epichlorohydrin, glycidyl ethers of monohydric alcohols or phenols, for example n-butyl glycidyl ether, n-octyl glycidyl ether, phenyl glycidyl ether and cresyl glycidyl ether, glycidyl acrylate, glycidyl methacrylate, styrene oxide and cyclohexene oxide, oxetanes such as 3,3-dimethyloxetane and 3,3-di(chloromethyl)oxetane, tetrahydrofuran, dioxolanes, trioxane and 1,3,6-trioxacyclooctane, spiroorthocarbonates, lactones such as beta-propiolactone, gamma-valerolactone and epsilon-caprolactone, thiranes such as ethylene sulfide and propylene sulfide, azetidines such as N-acylazetidines, for example N-benzoylazetidine, as well as the adducts of azetidine with diisocyanates, for example toluene-2,4-diisocyanate and toluene-2,6-diisocyanate and 4,4'-diaminodiphenylmethane diisocyanate, epoxy resins, and linear and branched polymers with glycidyl groups in the side-chains, for example homopolymers and copolymers of polyacrylate and polymethacrylate glycidyl esters.

Polymerizable compounds include, but are not limited to, epoxy resins, diepoxides, polyepoxides and epoxy resin prepolymers of the type used to prepare crosslinked epoxy resins can be utilized in this invention.

Epoxy compounds which can be cured or polymerized by the processes of this invention include those known to undergo cationic polymerization and include 1,2-, 1,3-, and 1,4-cyclic ethers (also designated as 1,2-, 1,3-, and 1,4-epoxides). Cyclic ethers which can be used include the cycloaliphatic epoxies such as cyclohexene oxide and the series of resins commercially available under the trade designation "ERL" from Dow Chemical Co., Midland, Mich., such as vinylcyclohexene oxide, vinylcyclohexene dioxide (trade designation "ERL 4206"), 3,4-epoxy-6-methylcyclohexylmethyl-3,4-epoxy-6-methyl-cyclohexene carboxylate (trade designation "ERL 4201"), bis(2,3-epoxycyclopentyl) ether (trade designation "ERL 0400"), 3,4-epoxycyclohexylmethyl-3,4-epoxycyclohexane carboxylate (trade designation "ERL 4221"), bis-(3,4-epoxycyclohexyl) adipate (trade designation "ERL 4289"), aliphatic epoxy modified from polypropylene glycol (trade designations "ERL 4050" and "ERL 4052"), dipentene dioxide (trade designation "ERL 4269"), and 2-(3,4-epoxycylclohexyl-5,5-spiro-3,-4-epoxy) cyclohexene-meta-dioxane (trade designation "ERL 4234"), also included are the glycidyl ether type epoxy resins such as propylene oxide, epichlorohydrin, styrene oxide, glycidol, the series of epoxy resins commercially available under the trade designation "EPON" from Shell Chemical Co., Houston, Tex., including the diglycidyl either of bisphenol A and chain extended versions of this material such as those having the trade designation "EPON 828", "EPON 1001", "EPON 1004", "EPON 1007", "EPON 1009" and "EPON 2002" or their equivalent from other manufacturers, dicyclopentadiene dioxide, epoxidized vegetable oils such as epoxidized linseed and soybean oils commercially available under the trade designations "VIKOLOX" and "VIKOFLEX" from Elf Atochem North America, Inc., Philadelphia, Pa., epoxidized liquid polymers having the trade designation "KRATON", such as "L-207" commercially available from Shell Chemical Co., epoxidized polybutadienes such as those having the trade designation "POLY BD" from Elf Atochem, 1,4-butanediol diglycidyl ether, polyglycidyl ether of phenolformaldehyde, epoxidized phenolic novolac resins such as those commercially available under the trade designations "DEN 431" and "DEN 438" from Dow Chemical Co., epoxidized cresol novolac resins such as the one commercially available under the trade designation "ARALDITE ECN 1299" from Vantico, Inc. Brewster, N.Y., resorcinol diglycidyl ether, epoxidized polystyrene/polybutadiene blends such as those commercially available under the trade designation "EPOFRIEND" such as "EPOFRIEND A1010" from Daicel USA Inc., Fort Lee, N.J., the series of alkyl glycidyl ethers commercially available under the trade designation "HELOXY" from Shell Chemical Co., Houston, Tex., such as alkyl $C_8$-$C_{10}$ glycidyl ether (trade designation "HELOXY MODIFIER 7"), alkyl $C_{12}$-$C_{14}$ glycidyl ether (trade designation "HELOXY MODIFIER 8"), butyl glycidyl ether (trade designation "HELOXY MODIFIER 61"), cresyl glycidyl ether (trade designation "HELOXY MODIFIER 62"), p-tert-butylphenyl glycidyl ether (trade designation "HELOXY MODIFIER 65"), polyfunctional glycidyl ethers such as diglycidyl ether of 1,4-butanediol (trade designation "HELOXY MODIFIER 67"), diglycidyl ether of neopentyl glycol (trade designation "HELOXY MODIFIER 68"), diglycidyl ether of cyclohexanedimethanol (trade designation "HELOXY MODIFIER 107"), trimethylol ethane triglycidyl ether (trade designation "HELOXY MODIFIER 44"), trimethylol propane triglycidyl ether (trade designation "HELOXY MODIFIER 48"), polyglycidyl ether of an aliphatic polyol (trade designation "HELOXY MODIFIER 84"), polyglycol diepoxide (trade designation "HELOXY MODIFIER 32"), and bisphenol F epoxides.

Epoxy resins can include the "ERL" type of resins including 3,4-epoxycyclohexylmethyl-3,4-epoxycyclohexanecarboxylate, bis-(3,4-epoxycyclohexyl) adipate and 2-(3,4-epoxycylclohexyl-5,5-spiro-3-,4-epoxy) cyclohexene-meta-dioxane and the bisphenol A "EPON" type resins including 2,2-bis-(p-(2,3-epoxypropoxy)phenylpropane) and chain extended versions of this material. It is also within the scope of this invention to use a blend of more than one epoxy resin.

Epoxy functional materials can include epoxy functional silanes and difunctional and multifunctional epoxy terminated silicones (commercially available from Gelest Incorporated, Morrisville, Pa.). Examples include, but are not limited to, 2-(3,4-epoxycyclohexyl)ethyl, triethoxysilane and bis [2-(3,4-epoxycyclohexyl)ethyl]-tetramethyl disiloxane. Epoxypropoxypropyl terminated-, epoxycyclohexylethyl terminated-, epoxypropoxypropyl terminated- and epoxypropoxypropyl) dimethoxysilyl terminated-polydimethyl siloxanes and others commercially available from Gelest Incorporated, can also be used by this invention.

It is also within the scope of this invention to use one or more epoxy resins blended together. Different types of resins can be present in any proportion.

The hydroxyl-containing material can optionally contain other functionalities that do not substantially interfere with cationic cure at room temperature. The hydroxyl-containing materials can be nonaromatic in nature, or can contain aromatic functionality. The hydroxyl-containing material can optionally contain heteroatoms in the backbone of the molecule, such as nitrogen, oxygen, sulfur, and the like, provided that the ultimate hydroxyl-containing material does not substantially interfere with cationic cure at room temperature. The hydroxyl-containing material can, for example, be selected from naturally occurring or synthetically prepared cellulosic materials.

Optionally, monohydroxy- and polyhydroxy-alcohols can be added to the curable compositions of the invention, as chain-extenders for the epoxy resin. The hydroxyl-containing material used in the present invention can be any organic material having a hydroxyl functionality of at least 1, or any organic material having a hydroxyl functionality of at least 2.

The hydroxyl-containing material can contain two or more primary or secondary aliphatic hydroxyl groups (i.e., the hydroxyl group is bonded directly to a non-aromatic carbon atom). The hydroxyl groups can be terminally situated, or they can be pendent from a polymer or copolymer. The molecular weight of the hydroxyl-containing organic material can vary from very low (e.g., 32) to very high (e.g., one million or more). Suitable hydroxyl-containing materials can have low molecular weights, i.e., from about 32 to 200, intermediate molecular weight, i.e., from about 200 to 10,000, or high molecular weight, i.e., above about 10,000. As used herein, all molecular weights are weight average molecular weights.

A cationically polymerizable, bi-functional monomer, comprising a polymerizable vinyl group and hydroxymethyl functionality, can be N-methylol acrylamide. A cationically polymerizable, bi-functional monomer that combines a readily polymerizable vinyl group, can for example, be isobutoxymethyl acrylamide. A cationically polymerizable, bi-functional monomer comprised of a polymerizable vinyl group, can for example, be n-butoxymethyl acrylamide moiety. These acrylamide materials can improve wet and dry properties in non-woven fabric; and for coatings, they can enhance scratch and mar resistance and impart superior water and solvent resistance. Their use can improve water and solvent resistance in adhesives. Other applications include latex adhesives, paper coatings, latexes, textiles, non-woven fabrics, can coatings, UV cured systems, photo-resist and latex solution coatings resins.

Any cationically-reactive vinyl ether can be used in the polymerizable compositions of the present invention. Examples of vinyl ethers which can be used include tri(ethyleneglycol) divinyl ether, commercially available under the trade designation "RAPI-CURE DVE-3", from International Specialty Products, Wayne, N.J., di(ethyleneglycol) divinyl ether, di(ethyleneglycol) monovinyl ether, ethylene glycol monovinyl ether, triethyleneglycol methyl vinyl ether, tetraethyleneglycol divinyl ether, glycidyl vinyl ether, butanediol vinyl ether, butanediol divinyl ether, 1,4-cyclohexanedimethanol divinyl ether commercially available under the trade designation "RAPI-CURE CHVE" from International Specialty Products, 1,4-cyclohexanedimethanol monovinyl ether, 4-(1-propenyloxymethyl)-1,3-dioxolan-2-one, 2-chloroethyl vinyl ether, 2-ethylhexyl vinyl ether, methyl vinyl ether, ethyl vinyl ether, n-propyl vinyl ether, isopropyl vinyl ether, n-, iso- and t-butyl vinyl ethers, octadecyl vinyl ether, cyclohexyl vinyl ether, 4-hydroxybutyl vinyl ether, t-amyl vinyl ether, dodecyl vinyl ether, hexanediol di- and mono-vinyl ethers, trimethylolpropane trivinyl ether, commercially available under the trade designation "TMPTVE" from BASF Corp., Mount Olive, N.J., aminopropyl vinyl ether, poly(tetrahydrofuran) divinyl ether, divinyl ether resin commercially available under the trade designation "PLURIOL E200" from BASF Corp., ethylene glycol butyl vinyl ether, 2-diethylaminoethyl vinyl ether, dipropylene glycol divinyl ether, and the divinyl ether resins commercially available under the trade designation "VECTOMER" from Morflex Inc., Greensboro, N.C., such as a vinyl ether terminated aromatic urethane oligomer (trade designations "VECTOMER 2010" and "VECTOMER 2015"), a vinyl ether terminated aliphatic urethane oligomer (trade designation "VECTOMER 2020"), hydroxybutyl vinyl ether isophthalate (trade designation "VECTOMER 4010"), and cyclohexane dimethanol monovinyl ether glutarate (trade designation "VECTOMER 4020"), or their equivalent from other manufacturers. It is within the scope of this invention to use a blend of more than one vinyl ether resin.

It is also within the scope of this invention to use one or more epoxy resins blended with one or more vinyl ether resins. The different kinds of resins can be present in any proportion.

Other nonlimiting examples of cationic compounds which can be used with the present invention include, e.g., the N-methylol acrylamide crosslinking monomer materials. Representative cationic monomers include the N-methylol acrylamide reactants mentioned above, dimethylaminoethyl methacrylate, t-butylaminoethyl methacrylate, 2-hydroxy-3-methacryloxypropyl trimethyl ammonium chloride, allyl-trimethyl-ammonium chloride, S-allyl-thiuronium bromide, s-methul(allyl-thiuronium) methosulphate, diallyl-dibutyl-diammonium chloride, diallyl-dimethyl-ammonium methosulphate, dimethallyl-diethyl-ammonium phosphate, diallyl-dimethyl-ammonium nitrate, S-allyl-(allyl-thiuronium) bromide, N-methyl(4-vinylpyridinium) methosulphate, N-methyl(2-vinylpyridinium) methosulphate, allyl-dimethyl-beta-methacryloxyethyl-ammonium methosulphate, beta-methacryloxymethyl-trimethylammonium nitrate, beta-methacryloxyethyl-trimethylammonium p-toluene-sulphonate, delta-acryloxybutyl-tributylammonium methosulphate, methallyl-dimethyl-O-vinylphenylammonium-chloride, octyldiethyl-m-vinylphenyl-ammonium phosphate, beta-hydroxyethyl-dipropyl-p-vinylphenyl-ammonium bromide, benzyl-dimethyl-2-methyl-5-vinyl-phenyl-ammonium phosphate, 3-hydroxypropyl-diethyl-vinylphenylammonium sulphate, octadecyl-dimethyl-vinylphenyl-ammonium p-toluene sulphonate, amyl-dimethyl-3-methyl-5-vinylphenyl-ammonium thiocyanate, vinyloxyethyl-triethyl-ammonium chloride, N-butyl-5-ethyl-2-vinylpyridinium iodide, N-propyl-2-vinyl-quinolinium methyl sulphate, N-butyl-5-ethyl-3-vinylpyridinium iodide, N-propyl-2-vinyl-quinolinium methyl sulphate, allyl-gamma-myristamidopropyl-dimethyl-ammoniumchloride, methallyl-gamma-caprylamido-propyl-methyl-ethyl-ammonium bromide, allyl-gamma-caprylamidopropyl-methylbenzyl-ammonium phosphate, ethallyl-gamma-myristamidopropyl-methyl-alpha-naphthylmethyl-ammonium chloride, allyl-gamma-palmitamidopropyl-ethyl-hexyl ammonium sulphate, methyallyl-gamma-lauramidopropyldiamyl-ammonium phosphate, propallyl-gamma-lauramidopropyl-diethyl-ammonium phosphate, methallyl-gamma-caprylamido-propyl-methyl-beta-hydroxyethylammonium bromide, allyl-gamma-stearamido-propyl-methyl-dihydroxypropyl-ammonium phosphate, allyl-gamma-lauramidopropyl-benzyl-beta-hydroxyethy-lammonium chloride and methallyl-gamma-abietamidopropyl-hexyl-gamma'-hydroxypropyl-ammonium phosphate, vinyl diethyl-methyl sulphonium iodide, ethylenically unsaturated nitrogen containing cations.

In one embodiment the coating composition can contain one, or more, reactive diluents. For example the coating composition can contain one, or more, of the following nonlimiting examples including anhydrides and oxetane materials for example, but not limited to compounds having an oxetane ring such as 3-ethyl-3-hydroxymethyloxetane, 3-(meth)-allyloxymethyl-3-ethyloxetane, (3-ethyl-3-oxetanylmethoxy)methylbenzene, 4-fluoro-[1-(3-ethyl-3-oxetanylmethoxy)methyl]benzene, 4-methoxy-[1-(3-ethyl-3-oxetanylmethoxy)methyl]-benzene, [1-(3-ethyl-3-oxetanylmethoxy) ethyl]phenyl ether, isobutoxymethyl(3-ethyl-3-oxetanylmethyl) ether, isobornyloxyethyl(3-ethyl-3-oxetanylmethyl) ether, isobornyl(3-ethyl-3-oxetanylmethyl) ether, 2-ethylhexyl(3-ethyl-3-oxetanylmethyl) ether, ethyldiethylene glycol (3-ethyl-3-oxetanylmethyl) ether, dicyclopentadiene (3-ethyl-3-oxetanylmethyl) ether, dicyclopentenyloxyethyl(3-ethyl-3-oxetanylmethyl) ether, dicyclopentenyl(3-ethyl-3-oxetanylmethyl) ether, tetrahydrofurfuryl(3-ethyl-3-oxetanylmethyl) ether, tetrabromophenyl(3-ethyl-3-oxetanylmethyl) ether, 2-tetrabromophenoxyethyl(3-ethyl-3-oxetanylmethyl) ether, tribromophenyl(3-ethyl-3-oxetanylmethyl) ether, 2-tribromophenoxyethyl(3-ethyl-3-oxetanylmethyl) ether, 2-hydroxyethyl(3-ethyl-3-oxetanylmethyl) ether, 2-hydroxypropyl(3-ethyl-3-oxetanylmethyl) ether, butoxyethyl (3-ethyl-3-oxetanylmethyl) ether, penteachlorophenyl(3-ethyl-3-oxetanylmethyl) ether, pentabromophenyl(3-ethyl-3-oxetanylmethyl) ether, bornyl(3-ethyl-3-oxetanylmethyl) ether, compounds having two or more oxetane rings, or compounds having two or more oxetane rings such as, 3,7-bis(3-oxetanyl)-5-oxa-nonane, 3,3'-(1,3-(2-methylenyl)propanediylbis-(oxymethylene))-bis-(3-ethyloxetane), 1,4-bis[(3-ethyl-3-oxetanylmethoxy)methyl]benzene, 1,2-bis[(3-ethyl-3-oxetanylmethoxy) methyl]ethane; 1,3-bis[(3-ethyl-3-oxetanylmethoxy)methyl]propane; ethylene glycol bis(3-ethyl-3-oxetanylmethyl) ether; dicyclopentenylbis(3-ethyl-3-oxetanylmethyl) ether; triethylene glycol bis(3-ethyl-3-oxetanylmethyl) ether; tetraethylene glycol bis(3-ethyl-3-oxetanylmethyl) ether, tricyclodecanediyldimethylene bis(3-ethyl-3-oxetanylmethyl) ether, trimethylolpropane tris(3-ethyl-3-oxetanylmethyl) ether, 1,4-bis(3-ethyl-3-oxetanylmethyl)butane, 1,6-bis(3-ethyl-3-oxetanylmethoxy) hexane, pentaerythritol tris(3-ethyl-3-oxetanylmethyl) ether, pentaerythritol tetrakis(3-ethyl-3-oxetanylmethyl) ether, polyethylene glycol bis(3-ethyl-3-oxetanylmethyl) ether, dipentaerythritol hexakis(3-ethyl-3-oxetanylmethyl), ether, dipentaerythritol pentakis(3-ethyl-3-oxetanylmethyl) ether, dipentaerythritol tetrakis(3-ethyl-3-oxetanylmethyl) ether, caprolactone modified dipentaerythritol hexakis(3-ethyl-3-oxetanylmethyl) ether, caprolactone modified dipentaerythritol pentakis(3-ethyl-3-oxetanylmethyl) ether, ditrimethylolpropane tetrakis(3-ethyl-3-oxetanylmethyl) ether, EO modified bisphenol A bis(3-ethyl-3-oxetanylmethyl) ether, PO modified bisphenol A bis(3-ethyl-3-oxetanylmethyl) ether, EO modified hydrogenated bisphenol A bis(3-ethyl-3-oxetanylmethyl) ether, PO modified hydrogenated bis(3-ethyl-3-oxetanylmethyl) ether, EO modified bisphenol F bis (3-ethyl-3-oxetanylmethyl) ether. Solvents and diluents cab be employed to, among other purposes, reduce the viscosity of coating compositions.

Photoinitiators can be utilized in this invention. A "Photoinitiator" (also "photo-curing" material) includes any agent which when exposed to a specific wavelength of energy forms a reactive element which can begin the chain reaction to cause polymer formation. Photoinitiators for radical curing reactions can contain benzoil groups. Aryl sulfonium (also aryl "sulphonium") salts can generate both radical type and cationic active centers.

Photoinitiators which can be used include, but are not limited to, iodonium salts and sulfonium, salts diazonium salts, (also known as organohalogenides) and thioxanthonium salts.

Any suitable iodonium salt can be used with this invention. Iodonium salts include, but are not limited to, iodonium, (4-methylphenyl) [4 (2-methylpropyl) phenyl]-, hexafluorophosphate(1-) (e.g., Irgacure 250 by Ciba Specialty Chemicals, Tarrytown, N.Y.). Iodonium salts (e.g., Irgacure 250) produce an acid capable of inducing cure or polymerization of epoxy compounds, cycloaliphatic epoxy compounds, oxetane compounds and compounds with epoxy and/or cycloaliphatic epoxy or oxetane groups.

Examples of useful aromatic iodonium complex salt photoinitiators include, but are not limited to, diphenyliodonium tetrafluoroborate; di(4-methylphenyl) iodonium tetrafluoroborate; phenyl-4-methylphenyliodonium tetrafluoroborate; di(4-heptylphenyl)iodonium tetrafluoroborate; di(3-nitrophenyl)iodonium hexafluorophosphate; di(4-chlorophenyl)iodonium hexafluorophosphate; di(naphthyl) iodonium tetrafluoroborate; di(4-trifluoromethylphenyl) iodonium tetrafluoroborate; diphenyliodonium hexafluorophosphate; di(4-methylphenyl)iodonium hexafluorophosphate; diphenyliodonium hexafluoroarsenate; di(4-phenoxyphenyl)iodonium tetrafluoroborate; phenyl-2-thienyliodonium hexafluorophosphate; 3,5-dimethylpyrazolyl-4-phenyliodonium hexafluorophosphate; diphenyliodonium hexafluoroantimonate; 2,2'-diphenyliodonium tetrafluoroborate; di(2,4-dichlorophenyl)iodonium hexafluorophosphate; di(4-bromophenyl)iodonium hexafluorophosphate; di(4-methoxyphenyl)iodonium hexafluorophosphate; di(3-carboxyphenyl)iodonium hexafluorophosphate; di(3-methoxycarbonylphenyl)iodonium hexafluorophosphate; di(3-methoxysulfonylphenyl)iodonium hexafluorophosphate; di(4-acetamidophenyl)iodonium hexafluorophosphate; di(2-benzothienyl)iodonium hexafluorophosphate; and diphenyliodonium hexafluoroantimonate (DPISbF6).

One or more sufonium salt(s) can be used with this invention. Arylsufonium salts include, but are not limited to, mixed arylsulfonium hexafluoroantimonate salts (e.g., Cyracure UVI-6976 produced by Dow Chemicals Midland, Mich.) and arylsulfonium hexafluorophosphate salts (e.g., UVI-6992 produced by Dow Chemicals, Midland, Mich.).

Other photoinitiators which can be used include, but are not limited to, Meerkat, Polecat and Bobcat (each of Meerkat, Polecat and Bobcat is produced by Sun Chemical at Parsippany, N.J.). Photoinitiators such as, but not limited, to Meerkat, Polecat and Bobcat can be used to reduce toxic by-products of photo-cleavage by combining substrate acidity and process parameters i.e., coating temperature, substrate temperature, percent relative humidity, photoinitiator type and level, photosensitizer type and level and photon degree of penetration and photon energy level.

Any suitable diazonium salt can be used with this invention as a photoinitiator and/or synergist. Aryl diazonium salts of complex halogenides can function synergistically when combined with organohalogen compounds. Amino-aryldiazonium salts of complex halogenides in which said amino group can be present as a substituent on the aryl ring as well as compounds in which the amino group is part of a heterocyclic ring. These aryldiazonium compounds require the application of heat following light exposure to aid in curing when employed as photoinitiators for epoxide photopolymerization. A synergistic effect can be realized with the organohalogens as a result of photolysis. An acidic product (e.g., $H^+X^-$) can be provided which neutralizes the effect of the amino nitrogen and releases the Lewis acid derived from the diazonium salt. A synergistic effect can be obtained with the combined catalysts, 2-chloro-4-(dimethylamino)-5-methoxybenzenediazonium.

Any suitable thioxanthonium salt photoinitiator can be used with this invention. Thioxanthonium salts include, but are not limited to, 10-biphenyl-4-yl-2-isopropyl-9-oxo-9H-thioxanthen-10-ium hexafluorophosphate (e.g. Meerkat by Sun Chemical at Parsippany, N.J.). Other thioxanthonium salt photoinitiators from Sun Chemical include Polecat and Bobcat. Polecat and Bobcat thioxanthonium salts have two thioxanthonium functional end groups connected together to reduce migration of photo cleavage byproducts. Such photoinitiators can be used to reduce toxic by-products of photocleavage in, for example, food contact applications.

Synergists or co-catalysts, such as but not limited to, tertiary amine or photopolymerizable epoxy monomers bearing benzyl, allyl and/or propargyl acetal and ether groups can be used by this invention.

Byproducts of photoinitiator and photosensitizer activation can be odorous. In some embodiments, the present invention can provide reduced, little or no odor resulting from photoinitiators. Irgacure 250 with Speedcure CPTX can be employed and produced fewer odors than a sulphonium photoinitiator. Articles that come in contact with food, as defined and regulated by the Food Packaging Industry in the USA and around the World, are monitored, regulated and/or restricted based on their chemical nature, composition and transient components. Sulphonium salt cationic photoinitiators like Polecat, Meercat and Bobcat commercially available from Sun Chemical, can be used for food contact articles and applications. An article intended for food contact can be produced as a product of this invention.

Photolabile acids can be utilized with this invention. These include, but are not limited to any one, or more, of sulfonium salts, iodonium salts, halogenated aromatic compounds, halogenated triazines, nitrobenzyl esters, tris(methanesulfonyloxy) benzene, and aryl naphthoquinonediazide-4-sulfonates (also "sulphonate").

Photo-labile acids can be added to the ink for odor free curing. Suitable photo-labile acids can be incorporated in the substrate or a layer of coating applied to a substrate and in some embodiments can be activated with UV light to release an acidic material.

Photo-labile acids can be added to the ink for odor free curing. Photo-labile acids can be incorporated in the substrate or in any layer of coating applied to a substrate. In some embodiments photo-labile acids can be activated with UV light to release an acidic material. Photo-labile acids can be applied in a first layer directly upon (a layer or amount in contact with) a substrate.

Iodonium salt photoinitiator can be added to a coating and can be selected to reduce odor. Iodonium salt photoinitiator, (e.g. Irgacure 250), used herein, produced photo-cleavage byproducts whose odor was more preferred than photo-cleavage byproducts from sulphonium salt photoinitiators. Thioxanthonium photoinitiators, (e.g. Meerkat, Polecat and Bobcat (each produced by Sun Chemical at Parsippany, N.J.) can also be used by this invention to reduce toxicity due to photo-cleavage byproducts (i.e. odor toxicity mutagenicity regulation restriction). Photo-labile acids can also be employed to further reduce the required photoinitiator level for cure and further reduce the toxic photo-cleavage byproducts. With a given coating temperature, substrate temperature, percent relative humidity, this invention can be used, for example, with photoinitiator types and levels (e.g., 1.0% or lower) and their blends, photosensitizer type and level (0.5 or lower) and photon degree of penetration and photon energy level, as described herein, to balance differential cure.

Suitable photo-labile acids can be incorporated in the substrate or first layer of an application to be activated with UV light to release an acidic material.

Chemically amplified imaging and photo-resist materials can benefit from the employment of photogenerated acid. Acid-catalyzed reactions include, but are not limited to one or more of: catalyzed thermolysis of polymer side-chains; catalyzed thermolysis of polymer main-chains; catalyzed hydrolysis of polymer side-chains; catalyzed hydrolysis of polymer main-chains; depolymerization processes based on ceiling temperature phenomenon; electrophilic aromatic substitution reactions; and electrophilic rearrangements In the process of producing a polyester substrate, mono-, di-, tri and/or polyfunctional acid(s) can be polymerized with mono-, di-, tri and/or, polyfunctional hydroxyl containing materials catalyzed by an acid(s). The substrates can posses "residual acid functionality", containing acid, acidic end groups and/or acid of catalysis from the reaction.

Cationically-curable materials can be combined with a three-component or ternary photoinitiator system. The first component in the photoinitiator system can be an iodonium salt, i.e., a diaryliodonium salt. The iodonium salt desirably is soluble in the monomer and can be shelf-stable, meaning it does not spontaneously promote polymerization when dissolved therein in the presence of the sensitizer and donor. Accordingly, selection of a particular iodonium salt can depend to some extent upon the particular monomer, sensitizer and donor chosen. The iodonium salt can be a simple salt, containing an anion such as $Cl^-$, $Br^-$, $I^-$ or $C_4H_5SO_3^-$; or a metal complex salt containing an antimonate, arsenate, phosphate or borate such as $SbF_5OH^-$ or $AsF_6^-$. Mixtures of iodonium salts can be used if desired Aromatic iodonium complex salts which can be used include, but are not limited to, diaryliodonium hexafluorophosphate and diaryliodonium hexafluoroantimonate.

Photoinitiator compounds can be provided in an amount effective to initiate or enhance the rate of cure of a resin system. The iodonium initiator can be present in a range of 0.05-10.0 wt %, or in another embodiment 0.10-5.0 wt %, or even in a range of 0.50-3.0 wt % based on resin solids of the overall composition. The sensitizer can be present in about 0.05-5.0 wt % based on resin compounds of the overall composition. The sensitizer can be present at 0.10-1.0 wt %. The electron donor can be present in a range of 0.01-5.0 wt %, or 0.05-1.0 wt %, and in another embodiment 0.05-0.50 wt % based on resin solids of the overall composition.

A second component in a photoinitiator system can be a sensitizer. The sensitizer can be soluble in the monomer, and is capable of light absorption within the range of wavelengths of greater than 300 nm to 1200 nm, and is chosen so as not to interfere with the cationic curing process.

Sensitizers can be used in this invention. Sensitizers which can be used include thioxanthones. Thioxanthones include, but are not limited to 1-chloro-4-propoxythioxanthone and 1-Chloro-4-Propoxy-9H-Thioxanthen-9-one Speedcure CPTX (Aceto Corporation, Lake Success, N.Y.). Sensitizers include, but are not limited to, Aceto 73 (Aceto Corporation, Lake Success, N.Y.). Aceto 73, 9, 10-diethoxyanthracene (CAS#68818-86-0), in combination with Speedcure CPTX is one sensitizer system which can be used with iodonium salt in the cationic curing of epoxy resins.

Sensitizers can include, but are not limited to, compounds in the following categories: ketones, coumarin dyes (e.g., ketocoumarins), xanthene dyes, acridine dyes, thiazole dyes, thiazine dyes, oxazine dyes, azine dyes, aminoketone dyes, porphyrins, aromatic polycyclic hydrocarbons, p-substituted aminostyryl ketone compounds, aminotriaryl methanes, merocyanines, squarylium dyes and pyridinium dyes. Ketones (e.g., monoketones or alpha-diketones), ketocoumarins, aminoarylketones and p-substituted aminostyryl ketone compounds are sensitizers. Applications requiring high sensitivity can employ a sensitizer containing a julolidinyl moiety. Applications requiring deep cure (e.g., cure of highly-filled composites), can employ sensitizers having an extinction coefficient below about 1000, or below about 100, at the desired wavelength of irradiation for photopolymerization. Alternatively, dyes that exhibit reduction in light absorption at the excitation wavelength upon irradiation can be used.

In one embodiment, ketone sensitizers having the formula: $ACO(X)_bB$ in which X is CO or $CR^1R^2$, where $R^1$ and $R^2$ can be the same or different, and can be hydrogen, alkyl, alkaryl or aralkyl, b is zero or one, and A and B can be the same or different and can be substituted (having one or more non-interfering substituents) or unsubstituted aryl, alkyl, alkaryl, or aralkyl groups, or together A and B can form a cyclic structure which can be a substituted or unsubstituted cycloaliphatic, aromatic, heteroaromatic or fused aromatic ring. Ketones of the above formula include monoketones (b=0) such as 2,2-, 4,4- or 2,4-dihydroxybenzophenone, di-2-pyridyl ketone, di-2-furanyl ketone, di-2-thiophenyl ketone, benzoin, fluorenone, chalcone, Michler's ketone, 2-fluoro-9-fluorenone, 2-chlorothioxanthone, acetophenone, benzophenone, 1- or 2-acetonaphthone, 9-acetylanthracene, 2-, 3- or 9-acetylphenanthrene, 4-acetylbiphenyl, propiophenone, n-butyrophenone, valerophenone, 2-, 3- or 4-acetylpyridine, 3-acetylcoumarin and the like. Suitable diketones include aralkyldiketones such as anthraquinone, phenanthrenequinone, o-, m- and p-diacetylbenzene, 1,3-, 1,4-, 1,5-, 1,6-, 1,7- and 1,8-diacetylnaphthalene, 1,5-, 1,8- and 9,10-diacetylanthracene, and the like. Suitable alpha-diketones (b=1 and X=CO) include 2,3-butanedione, 2,3-pentanedione, 2,3-hexanedione, 3,4-hexanedione, 2,3-heptanedione, 3,4-heptanedione, 2,3-octanedione, 4,5-octanedione, benzil, 2,2'-3,3'- and 4,4'-dihydroxylbenzil, furil, di-3,3'-indolylethanedione, 2,3-bornanedione (camphorquinone), biacetyl, 1,2-cyclohexanedione, 1,2-naphthaquinone, acenaphthaquinone, and the like.

Another component of an initiator system can be an electron donor (also "donor"). The donor can be selected in consideration of factors, such but not limited to shelf stability and the nature of the polymerizable materials, iodonium salt and sensitizer chosen. The donor can be alkyl aromatic polyether or an N-alkyl arylamino compound wherein the aryl group is substituted by one or more electron withdrawing groups. Examples of suitable electron withdrawing groups include carboxylic acid, carboxylic acid ester, ketone, aldehyde, sulfonic acid, sulfonate and nitrile groups.

N-alkyl arylamino donor compounds can be used and can include, for example, compounds of the following structural Formula 1:

Formula 1

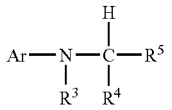

wherein each $R^3$, $R^4$ and $R^5$ can be the same or different, and can be H, $C_{1-18}$ alkyl which is optionally substituted by one or more halogen, —CN, —OH, —SH, $C_{1-18}$ alkoxy, $C_{1-18}$ alkylthio, $C_{3-18}$ cycloalkyl, aryl, COOH, $COOC_{1-18}$ alkyl, $(C_{1-18}\text{ alkyl})_{0-1}$-CO—$C_{1-18}$ alkyl, $SO_3R^6$, CN or an aryl group which is optionally substituted by one or more electron withdrawing groups, or the $R^3$, $R^4$ or $R^5$ groups can be joined to form a ring; and Ar is aryl which is substituted by one or more electron withdrawing groups. Suitable electron withdrawing groups include —COOH, —$COOR^6$, —$SO_3R^6$, —CN, —CO—$C_{1-18}$ alkyl and —C(O)H groups, wherein $R^6$ can be a $C_{1-18}$ straight-chain, branched, or cyclic alkyl group.

Donor compounds can include 4-dimethylaminobenzoic acid, ethyl 4-dimethylaminobenzoate, 3-dimethylaminobenzoic acid, 4-dimethylaminobenzoin, 4-dimethylaminobenzaldehyde, 4-dimethylaminobenzonitrile and 1,2,4-trimethoxybenzene.

Blends and levels of photoinitiator, sensitizer and synergists can be utilized in the practice of this invention. Photoinitiators can be used in conjunction with process variables (parameters) including, but not limited to, light source, light wavelength(s), dosage, substrate temperature and/or coating temperature. Such practice of this invention can produce articles which have finishes which include, but are not limited to, smooth, standard, textured, matte, glossy or wrinkled.

"Photoiniator package" (also "photointiator packages") include for example, but are not limited to, one, more or a blend of photoactive cationic compounds with or without one, or a blend of photosensitizers as designed to create an article which is, but not limited to, smooth, textured, matte, glossy or wrinkled.

Photoactive cationic materials include for example, but are not limited to, photoactive nuclei, photoactive cationic moieties and/or photoactive cationic organic compounds.

The coating compositions utilized with this invention can include a broad variety of additives. These additives can be added to modify a coating composition, a coating characteristic and physical properties including for example, but not limited to color, density, conductivity, flexibility, oxidation, degradation (by, i.e., chemicals, heat or light), scent, pH, and flow characteristics.

The additives which can be used include, but are not limited to: biocides, antimicrobial agents, antibiotic agents, antifungal agents, lightfast agents, magnetic materials, dyes, fixatives, flavors, perfumes, volatile compounds, anticurl agents, anti-discoloration agents, indicator dyes, actinic molecules, metal atoms, metal containing compounds and flame retardants. The coating composition can, e.g., contain one or more of pigment(s), photoinitiator(s), sensitizer(s), additive(s), filler(s), antidegradant(s) and antioxidant(s).

Additives which are commonly used for outdoor durability include, but are not limited to, UV light stabilizers and absorbers, such as but not limited to benzophenones, benzotriazoles, benzoxazinones, hindered benzoates, hindered amines or hindered amine light stabilizers (HALS) and triazines. Antioxidants are also use in outdoor coating applications and include but are not limited to hindred phenolics, phosphite blends and thiosesters. Radical scavengers are yet another class of compounds used for outdoor durability and include the triazines and hindered amine (HALS) radical scavengers.

The basicity of additive materials and cure rate can be coordinated to allow a broad range of additives to be used. The level of photoactive, acid generating compounds in the coating or substrate can be coordinated with the acid nature of the substrate such that the cure rate of the coating surface, coating bulk and coating-substrate interface produce the desired article.

Antioxidants can be employed with this invention. Antioxidants which can be employed include, for example, but are not limited to, Good-rite® antioxidants (from Noveon Inc., Akron, Ohio, USA).

Hygienic powder coatings can be used in this invention. Antibacterial powders can be employed. High-temperature-resistant powders can be used in this invention. Silicone-based powder coatings can be used. Thin-film powders can be used in this invention. Powders that range from 0.8-1.2 mils can be used. UV-curable powders can be used in this invention. Near-infrared-curable powders can be used in this invention, e.g., in heat-sensitive applications.

A variety of filler materials can be used in the coating composition of this invention. A filler material can be, but is not limited, to an inert substance added for a purpose other than as a pigment. Filler materials can be used as necessary to reduce cost, enhance film properties or influence flow and leveling characteristics. These fillers can include, but are not limited, to barytes, clay, flattener, glass, talc and/or nanoparticle anti-scratch materials.

"Pigments" include any material or materials which add color to other materials. "Pigmented" materials include, but are not limited to, coatings and inks for printed images and any material including a pigment. Pigments can have color strength and hiding power. Pigmented materials can be decorative in nature or serve other utilities such as light absorption, reflectivity, polish, or finish. Other pigments provide interactive changes like thermochromic or photochromic, photoluminescent glow-in-the-dark, UV fluorescent and IR reactive. Pigmented materials can be utilized for a broad variety of purposes.

"High pigmented" materials include, but are not limited to, substances containing pigments with low opacity which provide hiding power at elevated concentrations. High pigment levels in inks can achieve equal color densities while printing less ink. Hiding power refers to the ability of a pigmented system to cover or hide color contribution made by the coated substrate and is tested by Delta E/Delta Color over Laneta Black and White color charts.

"Coating composition" is to be broadly construed and includes examples including, but not limited to: inks, paints powders, composites, solutions, mixtures, emulsions, liquids, pastes, deposited gases, solids dispersions, emulsions, adhesives, adhesion promoters and/or conductive circuits.

"Cationic coating composition" includes any composition having in part a cationically polymerizable functionalized material such as epoxy functionalized optionally with a cationically polymerizable vinyl ether functionalized material optionally with monohydroxy- and polyhydroxyl alcohols as chain extenders, with a photoinitiator package, optionally with a pigment, optionally with a solvent can be used by this invention.

A cationic ink can include one, or more, compound(s) based on cycloaliphatic epoxides with reactive diluent(s) oxetanes and/or vinyl ethers, pigments and optionally with a photoinitiator and optionally with a sensitizer can be used with this invention. Any cationic coating composition employed as, or which can be employed as an ink, can be considered as a cationic ink.

Bifunctional monomers can also be used and can include, but are not limited to, at least one cationically polymerizable functionality or a functionality that copolymerizes with cationically polymerizable monomers, e.g., functionalities which can allow an epoxy-alcohol copolymerization.

When two or more polymerizable compositions are present, they can be present in any proportion.

"Color" is a visual attribute of a thing. Color results from the light emitted, transmitted or reflected. For example, a white color is made up of many different wavelengths of light. Colors include, but are not limited to, formulations of coatings to achieve a particular visual attribute suited for an application including color, hiding.

Colors of inks and coatings used in this invention can include, but are not limited to, Cyan, Yellow, Magenta, Black, Lt. Magenta, Lt. Cyan, Green, Orange and Violet, as well as any blend or hue of these colors. Other colors include for example, but are not limited to, metallics, transition, mica, pearlized, silver, chrome-effect and clear.

"Multicolor" includes coatings, compounds, articles and products having more than one color or hue. This term includes but is not limited to overt color shift and semi-covert light polarization as it relates to the security or anti-counterfeiting inks applications for driver license, identification cards or badges. Hammertones or veins result in antique or distressed looks created by a black base with metallic pigments of gold, silver, or copper contrasting against the black. This weathered look is popular in the furniture and display industries, which demand a range of multicolor looks including granite, confetti, rusty, and weathered appearances.

"Clearcoat" or "clearcoats" include coatings which can be without pigments. However, a clearcoat can include pigment-like materials which do not substantially affect color, as well as nanoparticles, fillers and additives.

"Metallic coatings" and/or "metallics" include a metallic flake, or pigment, or metal which can be applied to a substrate. Metallic coatings can add sparkle highlights, which can reproduce the appearance of the base metal and add richness to the look of the product. A variety of metallic finishes can be used for example in products such as indoor and outdoor furniture, exercise equipment, lawn and garden tools, and other products, which can resemble the look of gold, chrome, or brass. Further, metallic coatings can provide conductivity, modify coating density and modify electromagnetic or magnetic properties.

Solvents can be used in the coating composition of this invention. Solvent(s) which can be are included, but are not limited to any one or more of cyclohexanone, water, acetates, ketones, aromatics, aliphatics and/or esters.

A "dispersant" is a component of a solution which can help wet the pigment surface or other particles and prevents agglomeration. A dispersant also includes a component of a solution or composition which helps wet a pigment or other component, and facilitates dispersion of the same within a composition, mixture or solution. A dispersant can prevent or reduce agglomeration as compared to compositions without dispersant. Dispersants can be utilized with this invention. Pigments and dispersants of can raise the coating pH and can affect cure rates as they can compete for acid during the cure step.

Hyperdispersant Technology can be utilized with this invention.

Nonlimiting examples of dispersants which can be optionally utilized with this invention includes COLORBURST dispersants (Noveon Cleveland, Ohio USA) which can be used in the dispersion of pigments in solvent paste and liquid inks. Dispersants can improve color development and gloss, increase pigment loading, improve antisettling and maintain temperature and shear stability. Solsperse® and Solplus® (Noveon Cleveland, Ohio USA) can also be used.

The invention includes and can utilize ink jet printing inks. Ink jet printing inks can provide a printer with a deliverable color palette, much like a painter, which can be interlaced and applied to media producing decorative, printed, coated and/or protected articles as printed images, signs, documents, banners and such.

Light curing inks can be of an ink jetting viscosity and can use reactive diluents, or nonreactive diluents. Reactive diluents can include ingredients which react with and dilute the ink formulation to a viscosity range which can be reliably printed by the inkjet print head. Jetting reliably is designed into the ink shear stress and flow characteristics such that piezoelectric inkjet print heads expel a droplet with repeatable drop size, drop shape and drop velocity. The curing or reaction rate for light curing technologies can range from almost zero, to milliseconds, or to longer periods of time. In free radical inks, that cure rate and curing process can generate internal stresses, as the monomers and oligomers are polymerized (e.g., from free volume or ink film shrinkage). This is often attributed to the poor adhesion and poor flexibility seen with free radical ink systems. Cationic light cure ink technology reacts at a speed which is on an order of magnitude slower than free radical light cure ink and actually can be considered as a living polymerization. The initiated polymerization can continue after the activating light has been removed know as dark cure. The reactive cationic site can propagate through ring opening or ring strain relieving polymerization and lead to more flexible ink film.

As used herein, a substrate is any material onto which an amount of coating composition, or other material involved in a coating system, can be applied. Substrates include, but are not limited to PVC, commercial cast and calendared vinyls and rigid substrates for nonlimiting examples such as those used in the signage and specialty graphics industry. Other substrates include metal, wood, plastic, fabrics, cotton, wool, others, and previously coated articles like automobiles.

A "substrate synthetic process" includes the compounding, forming, molding, pressing, extruding, pretreating and/or post treating and/or annealing to generate the final substrate for an application.

An "acidic substrate" includes any material to be coated that has an acidic nature or photolabile, thermal labile or process labile acidic potential.

An "acid containing substrate" includes any material to be coated that has a pH of 7.0 or lower, an acidic nature or photolabile, thermal labile or process labile acidic potential A "heat sensitive substrate" includes any substrate whose physical properties or characteristics change as a function of temperature. Such physical properties can include, but are not limited to, one or more of the following: color, dimension, density, flexibility, toughness, hardness, viscosity, brittleness, finish, composition, chemistry and look. Heat sensitive substrates include, but are not limited to, those with thermal expansions that lead to out of plane deformation, color changes, chemical changes, or undesired temperature dependant changes. In one embodiment, color or dimension temperature sensitive substrates can be used in this invention to avoid temperature related changes.

A substrate in this invention can be acidic in nature, or not acidic in nature. Further, acid can be applied to the substrate directly or in conjunction with the application of a coating composition, or coating system having additional components, e.g., additives, diluents, and other materials disclosed herein.

The processes which release or deposit an acid onto, or which increase the acidic nature of the substrate (to a pH of 7.0 or lower) can include, but are not limited to, coating with an acid or acidic solution, in-mold coating applied prior to injection molding a plastic part, curtain coating with an acidic rinse prior to coating, wiping and/or spraying the substrate with an acidic solution. These processes can be quantified by (Fourier Transform Infrared Spectroscopy) FTIR spectroscopy or pH and/or etching of the substrate surface as seen by gloss change.

In one embodiment, a substrate is treated by flame exposure or acid etching at the location to be coated. Moisture and acid can be used to convert a polyester backbone back to its starting polyol and polyacid and can cause the unzipping of a polyester backbone and can make acid available for coating a substrate interface for cure and adhesion. The decomposition can be quantified by surface FTIR spectroscopy or pH.

The acidic surface can aid adhesion through covalent bonding of the coating to the substrate surface. Acid etching of the substrate can also enhance adhesion. Other methods to enhance adhesion include, but are not limited to, plasma and corona treatment and/or adhesion promoters.

Substrate acid content can be combined with process parameters which can include, but are not limited to, time from application of a coating (or an amount of coating) before light exposure, print speed, coating temperature, substrate temperature, percent relative humidity, coating thickness, pigment level and type to create the desired article.

Some color powders which can be used cure at low temperatures, e.g., below 212° F. These powders can be used on temperature-sensitive materials, and parts which can utilize large amounts of energy with other curing systems. Heat sensitive powders can also be used with wood materials such as particle board and fiberboard, as well as glass and plastic products, can now benefit from a powder coated finish. Other products can include office furniture, kitchen cabinets, and ready-to-assemble furniture for homeowners. Preassembled components such as electrical motors, shock absorbers, foam-core doors, and other products which can have plastics, laminations, electrical wires, or rubber seals, can also receive a powder coated finish. In addition, heat-sensitive alloys such as magnesium can be powder coated. This technology allows for reduced Volatile Organic Compound emissions and is environmentally friendly.

In one embodiment, this invention allows for the coating of "heat sensitive substrates" and "heat sensitive articles" which include any material having properties that change as a function of temperature. For example, heat sensitive articles can include, but are not limited to: coroplast, sintra, styrene, biological, cellular, epithelial, skin, plasma, ocular, lense, conductive and photographic articles or materials.

Application techniques for coating objects can include any one, or more, of the following non-limiting techniques ink jet, ink jetted films and prints, brushed, sprayed, in-mold coated prior to injection molding parts, electrodeposition or E-Coat e.g., vapor deposition and applications that form a multi-layer substrate plus coating composite.

Coating thickness is dependent on the application and end use. Adjustment of line speed, light intensity and photoinitiator type and level as well as the acidity of the substrate can be tailored to the end product application.

The scope of the invention can include an applied acid, or activated acid substrate, of pH 7.0 or lower, or an acid pretreatment, followed by an applied coating which can be then over coated with an over varnish or clearcoat. Additional layers can also be used to generate color affects, e.g., Chrome effect, transition mica colors, soft feel, and others.

Acid in the substrate plus ink, which can be jetted, can be followed by exposure to a lamp for curing and to produce a coated article. The ink can be jetted at ink jet frequencies, e.g., but not limited, in a range of 5-20 kHz, or higher, and optionally with line speeds which can be of a range for example, but not limited to, about 0 $ft^2$/hr to about 50 $ft^2$/hr, and up to about 6400 $ft^2$/hr or higher.

The physical property data that characterize the applied solutions/coatings/inks can be governed by the use and final required performance properties.

Viscosity was reduced with a reactive diluent trimethylol propane oxetane ("TMPO" from Perstorp Specialty Chemicals AB Perstorp, Sweden). Viscosity was reduced with a reactive diluent Rapicure DVE-3 obtained from ISP International Specialty Products Germany.

Curing can include the step of reacting a monofunctional cationically polymerizable functional group, or a difunctional cationically polymerizable functional group, or a trifunctional cationically polymerizable functional group, or a multifunctional cationically polymerizable functional group of said cationic coating composition.

In some embodiments a coating composition, or a coating system, is evenly and uniformly applied to a substrate of consistent characteristics. In other embodiments it is not.

Figure 2:
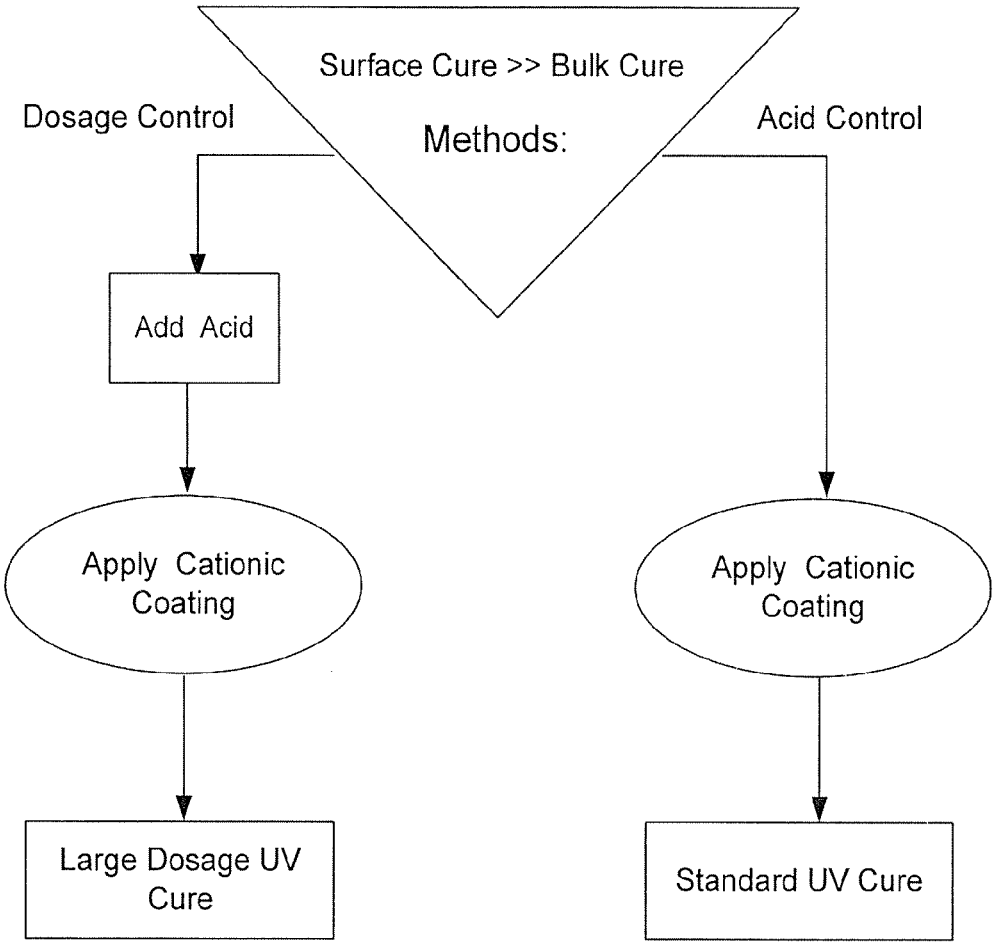
FIG. 2 Textured Finish Process Flow Diagram.

FIG. 2 is a process flow diagram illustrating an embodiment of the process for a differential application of coating. In a differential application of coating, at least one characteristic of a coating, application or curing of a first portion is different than a characteristic of a coating, application or curing of a second portion. The first and second portion can be on the same coating layer or different layers. A broad range of characteristics and combination of differences in coatings, application techniques and curing methods is encompassed in this invention.

Figure 14:
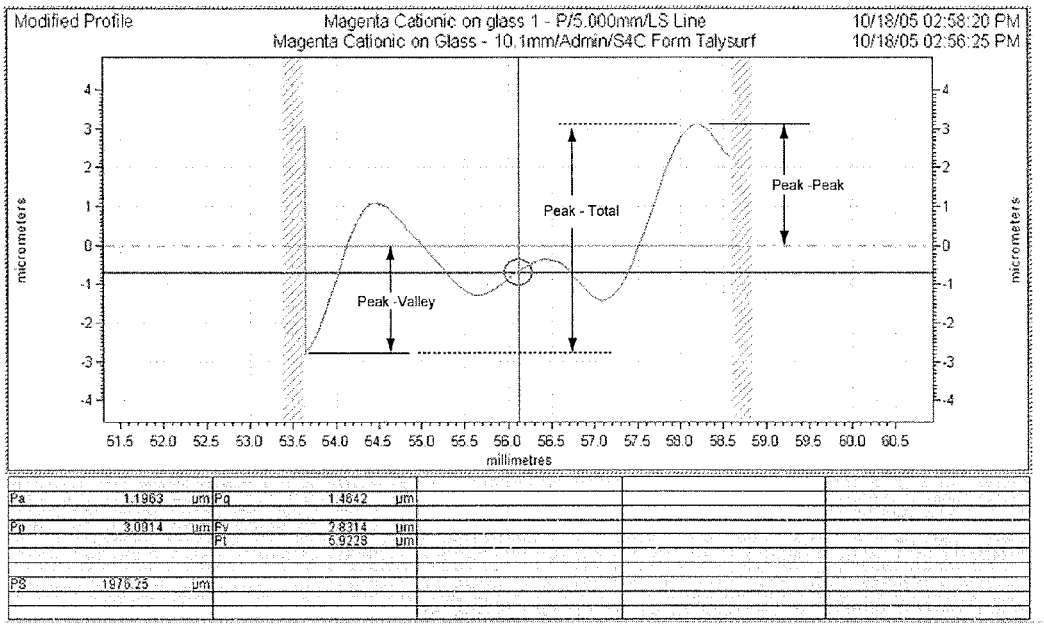
FIG. 14: Coating Profile Measured By Profilometer.

FIG. 14 illustrates the profilometer modified profile created from profilometer data in this example was collected using Taylor Hobson Profilometer. The profilometer data was collected using a five millimeter travel across the test area and perpendicular to the wrinkle such that valleys and peaks were measured. The "Peak Total" equals the sum of the "Peak Valley" plus the "Peak Peak" in the units of micrometers.

Figure 15:
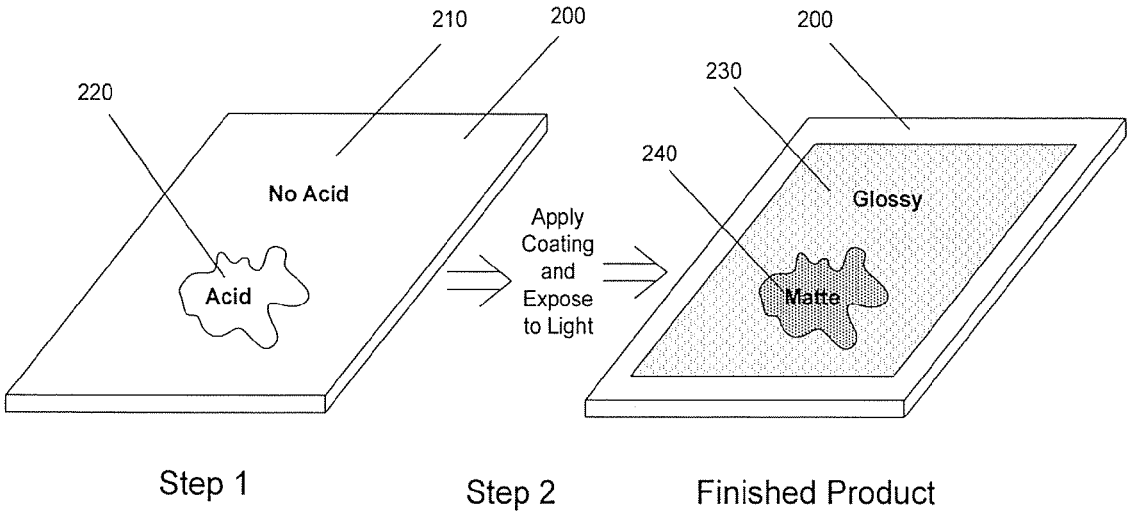
FIG. 15: Multi-Texture Process Flow Diagram.

FIG. 15 illustrates an acidic, acid and/or acid photo labile acid containing substrate with or without a coating, laminate, pretreatment and/or adhesion promoter (200) to be coated using this invention. The substrate, (200), can have a first portion or area (210), which is not exposed to acid or where an acid is not applied and/or and acid is not activated and/or is not acidic, as it is described herein, prior to receiving a coating and at least a second portion or area (220), on said substrate (200), exposed to an acid or where an acid is applied and/or and acid is activated and/or is acidic, as it is described herein, prior to receiving a coating.

In the example embodiment illustrated in FIG. 15 coating is applied to the first portion or area (210), for curing as a first cured portion and to the second portion or area (220) for curing as a second cured portion. The first coated portion or area (210), and the second coated portion or area (220), are cured. The first cured portion or area, (210), and the second cured portion or area (220), can have finishes which are not the same. The finish which is obtained for each portion or area (210), and/or (220), of a cured coating is a result of a combination of variables including, but not limited to, acidity of the substrate (200), type of coating, time before cure, and length and nature of cure. In FIG. 15 a textured surface having a wrinkle finish can be obtained.

"Texture" (also "Textures" or "Textured") coatings can be used to hide substrate irregularities and fingerprints. Texture can provide a nonslip surface while giving a feel to a product. Appearances which can be achieved with Texture finisher vary for nonlimiting example from the look of fine sandpaper, a pebbly texture, or a rougher look resembling alligator skin.

"Wrinkle" (also "Wrinkles" or "Wrinkled") finishes include a class of textures which can offer styling variation and can have a consistent appearance. Wrinkle and/or texture finished can exhibit resistance to wear and weatherability conditions. Wrinkle and/or texture finishes can be used for example with tools, exercise equipment, and shop displays.

Figure 3:
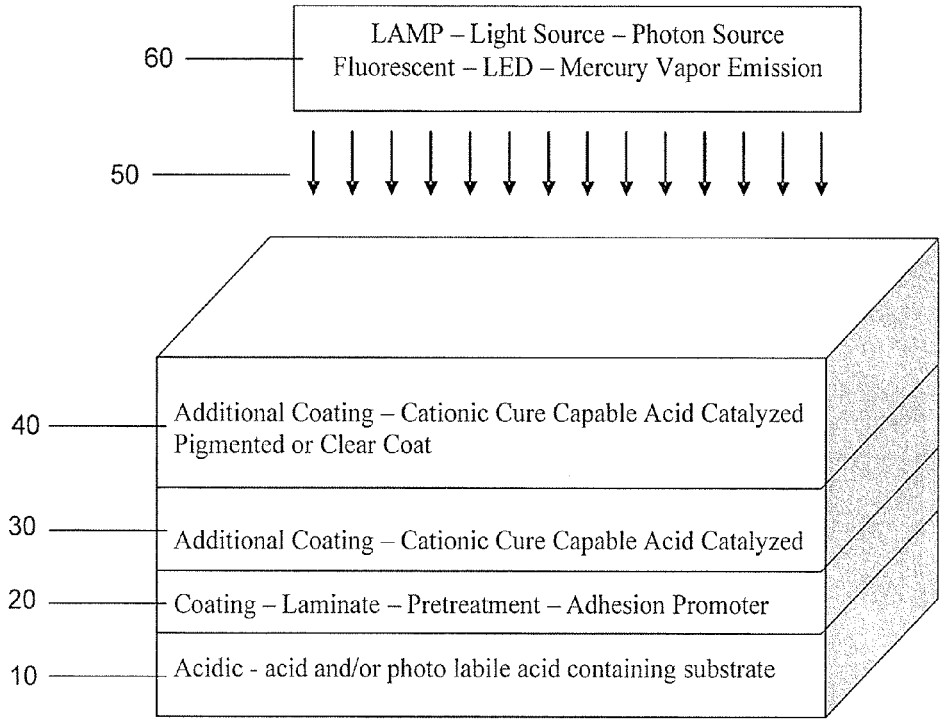
FIG. 3 Coated Substrate (Article) Drawing.

FIG. 3 is a cross-sectional illustration of a laminate application of a coating system. Coatings can have one or more layers. Coatings can be applied to a substrate surface, or to another coating or coating surface. Coatings can be applied to treated or untreated surfaces. Further, coatings can be applied alone or in combination with other materials, solids, liquids, acids, chemical solutions and gases. A broad variety of coating application techniques are encompassed by the invention herein. FIG. 3 illustrates a coating system having a substrate provided with acidic and/or photolabile acid characteristics. The substrate is coated with a laminate of coating material. The addition of an adhesion promoter, or other pretreatment, e.g., but not limited to an acidification are optional steps which can be taken and have example results shown in FIG. 3. FIG. 3 illustrates the application of a second layer of coating which is cationic cure capable and acid catalized. FIG. 3 illustrates yet another additional coating layer of coating which is cationic cure capable and acid catalized. A pigmented coating or clearcoat coating can optionally be employed. Optionally, a clearcoat can be applied (or added) over an existing layer. Curing by exposure to light as disclosed herein can be executed of the entire multi-laminate, after each coating, after at least two coatings, or at any time in the coating process. The invention broadly encompasses exposure of coatings, laminates, additives and material inputs, or products at any time to obtain a texture, finish, coating or product result utilizing the technology disclosed herein.

Figure 4:
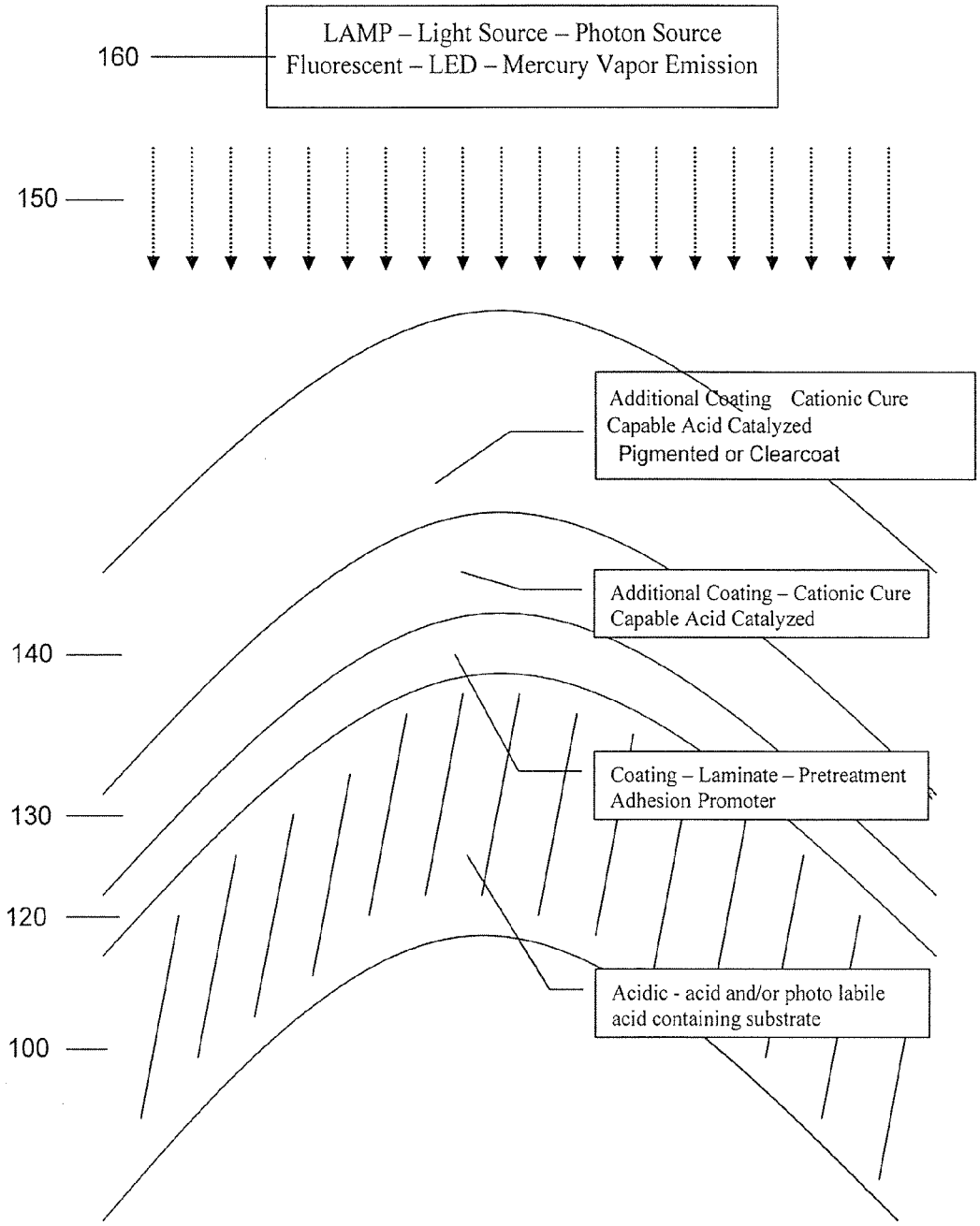
FIG. 4 Low Exposure-Dark Cure Depiction.

FIG. 4 illustrates a surface which is not flat and has surfaces which do not receive the same intensity across the part. The process broadly encompasses exposure of coatings, laminates, additives and material inputs, or products at any time to obtain a texture, finish, coating or product result utilizing the technology disclosed herein.

"Cure" includes the curing process, related chemistry physical changes, or activities conducted in executing a cure of a coating, substance or material. "Cure" as used herein includes both initiating and experiencing a chemical reaction in which molecules combine converting available reactive groups to the extent that the functional groups remain mobile at high conversion. At 85 to 95 percent conversion of reactants, chain mobility becomes restricted as the network forms limiting incorporation of all reactive groups. "Cure", "to cure" and "curing" are variations of the aforementioned broad meaning, and include the progression of time through the curing process. "Cure" in a given application includes the changes to a material in order to obtain desired coating performance specifications (e.g., scratch resistance after coating and cure before packaging the article for shipping) for a given application and/or end use of the cured coating. "Adequate cure" includes the curing of a coating to achieve properties including, but not limited to, adhesion, chemical and solvent resistance, and image and color quality. "Cure" also includes the common definition of the terms would be understood by a person of having ordinary skill in the art practicing the invention disclosed herein.

"Cured" is a term indicating a curing process is complete, or indicates a method by which a cure or curing is achieved, e.g., "cured by". Also "cured" can be used when a curing process is sufficiently complete in the context of a given curing method. Cure or rate of cure can increase when light is applied to the coating.

This invention encompasses both the "light cure" and "dark cure" of a reactive coating composition.

"Light cure" as used herein is broadly construed to include any chemical reaction, drying, hardening, physical change or transformation of a coating composition which results from or occurs during exposure to light. In one embodiment, "light cure" encompasses areas exposed to light with a 0.008 Watt/$cm^2$/nm peak intensity at a wavelength of 254 nm. The light used in this example was a TripleBright II lamp which is commercially available from UV Systems, Inc. (Renton, Wash.). The spectral distribution for the lamp, as further described in Example 12, was measured using a Solatell UV Spectroradiometer, and the results are graphed in FIG. 8

In one embodiment, the invention employs an acidic or acid containing substrate having a pH of 7.0 or lower with a short exposure to a low intensity (254 nm 0.008 W/$cm^2$/nm) light.

In one embodiment, aspects of the invention which allow for the coating of heat sensitive articles. Heat sensitive articles can have materials with physical properties which can change as temperature changes.

In one embodiment, cure can be achieved with a light exposure time of 0.2 seconds, or greater. Cure can be a function of light intensity and dosage as well as photoinitiator and sensitizer blend and level, acid nature of the substrate as well as the temperature of the coating, temperature of the substrate, the percent relative humidity and application environment temperature.

Variations in light exposure can occur as a result of three dimensionality of the substrate and non-perpendicular orientation to the photon direction, reflectance and absorption of photons due to polymers, photoinitators, pigments and other coatings which can diminished photon penetration due to coating thickness and variation.

"Free of exposure to light" as used herein includes but is not limited to light in a range from zero, or no light, to light present but at reduced intensity as compared to direct perpendicular exposure to light upon a surface, object, or material. Differences in light exposure can arise from any light limiting circumstance including, but not limited to, three dimensionality of a substrate, non-perpendicular orientation to the photon direction, reflectance and/or absorption due to pigmentation and diminished photon penetration due to coating thickness and variation.

"Dark cure" as used herein is broadly construed to encompass any chemical reaction, drying, hardening, physical change or transformation of a coating composition which results in the absence of exposure to light at its coincident value on a surface directly exposed to a light source. A "dark area" is a portion of a coating or coated article which is exposed to light at levels not equal to areas perpendicular to the direction of a light. Dark areas are herein broadly construed to encompass any area other than those directly exposed to light. Dark areas including portions of the coating composition which are exposed to no light, free of light, as well as areas which are exposed to less than the direct exposure of a light source. Further, dark areas can include those which are shaded, blocked, shadowed, covered, protected, or which for any reason do not receive direct exposure to a light source. In one embodiment "dark cure" encompasses areas exposed to light of a wavelength of between 200 nm and 1200 nm and an intensity less than or equal to 0.05 $W/cm^2/nm$.

When a coating composition is applied to a substrate it has a thickness. In some embodiments, light exposure is not able to penetrate the thickness of a coating. In such instances, "dark area" is broadly construed to include the portions of the coating composition to which the light does not penetrate (or not penetrate with the fall intensity as from the source).

An embodiment of this invention includes the curing of a coating or a portion of a coating by both light cure and dark cure. This combination of curing can occur where an amount of a coating composition cures as a result of light exposure and another amount of a coating composition of the same portion cures by chemical reaction or hardening process which is independent of exposure to light. Examples with dark cure can include, but are not limited, to drying, polymerization and/or reaction.

Epoxy resins "dark-cure" on acidic substrates in the presence of acid alone. Functional groups which can polymerize by this invention include, but are not limited to, photocurable compounds including mono- and di-functional monomers. Other monomers and oligomers can be selected from the following list, Poly BD 605E Polybutadiene, epoxidized, hydroxy terminated, Eponex Resin 1510 Hydrogenated bisphenol A-epichlorohydrin based epoxy, Cardura E-10P 2,3-Epoxypropyl neodecanoate, Heloxy modifier 116 2-Ethylhexyl glycidyl ether, Heloxy modifier 107 Cyclohexane dimethanol diglycidyl ether, Heloxy modifier 84 Propoxylated glycerol triglycidyl ether, Heloxy modifier 68 Neopentyl glycol diglycidyl ether, Heloxy modifier 48 Trimethylolpropane triglycidyl ether, Araldite DY-D/CH 1,4-Butanediol diglycidyl ether, UVR-6128 Bis(3,4-epoxycyclohexylmethyl) adipate, UVR-6110 (3,4-epoxycyclohexyl)methyl-3,4-epoxycyclohexylcarboxylate, UVR-6105 (3,4-epoxycyclohexyl)methyl-3,4-epoxycyclohexylcarboxylate and oxetanes and/or their blends.

"Dual cure" is broadly construed herein to include any curing process in which an amount of coating composition is cured by, light cure and another amount is cured by any other method. Cures which are not considered to be light cure include chemical reaction independent of light including but not limited to drying and/or hardening, as well as including chemical reaction (e.g., polymerization reaction).

The "Two Process Cure", which is an embodiment of a dual cure mechanism, can in one embodiment combine a substrate cure process (e.g., but not limited to acidic substrate activated) with a second process involving light activated surface cure. Multiprocess cure is also encompassed in this invention. In some embodiments more than two cure processes are employed. A number of cure processes, many cure processes, or a variety of cure processes can be employed. Differentiated cure includes curing processes having a cure rate difference between the coating surface cure rate, the coating bulk cure rate and the substrate coating interface cure rate. A non-differentiated or balanced cure includes a cure having a cure rate balance or cure rate similarity between the coating surface cure rate, the coating bulk cure rate and the substrate coating interface cure rate.

In one embodiment, the two process cure can combine a substrate, whose pH is 7.0 or lower, substrate cure process with light surface cure aids through cure and adhesion of pigmented or light absorbing colors. Also the "Two Process Cure" produces cure and adhesion in low exposure or "dark" areas of three-dimensional graphics or printed parts, where light is not equal to areas perpendicular to the light source in the same manner. Once initiated the cationic chemistry continues to cure after the light source is removed.

Any coating system utilizing more than one reaction process can be a dual cure system. Dual cure systems can use the secondary hydroxyl functionality, formed upon ring opening polymerization of the epoxy or oxetane group, and reacting with an isocyanate functional resin. Additionally, a dual cure system can comprise a di-epoxide compound, cationic photoinitiator with an acrylate/radical photoinitiator and a mono-, di-, tri- and/or a polyfunctional acrylated material to balance surface cure with flexibility.

A "Substrate cure" includes the cure of an applied coating which is initiated at the substrate-coating interface by the substrate or substrate surface. Specifically due to acidic properties of the substrate having a pH of 7.0 or lower when coated as described by this invention.

A "Surface cure" includes electron beam (UV/EB) free radical and cationic curing technologies to be the chemical conversion of reactive groups upon exposure to light at the surface to produce a tack-free skin.

A "Through cure" includes a complete cure including the surface and the bulk and substrate-coating interface of the applied coating. Through cure can include, but is not limited to, a cure across the cross-section (or thickness) of a coating or coating layer.

In some embodiments, the coating chemistry, (cationically polymerizable material(s) photoinitiator, sensitizer, reactive diluent, pigmentation and their levels and combinations), substrate surface acidity, applied film thickness, light intensity and the time from applying a coating and exposing the applied coating and the time that the applied coating is exposed to the UltraBright II light can be varied to produce a broad variety of coating finishes. The time component of light exposure length of time determines the amount of light which is delivered to an area of the photoinitiated coating. An exposure time that allows light to penetrate partially into the coating and not completely though the coating can initiate cationic cure to the depth in the coating where photoinitiators are activated. A cure rate differential can then exist and cationically activated areas can polymerize at a rate which is different than areas which are not activated. Those coatings with differentiated cure rate when comparing the surface cure rate, bulk cure rate and substrate coating interface cure rate can produce wrinkled surfaces. One can, with this invention, expose the coating surface with enough light energy that a portion of the coating film is activated and a wrinkle producing cure differential exists. This can be achieved by a light intensity and time exposure, known as dosage, which partially penetrates and cationically activates the coating. Wavelength, intensity and exposure time can be optimized to obtain a desired result.

The time component of light exposure from the time when the coating is applied to when then coating is exposed to and activated by light, can be the time before the coating is cationically activated and cationic polymerization commences. The coating, before polymerization progresses and polymer networks form, can remain fluid and flow and/or level. Activating the coating in a time frame and with an intensity that prevents flow and/or leveling can produce a surface which is not coalesced. Activating the coating in a timeframe and with an intensity allowing flow and/or leveling can produce a surface which is coalesced. A broad range between coalesced and not coalesced.

The time components of light exposure can include a length of time from when the coating is applied to when the coating is exposed to and activated by the light and can be varied singularly or concurrently to produce a broad range of coated articles with a broad range of coating surface properties.

Varying the time between application of a coating to a substrate and exposure of the coated substrate to a light source can be used to achieve a broad range of finishes ranging from but not limited, to a matte finish, a standard finish and a glossy finish. The time delay between application of a coating to a substrate and exposure to light ("delay") include, but are not limited to, almost zero (0), instantaneous, 0.001 sec, 0.01 sec, 0.1 sec, 0.1 sec, 1.0 sec, 5.0 sec and 10.0, and 25 sec. Longer time delays include, but are not limited to 30 sec, 1 min, 5 min, 10 min, 30, min, 1 hour, or more than 1 hour. Values above, below and between these values can be used.

In one embodiment, a delay from application to substrate of an amount of coating to a substrate to exposure to light can be in a range of almost zero (0, or instantaneous) to 10 sec can be used to achieve a matte finish. In another embodiment, a delay of 0.001 sec to 10 sec can be used to achieve a standard finish. In yet another embodiment, a delay of almost zero (instantaneous) to 2 hrs, or 2 days can be used to achieve a glossy finish. In embodiments where a delay is used, a light source having a wavelength in a range of 100 nm to 1200 nm and intensity in a range of 0.0003 $W/cm^2/nm$ to 0.05 $W/cm^2/nm$ can be employed. The delay can be made longer or shorter in view of the light utilized. The combination of delay and light utilized can be optimized to achieve a desired finish.

FIG. 3 illustrates an article which is linear. Photons (50) can be delivered to an acidic, acid and/or Photo Labile Acid Containing Substrate (10), prior to or concurrently with and/or after applying a coating, laminate, pretreatment and/or adhesion promoter (20). An additional coating cationic cure capable acid catalyzed (30) can then be applied, followed by yet an additional coating cationic cure capable acid catalyzed pigmented or clearcoat (40). Photons (50) can be delivered to the article prior to and/or concurrently and/or after coating the article (20), and can be delivered to the article prior to and/or concurrently and/or after coating the article (30) and/or can be delivered to the article prior to and/or concurrently and/or after coating the article (40). The photon source-lamp, light source, fluorescent, light emitting diode and/or mercury vapor emission (60) can be used to deliver photon (50), to the article (10), prior to and/or concurrently and/or after a coating (20, 30), and/or (40), is applied to the article (10).

FIG. 4 illustrates an article which is non-linear, comprising three dimensionality and portions of the article that have portions of the surface which are exposed to the light, described herein, which are equal to or less than other areas exposed to said light. Photons (150) can be delivered to an acidic, acid and/or photo labile acid containing substrate (100), prior to or concurrently with and/or after applying a coating, laminate, pretreatment and/or adhesion promoter (120). n additional coating cationic cure capable acid catalyzed (130) can then be applied, followed by yet an additional coating cationic cure capable acid catalyzed pigmented or clearcoat (140). Photons (150) can be delivered to the article prior to and/or concurrently and/or after coating the article (120), and can be delivered to the article prior to and/or concurrently and/or after coating the article (130) and/or can be delivered to the article prior to and/or concurrently and/or after coating the article (140). The photon source (160) e.g., lamp, light source, fluorescent, light emitting diode and/or mercury vapor emission) can be used to deliver photons (150), to the article (100), prior to and/or concurrently and/or after a coating (120, 130) and/or (140), is applied to the article (100).

The results of Example 15 relate that a broad variety of coating finishes for a variety of colors can be obtained from the coating techniques disclosed herein.

The coating compositions, blends and levels of photoinitiator and cure techniques can provide finishes including, but not limited to, smooth, textured, matte, gloss or wrinkled. In other embodiments the finish of an article can be one or more of the following: glossy finish, standard finish, matte finish, textured finish and/or wrinkled finish.

"Smooth" coatings include, but are not limited to, coatings having a profilometer measurement peak average of 10 micrometers or less.

Texture coatings can be used to hide substrate irregularities and fingerprints. It can provide a nonslip surface while giving a feel to a product. Appearances can vary for nonlimiting example from the look of fine sandpaper, a pebbly texture, or a rougher look resembling alligator skin.

Wrinkle finishes are a class of textures which can offer styling variation and can have a consistent appearance. They can exhibit resistance to wear and weatherability conditions. These finishes can be used for example with tools, exercise equipment, and shop displays.

"Outdoor Durable" (also "outdoor durability") is a characteristic and/or property of graphics, printings, coatings and coated articles and products quantifying and expressing their ability to maintain performance for an intended period of time in outdoor environments. Outdoor durability can be maintained by some coatings for many years. Factors which can contribute to outdoor durability include, but are not limited to, adhesion, color quality, sign quality, chemical resistance and light resistance. An outdoor durable graphic is an article which can be produced by this invention. An outdoor durable graphic is a product which is outdoor durable, e.g., exhibits outdoor durable characteristics and properties.

"Heat stability" includes the degree to which physical property change is resisted when exposed to a warmth, heat, or temperature increase for any reason.

"Light stability" (also "lightfastness") includes the degree to which physical property change is resisted when exposed to a light, radiation, or other factor (e.g., sunlight, IR radiation, electromagnetic radiation) during normal use.

"Chemical stability" includes the degree to which physical property change is resisted when exposed to chemicals, or other factor (including, e.g., sunlight) during normal use.

Light absorbing and light reflecting pigments can compete for and reduce the depth of photon penetration into a coating thereby creating a differential cure when comparing the cure rate of the coating surface, the cure rate of the coating bulk and the cure rate of the substrate coating interface. This technique is utilized in some embodiments of this invention.

The color variety of the coatings of this invention is vast and not limited. There are also tints which can add highlight color to a substrate or base coat, such as a brass look over polished aluminum.

A range from flat to high gloss is generally available. Smooth, high-gloss coatings can offer high distinctiveness of image, creating an illusion of depth or a wet look. Matte finishes can hide surface defects or imperfections such as spot welds, nicks and scratches on a variety of substrates.

Matte finish can be controlled by cure parameters such as the print speed or through-put combined with the light dosage at the coating surface, the coating film thickness, the level, type and blend of photoinitiator(s) and photosensitizer(s), the substrate acidity and the time delay after coating deposition before light exposure.

Coating finish, i.e., matte or gloss, can be controlled by cure parameters such as the print speed or through-put combined with the light dosage at the coating surface, the coating film thickness, the level, type and blend of photoinitiator(s) and photosensitizer(s), the substrate acidity and the time delay after coating deposition before light exposure as such that produces cure rates which are equal at the coating surface, coating bulk and coating-substrate interface. Some embodiments have one or more finishes such as standard, gloss, matte and texture.

This invention can be used to produce matte and gloss finishes. The ink jet process for achieving a matte finish involves no delay, or a short delay, from when the coating is applied to the time the coating is exposed to the light. This ink jet process with a short delay freezes the drops in place and shape and minimizes droplet flow and coalescence. The ink jet process for achieving a glossy finish involves delay from when the coating is applied to the time the coating is exposed to the light that allows the droplets to flow and coalesce.

In one embodiment, a high gloss finish can be obtained by adding acid to the substrate prior to or concurrently with the coating in such a way that the surface cure rate, the bulk cure rate and substrate-coating interface cure rate are coordinated, providing a smooth film as describe herein.

This application includes a broad variety of printed products. Examples of printed products include, but are not limited to, signage, specialty graphics, printing, plastics, automotive, truck and bus, container and beverage, printable electronics, security tags, labels, 3D raised graphics, and products printed on format printers in a range of about 12 to about 3.2 meters wide, or even larger.

In one embodiment, stickers are printed. Examples of stickers include, but are not limited to: labels, barcode labels, package labels, bumper stickers, automobile signage, automobile graphics, and hazard communication placards.

Examples of outdoor durable graphics include, but are not limited to: signs, banners, vehicle wrap graphic auto graphic kits, car graphics, truck graphics, van graphics, boat graphics, van stripes airbrushed graphics, car stripes, truck stripes, boat stripes, window decals and pinstriping.

Cure can be measured by FTIR, chemical resistance, solvent resistance, percent gelation, glass transition temperature or adhesion.

The degree of pigmentation is measured on a weight basis and commonly reported as pigment to binder ratio (P/B). Pigment can be weighed into a formulation of coating composition at a level to provide color, hiding or opacity and/or color density.

Flexibility of a cured coating can be characterized by percent elongation and/or flexural bend.

"Adhesion" includes the ability of a dry coating to attach to and remain fixed on the surface without blistering, flaking, cracking, or being removed by tape. "Adhesion" also includes terms such as "adherence" and "bonding". Other adhesion processes include, but are not limited to, hydrogen bonding, van der Waals attractive forces or intermolecular attractions are attractions between one molecule and a neighboring molecule, ionic (electrovalent) bonding, co-ordinate (dative covalent) bonding, absorption, attractive or physical bonds, fusion bonds and/or metallic bond. "Adhesion" also includes the close union of a substrate and subsequently applied coatings.

Figure 12:
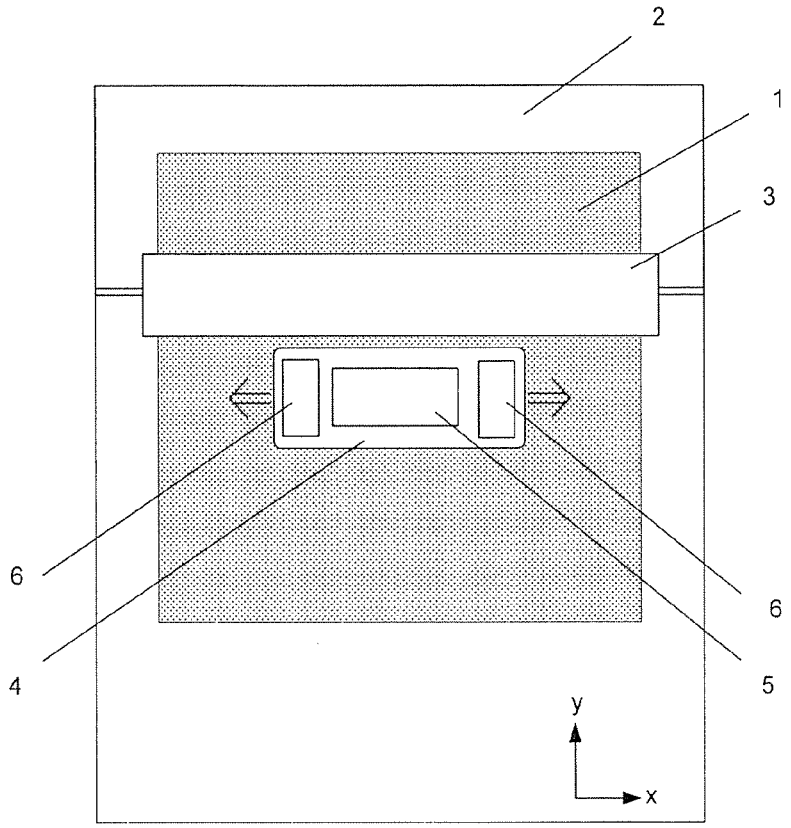
FIG. 12. Process Configuration Stationary Substrate.

FIG. 12 illustrates an ink jet printer with a stationary material substrate (1), placed on or affixed to or contained within and apparatus base (2). The long lamp (3), the print head carriage (4), the print heads (5), and the print head carriage mounted lamps (6), are attached to the apparatus base (2). The long lamp (3), the print head carriage (4), the print heads (5), and the print head carriage mounted lamps (6), can move in the "y-direction" with respect to the apparatus base (2), while the stationary material substrate (1), is stationary. The print head carriage (4), the print heads (5), and the print head carriage mounted lamps (6), can move in the "x-direction" with respect to the apparatus base (2). In one embodiment, the print head carriage mounted lamps (6), can be off during printing for ink flow. In another embodiment, the print head carriage mounted lamps (6), can be on. In yet another embodiment, one print head carriage mounted lamp (6), can be on, while the other print head carriage mounted lamp (6), can be off Depending on the width of the stationary material substrate (1), the number of long lamps (3), and print head carriage mounted lamps (6), can be greater than one. This can allow for increased dosage using the lamps described herein. Lamps (3), and/or (6), of different wavelengths, intensity and/or spectral output can be used depending on photoinitiator package and level, pigment type and level and spectral absorption of the pigments as it would be understood by one skilled in the art. FIG. 12 depicts a non-limiting configuration where the stationary material substrate (1), is stationary.

Figure 13:
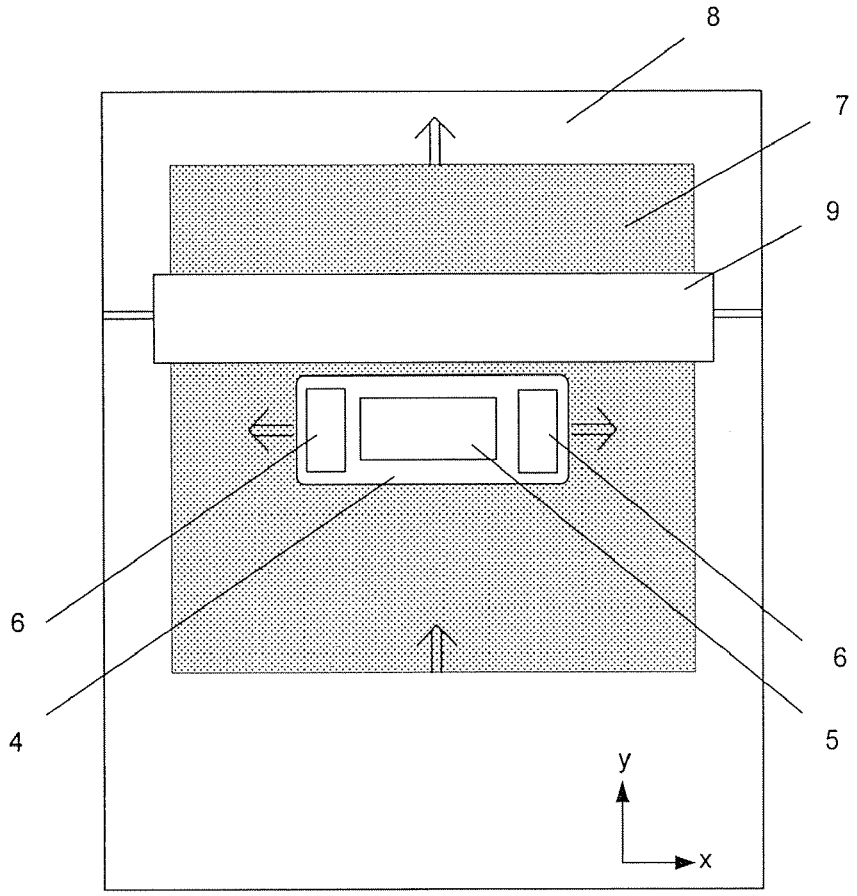
FIG. 13: Process Configuration Moving Substrate.

FIG. 13 illustrates a moving material substrate (7), which can move past the long lamp (9), the print head carriage (4), the print heads (5), the print head carriage mounted lamps (6), and the apparatus base (8) in the "y-direction" with respect to the apparatus base (8). The long lamp (9), is stationary. The print head carriage (4), the print heads (5), and the print head carriage mounted lamps (6), can move together in the "x-direction" with respect to the apparatus base (8). In one embodiment, the print head carriage mounted lamps (6), can be off during printing for ink flow. In another embodiment, the print head carriage mounted lamps (6), can be on. In yet another embodiment, one print head carriage mounted lamp (6), can be on, while the other print head carriage mounted lamp (6), can be off Depending on the width of the moving material substrate (7), the number of long lamps (9), and print head carriage mounted lamp (6), can be greater than one. This can allow for increased dosage using the lamps (6) and/or (9), described herein. Lamps (6) and/or (9), of different wavelengths, intensity and/or spectral output can be used depending on photoinitiator package and level, pigment type and level and spectral absorption of the pigments, as it would be understood by one skilled in the art.

In one embodiment, the invention encompasses an ink jet printer having a light, or an array of lights, of 0.0003 W/cm$^2$/nm to 0.05 W/cm$^2$/nm mounted perpendicular to and illuminating the printed media as the media moves through the printer. Additionally, the printer can have lights of 0.0003 W/cm$^2$/nm to 0.05 W/cm$^2$/nm mounted on both sides of the print head carriage for the purpose of freezing drops in place. This a achieved when the ink jetted drops are illuminated by the print head carriage lamps, preventing or minimizing drop bleed or drop gain, as it is understood by those skilled in the art, as the print head carriage transverses the media and printing an image. The printer can be equipped or supplied by an ink filtration and supply system consisting of but not limited to pumps, valves, ink level sensors, filters, main reservoir, on-head reservoirs, heaters, heat sensors, ink de-aerators, ink recirculation, ink recovery, ink purging, ink loading, computer electronic control systems and electronic and computer circuitry. Adjustment of the print meniscus can be controlled and adjusted for jetting reliability with the meniscus vacuum pressure. The printer ink applicator can be a Drop-On-Demand ink jet print capable of drop delivery volumes from 3 to 100 picoliters with firing frequencies of 2 to 100 kilohertz and drop velocities of 4 meters/second up to 25 meters/second. The printer can have 4 to 16 print heads which are compatible with the ink.

Figure 5:
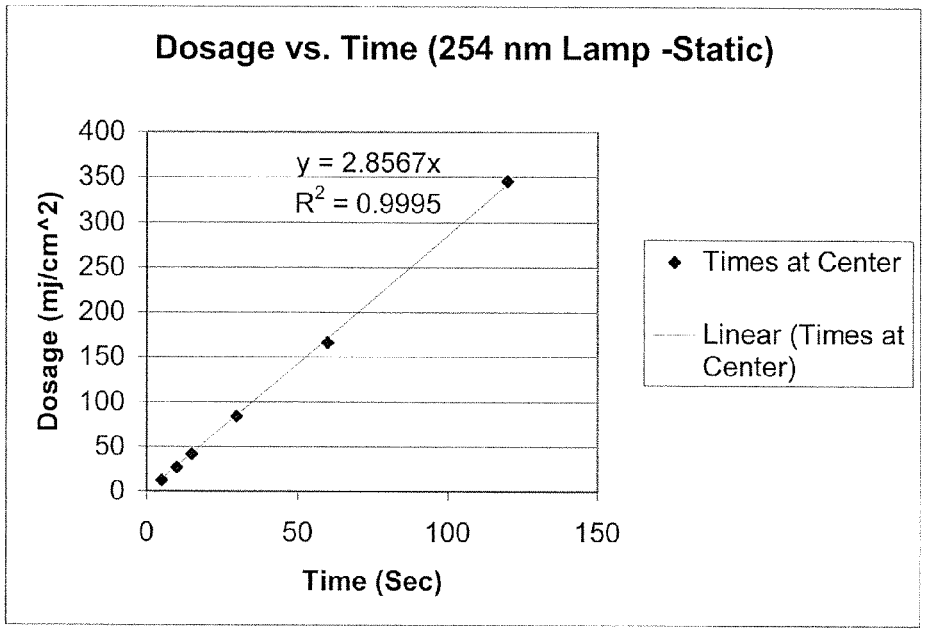
FIG. 5 Dosage v. Time (254 nm Lamp-Static)

FIG. 5 illustrates the dosage in millijoules/cm$^2$ units as a function of time under the center of the UV Systems TripleBright II 254 nm lamp with respect to the 22" lamp length and the 4 inch (also inch="; e.g., 4") lamp width.

A "Dark area" includes a surface which is not perpendicular to the radiation or light source such that the amount of photons or energy is reduced when compared to surfaces which are perpendicular to the radiation. A "Low exposure area" includes a surface which is not perpendicular to the radiation or light source such that the amount of photons or energy is reduced when compared to surfaces which are perpendicular to the radiation.

"Limited light exposure" includes circumstances of exposure of a coating composition (coating, or material to be cured) in which the exposure to a light is reduced, lowered, or diminished as compared to perpendicular exposure to the light at its full intensity. Limited light exposure can result for reasons, not limited to, orientation of light source(s) to the recipient material, configuration of light source(s) to the recipient material, coating thickness, pigmentation and reduced light transmittance such that the surface, bulk and substrate-coating interface do not become equally photoactive and photopolymerized.

A dark curing characteristic includes the potential of a substrate to initiate cationic polymerization of an applied coating in the absence, or reduced level, of radiation as a result of reduced photo electromagnetic radiation due to pigment type and level, film thickness, part or substrate shape, part or substrate area orientation form perpendicular to the light emission direction.

EXAMPLES

For the examples herein the linear print speed and print rates are correlated to print rate ft$^2$/hr in Table 2 below, for a "5 foot" wide media ("5 foot" wide media).

TABLE 2

Print Speed Correlation Table For 5 Foot Wide Media

| Lab View Value Interface | Measured Speed Inches per second | Print Rate ft$^2$/hour | Scale Factor Lab View | Scale Factor Measured Speed |
|---|---|---|---|---|
| 0.0665 | 0.039 | 58.5 | Set as "1" | 1 |
| 0.08 | 0.039 | 58.5 | 1.2 | 1 |
| 0.10 | 0.078 | 117 | 1.5 | 1.173 |
| 0.133 | 0.120 | 180 | 2.0 | 3.077 |
| 0.160 | 0.120 | 180 | 2.406 | 3.077 |
| 0.170 | 0.157 | 235.5 | 2.556 | 4.056 |
| 0.180 | 0.157 | 235.5 | 2.707 | 4.056 |
| 0.20 | 0.1967 | 295 | 3.008 | 5.043 |
| 0.266 | 0.237 | 355.5 | 4 | 6.077 |
| 0.30 | 0.276 | 414.5 | 4.511 | 7.085 |
| 0.40 | 0.3934 | 590 | 6.015 | 10.085 |
| 0.5332 | 0.5217 | 782.6 | 8.018 | 13.378 |
| 0.80 | 0.787 | 1180 | 12.03 | 20.171 |
| 1.064 | 1.02 | 1532 | 16 | 26.188 |
| 2.0 | 2.0 | 3000 | 30.075 | 51.282 |
| 2.128 | 2.087 | 3130 | 32 | 53.504 |

Example 1

Acid Coat 287-127 represents an example pretreatment which has been applied to a substrate, and light activated to release an acid, prior to applying a second coating of cationic coating composition (herein used in examples 3, 4, 5 and 6). The composition of acid coat 287-127 was: Isopropanol-50 grams; TMPO Oxetane-10 grams; Irgacure 250-2 grams.

Example 2

Substrate Descriptions and Preparations

Substrate 1: Glass was cleaned with soapy water and allowed to dry. The 4 inch by 4 inch glass plaques were wiped with isopropanol and dried within 90 seconds +/−90 seconds before applying a coating.

Substrate 2: Same preparation as Substrate 1, followed by an acetic acid wipe (99.6% glacial acetic acid) and air dried.

Substrate 3: Same preparation as Substrate 1, followed by application of "Acid Coat" 287-127 (described in Example 1) drawn down with a #10 wire cater. The acid coat was activated prior to additional coatings being applied by exposing the acid coated glass to the 254 nm Lamp at a dosage equal to the dosage for the subsequently applied coating.

Substrate 4: Instachange IP (3M commercially available vinyl).

Substrate 5: Same preparation as Substrate 4, followed by an acetic acid wipe (99.6% glacial acetic acid) and air dried.

Substrate 6: Same preparation as Substrate 4, followed by application of "Acid Coat" 287-127 (Example 1) drawn down with a #10 wire cater. The acid coat was activated prior to additional coatings being applied by exposing the acid coated Instachange to the 254 nm Lamp at a dosage equal to the dosage for the subsequently applied coating.

Example 3

Black 287-126 Cationic Composition

The coating contains the following ingredients: Cyracure UVR-6110 64.6 grams, TMPO (Trimethylol propane oxetane from Perstorp Specialty Chemicals AB Perstorp, Sweden) 16.2 grams, Black pigment 10C 909 (Black pigment 10C 909 from The Shepherd Color Company Cincinnati, Ohio USA) 5.0 grams, Irgacure 250 (Irgacure 250 was supplied by Ciba Specialty Chemicals Corp., Terrytown, N.Y., USA) 3.8 grams, Rapicure DVE-3 5.0 grams, Speedcure CPTX (Aceto Corporation Lake Success, N.Y.) 0.75 grams and Silwet 7604 (GE Silicones, Friendly, W. Va.), 0.5 grams were assembled into a dark plastic container and protected from light. The ingredients were dispersed with an ULTRA-TURRAX T25 for fifteen minutes. After dispersing, 2.0 grams of Boltorn H2004 were added (Boltorn H2004 from Perstorp Specialty Chemicals AB Perstorp, Sweden).

Figure 8:
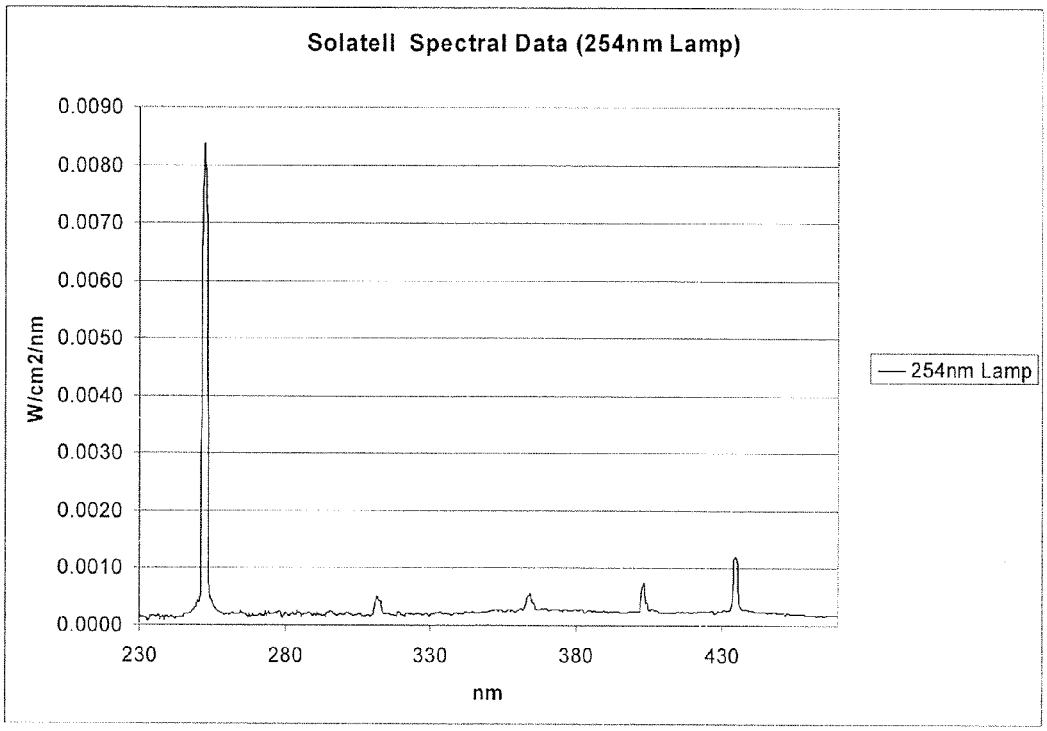
FIG. 8 Spectral Data: 254 nm Lamp.

To test cure, Example 3 was drawn down onto substrates as indicated and described in Example 2.

Where indicated, samples were then exposed to light (as defined in FIG. 8 or were held in absence of light. The coating cure was evaluated using Scotch® Magic™ Tape Catalog #810 tape adhesion and thumb twist at 1 minute and 5 minute intervals after exposure to light was completed.

TABLE 3

Example 3 Coating 287-126 Black Testing Results

| % RH | Treatment Substrate | Print Speed ($ft^2$/hr) | Substrate Example 2 | Adhesion 1 minute | Adhesion 5 minute | Thumb Twist 1 minute | Thumb Twist 5 minute |
|---|---|---|---|---|---|---|---|
| 44 | Acetic Acid Instachange IP | 295 | 5 | 100 | 100 | 10 | 10 |
| 44 | None Instachange IP | 295 | 4 | 100 | 100 | 10 | 10 |
| 32 | Acetic Acid Instachange IP | 414.5 | 5 | 100 | 100 | 10 | 10 |
| 32 | None Instachange IP | 414.5 | 4 | 100 | 100 | 10 | 10 |
| 32 | None Glass | 414.5 | 1 | 0 | 100 | 2 | 2 |
| 44 | Acetic Acid Instachange IP | 590 | 5 | 100 | 100 | 4 | 4 |
| 44 | None Instachange IP | 590 | 4 | 0 | 0 | 2 | 2 |
| 44 | Acid Coat Instachange IP | 1180 | 6 | 100 | 100 | 4 | 8 |
| 44 | None Instachange IP | 1180 | 4 | 0 | 0 | 2 | 2 |
| 44 | Acetic Acid Instachange IP | 3000 | 5 | 0 | 0 | 2 | 2 |
| 44 | None Instachange IP | 3000 | 4 | 0 | 0 | 2 | 2 |
| 44 | Acetic Acid Instachange IP | Dark Cure | 5 | Wet | Wet | Wet | Wet |
| 44 | None Instachange IP | Dark Cure | 4 | Wet | Wet | Wet | Wet |
| 44 | Acid Coat Glass | Dark Cure | 3 | Wet | Wet | Wet | Wet Tacky-2 hr |
| 44 | None Glass | Dark Cure | 1 | Wet | Wet | Wet | Wet Wet-2 hr |

1. Black coating was drawn down with a wire cater #28 on substrates as indicated.

2. The "thumb twist" test is performed by exerting downward pressure to maintain contact with the coating by a human thumb and then turning the orientation of the thumb 90 degrees.

3. Thumb twist rated as 10=No Failure, 9=Very Slight Surface Mark, 8=Slight Surface Mark, 6=Surface Marking No Film Breaking, 4=Surface Skin Film Breaking, 2=Surface Skin Easily Breaks and 0=Complete Failure.

4. In this example the percent adhesion is identified as either 100 for full adhesion (100%) of coating, or 0 for zero percent of coating remaining attached to the substrate after the "Coating Adhesion Test". For the Examples herein the "Coating Adhesion Test" was performed in accordance with ASTM 3359-02 Test Method A and having a modification to ASTM 3359-02 Test Method A in that no X-scribe was made. The tape which was used for the Coating Adhesion Tests of the examples herein was Scotch® Magic™ Tape Catalog #810 tape (available from 3M, St. Paul, Minn.). Scotch® Magic™ Tape Catalog #810 tape was applied to the specimen coated surface and smoothed in place with a finger per test method A: 7.5. In the tests for the examples herein, the free end of the tape was pulled rapidly, "jerked up" as close to 90° as possible per test method A:7.6. Adhesion was rated as a percentage of film remaining in contact with the substrate in the test area by visual inspection.

5. Severe surface wrinkle occurred when substrate acid content did not balance the cure differential of top and bottom surfaces.

6. Temperature in application room when coating, curing and testing was completed was measured and recorded to range from 71° F. to 73° F.

7. Print speed in the above chart can be converted into actual time the coating spends under the lamp. This calculation is done by assuming we are using 5 foot wide media and the lamp has an illumination window of 4". The conversion is 1200 divided by print speed (sqft/hr) as labeled in chart above. For example, a print speed of 58.5 sq ft/hr indicates a time under the lamp of 1200/58.5 or 20.51 seconds.

Example 4

Magenta 287-123 Cationic Composition

The following ingredients, Cyracure UVR-6110 64.6 grams, TMPO (Trimethylol propane oxetane from Perstorp Specialty Chemicals AB Perstorp, Sweden) 16.2 grams, Toner Magenta E02 (Toner Magenta E02 supplied by Clariant GmbH Frankfurt, Germany) 4.0 grams, Rapicure DVE-3 5.0 grams, Irgacure (Irgacure 250 was supplied by Ciba Specialty Chemicals Corp. Terrytown, N.Y. USA.) 250 3.0 grams, Speedcure CPTX (Aceto Corporation Lake Success, N.Y.) 0.75 grams and Silwet 7604 (GE Silicones, Friendly, W. Va.), 0.5 grams were assembled into a dark plastic container and protected from light. The ingredients were dispersed with an ULTRA-TURRAX T25 for fifteen minutes. After dispersing, 2.0 grams of Boltorn H2004 were added (Boltorn H2004 from Perstorp Specialty Chemicals AB Perstorp, Sweden).

To test cure, Example 4 was drawn down onto substrates as indicated and described in Example 2. Where indicated, samples were then exposed to light (as defined in FIG. 8) or were held in absence of light. The coating cure was evaluated using Scotch® Magic™ Tape Catalog #810 tape adhesion and thumb twist at 1 minute and 5 minute intervals after exposure to light was completed.

TABLE 4

Example 4 Coating 287-123 Magenta Testing Results

| % RH | Treatment Substrate | Print Speed ($ft^2$/hr) | Substrate Example 2 | Adhesion 1 minute | Adhesion 5 minute | Thumb Twist 1 minute | Thumb Twist 5 minute |
|---|---|---|---|---|---|---|---|
| 32 | Acetic Acid Instachange IP | 117 | 5 | 100 | 100 | 10 | 10 |
| 32 | None Instachange IP | 117 | 4 | 100 | 100 | 10 | 10 |
| 32 | Acetic Acid Instachange IP | 235.5 | 5 | 100 | 100 | 4 | 8 |
| 32 | None Instachange IP | 235.5 | 4 | 100 | 100 | 4 | 8 |
| 32 | None Glass | 235.5 | 1 | 80-90 | 100 | 2 | 4 |
| 44 | Acetic Acid Instachange IP | 235.5 | 5 | 40 | 90 | 2 | 4 |
| 44 | None Instachange IP | 235.5 | 4 | 20 | 50 | 2 | 4 |
| 44 | Acetic Acid Instachange IP | 295 | 5 | 0 | 0 | 0 | 0 |
| 44 | None Instachange IP | 295 | 4 | 0 | 0 | 0 | 0 |
| 44 | Acid Coat Instachange IP | 295 | 6 | 95 | 99 | 8 | 9 |
| 44 | Acetic Acid Instachange IP | Dark Cure | 5 | Wet | Wet | Wet | Wet |
| 44 | None Instachange IP | Dark Cure | 4 | Wet | Wet | Wet | Wet |
| 44 | Acid Coat Glass | Dark Cure | 3 | Wet | Wet | Wet | Wet |
| 44 | None Glass | Dark Cure | 1 | Wet | Wet | Wet | Wet |

1. Magenta coating was drawn down with a wire cater #28 on substrates as indicated.

2. Thumb twist rated as 10=No Failure, 9=Very Slight Surface Mark, 8=Slight Surface Mark, 6=Surface Marking No Film Breaking, 4=Surface Skin Film Breaking, 2=Surface Skin Easily Breaks and, 0=Complete Failure.

3. Temperature in application room when coating, curing and testing was completed was measured and recorded to range from 71° F. to 73° F.

4. Print speed in the above chart can be converted into actual time the coating spends under the lamp. This calculation is done by assuming we are using 5 foot wide media and the lamp has an illumination window of 4". The conversion is 1200 divided by print speed (sqft/hr) as labeled in chart above. For example, a print speed of 58.5 sqft/hr indicates a time under the lamp of 1200/58.5 or 20.51 seconds.

Example 5

Cyan 287-124 Cationic Composition

The following ingredients, Cyracure UVR-6110 64.6 grams, TMPO (Trimethylol propane oxetane from Perstorp Specialty Chemicals AB Perstorp, Sweden) 16.2 grams, Toner Cyan BG (Toner Cyan BG supplied by Clariant GmbH Frankfurt, Germany.) 4.0 grams, Rapicure DVE-3 5.0 grams, Irgacure (Irgacure 250 was supplied by Ciba Specialty Chemicals Corp. Terrytown, N.Y. USA.) 250 3.0 grams, Speedcure CPTX (Aceto Corporation Lake Success, N.Y.) 0.75 grams and Silwet 7604 (GE Silicones, Friendly, W. Va.), 0.5 grams were assembled into a dark plastic container and protected from light. The ingredients were dispersed with an ULTRA-TURRAX T25 for fifteen minutes. After dispersing, 2.0 grams of Boltorn H2004 were added (Boltorn H2004 from Perstorp Specialty Chemicals AB Perstorp, Sweden).

To test cure, Example 5 was drawn down onto substrates as indicated and described in Example 2. Where indicated, samples were then exposed to light (as defined in FIG. 8) or were held in absence of light. The coating cure was evaluated using Scotch® Magic™ Tape Catalog #810 tape adhesion and thumb twist at 1 minute and 5 minute intervals after exposure to light was completed.

TABLE 5

Example 5 Coating 287-124 Cyan Testing Results

| % RH | Treatment Substrate | Print Speed ($ft^2$/hr) | Substrate Example 2 | Adhesion 1 minute | Adhesion 5 minute | Thumb Twist 1 minute | Thumb Twist 5 minute |
|---|---|---|---|---|---|---|---|
| 32 | Acetic Acid Instachange IP | 180 | 5 | 75 | 100 | 4 | 4 |
| 32 | None Instachange IP | 180 | 4 | 75 | 100 | 4 | 4 |
| 32 | None Glass | 180 | 1 | 0 | 0 | 2 | 2 |
| 44 | Acid Coat Instachange IP | 295 | 6 | 95 | 99 | 8 | 9 |
| 44 | None Instachange IP | 295 | 4 | 0 | 0 | 2 | 2 |
| 44 | Acetic Acid Instachange IP | Dark Cure | 5 | Wet | Wet | Wet | Wet |
| 44 | None Instachange IP | Dark Cure | 4 | Wet | Wet | Wet | Wet |
| 44 | Acid Coat Glass | Dark Cure | 3 | Wet | Wet | Wet | Wet |
| 44 | None Glass | Dark Cure | 1 | Wet | Wet | Wet | Wet |

1. Cyan coating was drawn down with a wire cater #28 on substrates as indicated.

2. Thumb twist rated as 10=No Failure, 9=Very Slight Surface Mark, 8=Slight Surface Mark, 6=Surface Marking No Film Breaking, 4=Surface Skin Film Breaking, 2=Surface Skin Easily Breaks and 0=Complete Failure 3. Acid coat Example 1287-127 is drawn down on the substrate then exposed to light, prior to coating with indicated example, matching the subsequent coating exposure rate.

4. Temperature in application room when coating, curing and testing was completed was measured and recorded to range from 71° F. to 73° F.

5. Print speed in the above chart can be converted into actual time the coating spends under the lamp. This calculation is done by assuming we are using 5 foot wide media and the lamp has an illumination window of 4". The conversion is 1200 divided by print speed ($ft^2$/hr) as labeled in chart above. For example, a print speed of 58.5 sq ft/hr indicates a time under the lamp of 1200/58.5 or 20.51 seconds.

Example 6

Yellow Cationic Composition

The following ingredients, Cyracure UVR-6110 64.6 grams, TMPO (Trimethylol propane oxetane from Perstorp Specialty Chemicals AB Perstorp, Sweden) 16.2 grams, Toner Yellow (Toner Yellow 3GP supplied by Clariant GmbH Frankfurt, Germany.) 2.75 grams, Rapicure DVE-3 5.0 grams, Irgacure 250 (Irgacure 250 was supplied by Ciba Specialty Chemicals Corp. Terrytown, N.Y. USA.) 3.0 grams, Speedcure CPTX (Aceto Corporation Lake Success, N.Y.,) 0.75 grams and Silwet 7604 (GE Silicones, Friendly, W. Va.), 0.5 grams were assembled into a dark plastic container and protected from light. The ingredients were dispersed with an ULTRA-TURRAX T25 for fifteen minutes. After dispersing, 2.0 grams of Boltorn H2004 were added (Boltorn H2004 from Perstorp Specialty Chemicals AB Perstorp, Sweden).

To test cure, Example 6 was drawn down onto substrates as indicated and described in Example 2. Where indicated, samples were then exposed to light (as defined in FIG. 8) or were held in absence of light. The coating cure was evaluated using Scotch® Magic™ Tape Catalog #810 tape adhesion and thumb twist at 1 minute and 5 minute intervals after exposure to light was completed.

3. Lower applied coating was used as indicated to achieve cure.

4. Film properties were noticeably improved over acetic acid treated substrate than with no treatment.

6. Temperature in application room when coating, curing and testing was completed was measured and recorded to range from 71° F. to 73° F.

7. Print speed in the above chart can be converted into actual time the coating spends under the lamp. This calculation is done by assuming we are using 5 foot wide media and the lamp has an illumination window of 4 inches. The conversion is 1200 divided by print speed (sqft/hr) as labeled in chart above. For example, a print speed of 58.5 sqft/hr indicates a time under the lamp of 1200/58.5 or 20.51 seconds.

Example 7

Example 7: Profilometer Measurement Table and FIG. 15 include profilometer results of coating experiments conducted utilizing the methods disclosed herein. The results show and the examples below relate that a broad variety of coating finishes for a variety of colors can be obtained from the coating techniques disclosed herein. This cure differential can be controlled by this invention to produce articles with the desired finish to produce a smooth, textured or wrinkled coated article. The examples here are not limiting in the use of this invention and show that pigment type, pigment level and light absorbing characteristics can compete with the photoinitiator package for light creating a cure rate differential within the coating with respect to the surface cure rate, the bulk film cure rate and the coating substrate interface cure rate as it is known to those skilled in the art. In Example 7, it is shown that a given coating when applied to an inert glass surface and an acid pretreated surface at the indicated rate and cured at the indicated print speed a textured versus smooth finish can be achieved. For this example, "inert", or "inert surface" is a substrate or substrate surface that at the time of coating and curing is not acidic and/or does not contribute significantly to the curing or cure rate of cationic coatings.

TABLE 6

Example 6 Coating 287-125 Yellow Testing Results

| % RH | Treatment Substrate | Print Speed ($ft^2$/hr) | Substrate Example 1 | Adhesion 1 minute | Adhesion 5 minute | Thumb Twist 1 minute | Thumb Twist 5 minute |
|---|---|---|---|---|---|---|---|
| 32 | Acetic Acid Instachange IP | 58.5 | 5 | 100 | 100 | 10 | 10 |
| 32[3] | None Instachange IP | 58.5 | 4 | 100 | 100 | 4 | 10 |
| | | | 20 bar | | | | |
| 32[3] | None Glass | 58.5 | 1 | 99 | 100 | 4 | 8 |
| | | | 20 bar | | | | |
| 44 | Acetic Acid Instachange IP | 58.5 | 5 | 0 | 0 | 4 | 4 |
| 44 | None Instachange IP | 58.5 | 4 | 0 | 0 | 2 | 2 |
| 32 | None Glass | 58.5 | 1 | 0 | 0 | 0-2 | 0-2 |
| 44 | Acetic Acid Instachange IP | 295 | 5 | 0 | 0 | 2 | 2 |
| 44 | None Instachange IP | 295 | 4 | 0 | 0 | 0 | 0 |
| 44 | Acid Coat Instachange IP | 295 | 6 | 40 | 90 | 4 | 8 |
| 44 | Acetic Acid Instachange IP | 590 | 5 | 0 | 0 | 0 | 0 |
| 44 | None Instachange IP | 590 | 4 | 0 | 0 | 0 | 0 |
| 44 | Acid Coat Instachange IP | 590 | 6 | 0 | 0 | 4 | 8 |
| 44 | Acid Coat Instachange IP | Dark Cure | 6 | Wet | Wet | Wet | Wet |
| 44 | None Glass | Dark Cure | 1 | Wet | Wet | Wet | Wet |
| 44 | Acid Coat Glass | Dark Cure | 3 | Wet | Wet | Wet | Wet |
| 44 | None Instachange IP | Dark Cure | 4 | Wet | Wet | Wet | Wet |

1. Yellow coating was drawn down with a wire cater #28 on substrates.

2. Thumb twist rated as 10=No Failure, 9=Very Slight Surface Mark, 8=Slight Surface Mark, 6=Surface Marking No Film Breaking, 4=Surface Skin Film Breaking, 2=Surface Skin Easily Breaks and, 0=Complete Failure.

TABLE 7

Profilometer Measurement Table

| Color | Application Details ft²/hr-WC# Treatment | Substrate | Peak Average (μm) | Peak Peak (μm) | Peak Valley (μm) | Peak Total (μm) | Peak Total Inert Surface minus Peak Total Acidic Surface |
|---|---|---|---|---|---|---|---|
| Magenta 287-123 | 180-28 bar-Acetic Acid | Instachange IP | 0.8875 | 1.4726 | 3.8458 | 5.3184 | |
| Magenta 287-123 | 180-28 bar-None | Glass | 1.1963 | 3.0914 | 2.8314 | 5.9228 | 0.6044 |
| Black 287-126 | 414.5-28 bar-Acetic Acid | Instachange IP | 0.3169 | 1.2551 | 0.3805 | 1.6357 | |
| Black 287-126 | 415.5-28 bar-No Acid | Glass | 0.5022 | 0.6876 | 1.6582 | 2.3458 | 0.7101 |
| Cyan 287-124 | 180-28 bar Acetic Acid | Instachange IP | 1.0056 | 1.2156 | 3.307 | 4.5226 | |
| Cyan 287-124 | 180-28 bar-None | Glass | 4.6123 | 11.2642 | 6.0403 | 17.3045 | 12.7819 |
| Yellow 287-125 | 58.5-20 bar-Acetic Acid | Instachange IP | 2.1582 | 3.48 | 6.5203 | 10.0004 | |
| Yellow 287-125 | 58.5-20 bar-None | Glass | 8.3481 | 24.5665 | 10.7199 | 35.2863 | 25.2859 |

1. Application Details Print Speed (ft²/hr), Wire Cater #(WC#) and surface treatment used to create the article for profilometer evaluation of surface characteristics.

2. Profilometer data was collected using a Taylor Hobson Profilometer. A 5 millimeter travel was made across the test area and perpendicular to the wrinkle so that valleys and peaks were measured. Raw data profile was analyzed to provide "peak valley", "peak peak" and "peak total" values.

Example 8

For the examples herein, the print rates are shown in ft²/hr assuming the substrate is 5 feet wide. This information is contained in Table 8: Print Speed Correlation Table For 5 Wide Media.

TABLE 8

Print Speed Correlation Table For 5 Foot Wide Media

| Lab View Value Interface | Measured Substrates Feed Speed Inches per second | Print Rate ft²/hour | Scale Factor Lab View | Scale Factor Measured Speed |
|---|---|---|---|---|
| 0.0665 | 0.039 | 58.5 | Set as "1" | 1 |
| 0.08 | 0.039 | 58.5 | 1.2 | 1 |
| 0.10 | 0.078 | 117 | 1.5 | 1.173 |
| 0.133 | 0.120 | 180 | 2.0 | 3.077 |
| 0.160 | 0.120 | 180 | 2.406 | 3.077 |
| 0.170 | 0.157 | 235.5 | 2.556 | 4.056 |
| 0.180 | 0.157 | 235.5 | 2.707 | 4.056 |
| 0.20 | 0.1967 | 295 | 3.008 | 5.043 |
| 0.266 | 0.237 | 355.5 | 4 | 6.077 |
| 0.30 | 0.276 | 414.5 | 4.511 | 7.085 |
| 0.40 | 0.3934 | 590 | 6.015 | 10.085 |
| 0.5332 | 0.5217 | 782.6 | 8.018 | 13.378 |
| 0.80 | 0.787 | 1180 | 12.03 | 20.171 |
| 1.064 | 1.02 | 1532 | 16 | 26.188 |
| 2.0 | 2.0 | 3000 | 30.075 | 51.282 |
| 2.128 | 2.087 | 3130 | 32 | 53.504 |

Calculation of throughput speeds based on media width and cure rate.

TABLE 9

Square Feet Per Hour With Twenty Seconds Exposure Time For A Five Foot Wide Media

| Media Width (in) | Exposure Time (sec) | Illumination Width (in) | Feed Rate (in/sec) | in/hour | sqft/hr |
|---|---|---|---|---|---|
| 12 | 20 | 4 | 0.2 | 720 | 60 |
| 36 | 20 | 4 | 0.2 | 720 | 180 |
| 48 | 20 | 4 | 0.2 | 720 | 240 |
| 60 | 20 | 4 | 0.2 | 720 | 300 |
| 96 | 20 | 4 | 0.2 | 720 | 480 |
| 128 | 20 | 4 | 0.2 | 720 | 640 |

TABLE 10

Square Feet Per Hour With Two Seconds Exposure Time For A Five Foot Wide Media

| Media Width (in) | Exposure Time (sec) | Illumination Width (in) | Feed Rate (in/sec) | in/hour | sqft/hr |
|---|---|---|---|---|---|
| 12 | 2 | 4 | 2 | 7200 | 600 |
| 36 | 2 | 4 | 2 | 7200 | 1800 |
| 48 | 2 | 4 | 2 | 7200 | 2400 |
| 60 | 2 | 4 | 2 | 7200 | 3000 |
| 96 | 2 | 4 | 2 | 7200 | 4800 |
| 128 | 2 | 4 | 2 | 7200 | 6400 |

Example 9

The dosage versus time for the UV Systems TripleBright II 254 nm lamp was plotted in FIG. 5. From the slope of dosage versus time in FIG. 5, we get a dosage of 2.85 mj/cm2 for each second under the lamp. For different times under the lamp we calculate the dosage as follows; 2 sec=5.7 mj/cm2, 5 sec=14.25 mj/cm2, 10 sec=28.5 mj/cm2, 20 sec=57.0 mj/cm2.

Example 10

Figure 6:
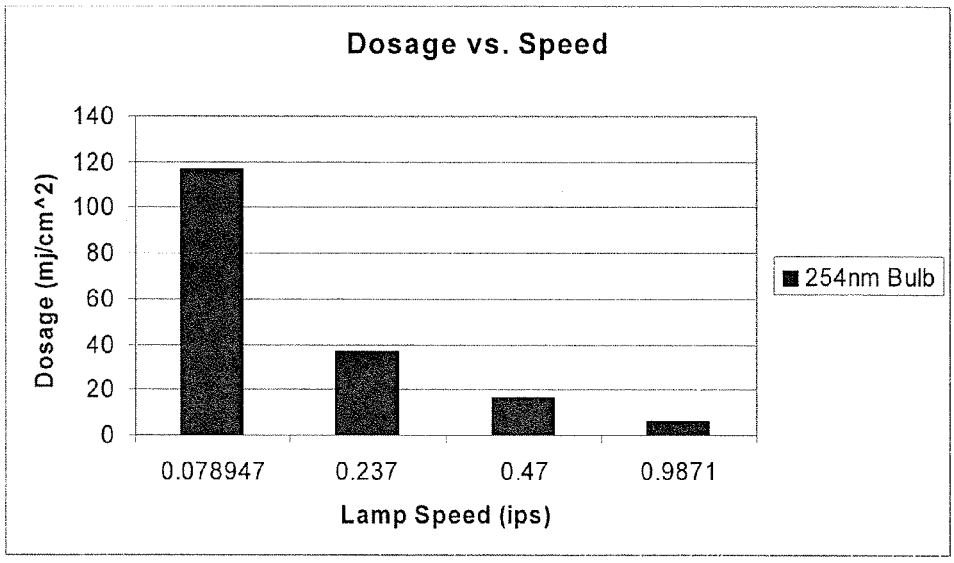
FIG. 6 Dosage v. Speed.

FIG. 6 plots the UV dosage from the UV Systems TripleBright II 254 nm lamp at an intensity of 0.008 Watt/cm2/nm versus linear lamp speed measured with the UV Integrator from Integration Technology (115 Heyford Park, Upper Heyford, Oxon, UK-OX25 5HA). The integrator was placed at the center of the bulb, with respect to the bulb's length of 22", as the bulb traveled over integrator.

Example 11

Figure 7:
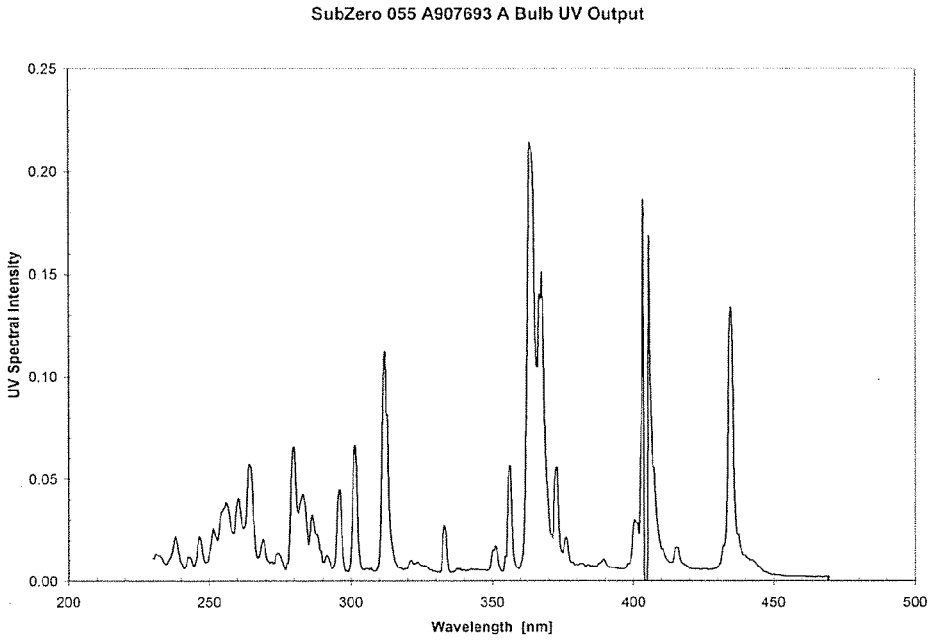
FIG. 7 Subzero 055 UV Spectral Intensity Chart.

FIG. 7 represent data taken with a Solatell UV Spectroradiometer (Solatell Limited, Centronic House King Henry's Drive Croydon, CR9 0BG United Kingdom) and represent light output of Gerber Scientific Products Solara UV inkjet printing product using Integrated Technologies SubZero 55 mercury vapor curing lamp technology.

Example 12

FIG. 8 represents data taken with a Solotel UV Spectroradiometer and represents light output from the UV Systems TripleBright II 254 nm Lamp used to cure coatings herein. The significance is that the intensity is less than 1/10 the intensity of the bulb used in Gerber Scientific Products current Solara UV inkjet printing product. The 254 nm Lamp used herein was available from UV Systems, Inc (Renton, Wash.) and was configured as a TripleBrightII but labeled as a TripleBright. The bulb length was 22" (18" of quartz/glass) and had a peak wavelength of 254 nm at an intensity of 0.008 Watt/cm$^2$/nm.

Example 13

A number of UV light sources were evaluated as a part of this research. The following non-limiting list shows an available range of low intensity light which can be used for curing the coatings described herein.

Figure 9:
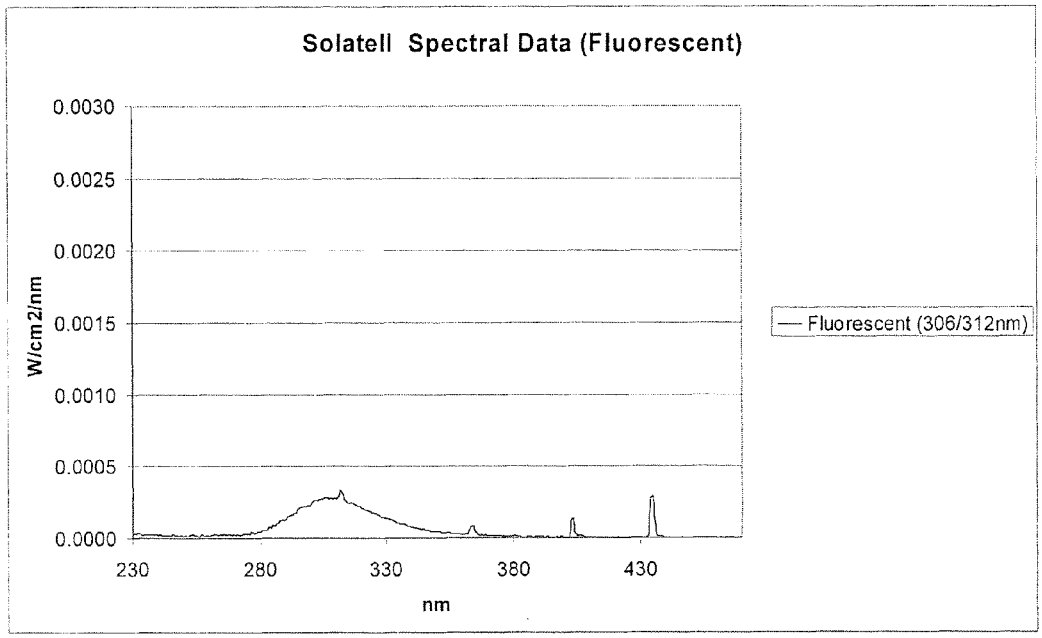
FIG. 9 Spectral Data: Fluorescent (306/312 nm)

FIG. 9 shows the UV spectral distribution of UV Systems TripleBright II with the 306/312 nm bulb.

Figure 10:
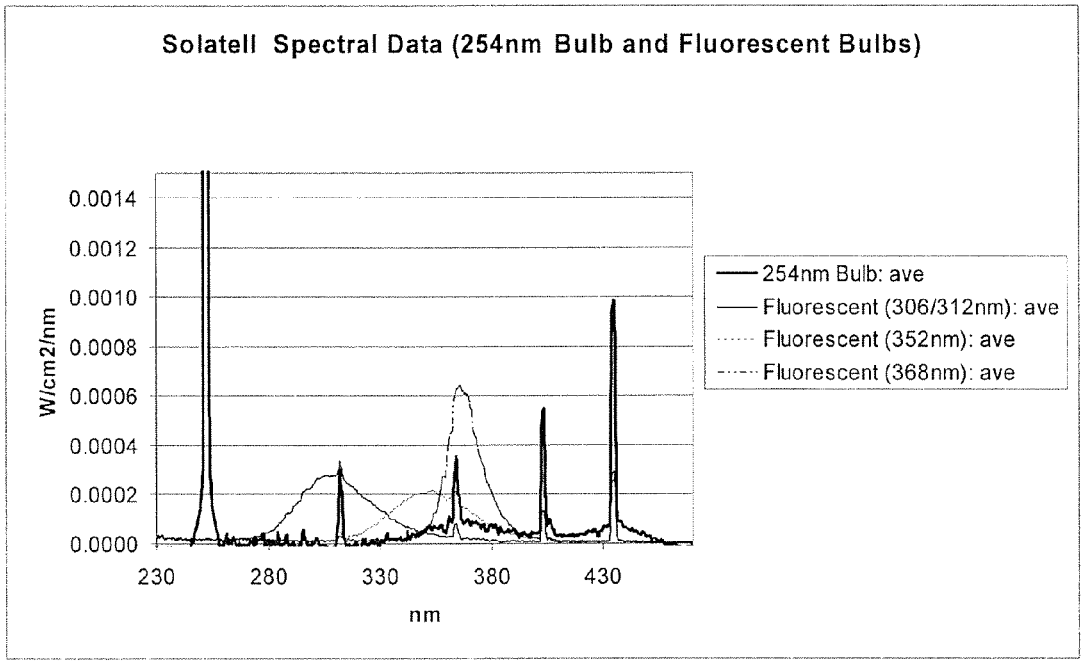
FIG. 10 Spectral Data: 254 nm, 306/312 nm, 352 nm and 368 nm lamps.

FIG. 10 shows the UV spectral distribution of UV Systems TripleBright II with the 254, 306/312, 352, 368 nm bulbs.

Figure 11:
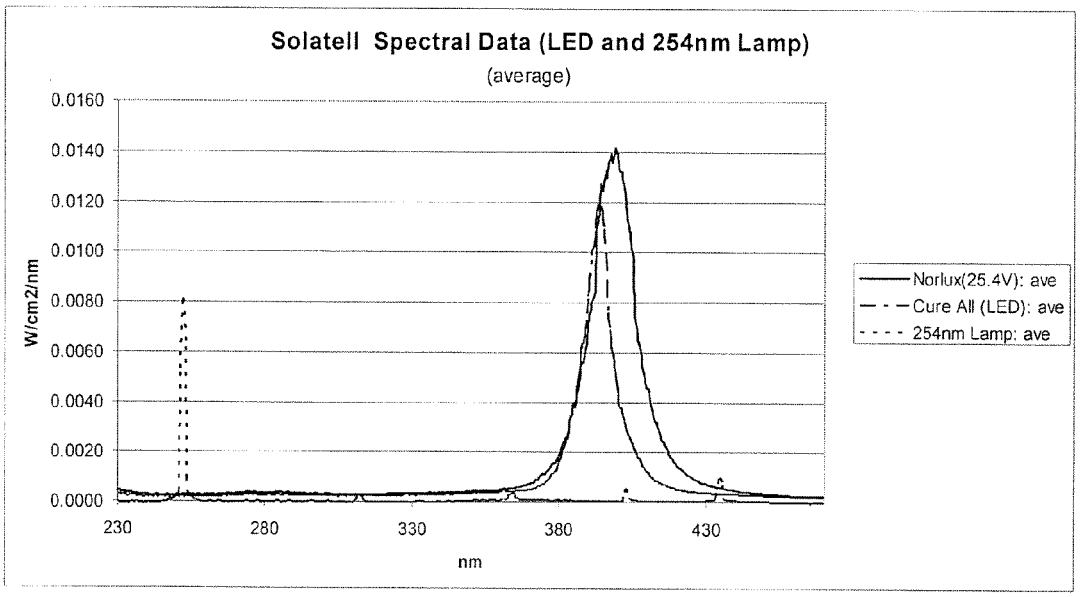
FIG. 11 Spectral Data: LED and Fluorescent (Norlux, Cure All, Fluorescent)

FIG. 11 shows spectral data of two commercially available LED products that fit within the scope of the invention with a comparison to output from UV Systems TripleBright II with the 254 nm bulb. These are a Norlux (Carol Stream, Ill.) NHX3950405005 395 nm Hex LED and a UV Process Supply (Chicago, Ill.) CureAll Linear 100 Developers Unit.

Example 14

Example 14 shows the exposure time which is calculated for a coating as a function of linear substrate input speed for the moving substrate configuration or the stationary substrate and moving long lamp configuration.

TABLE 11

Correlation Of Linear Print Speed And Exposure Time

| Speed (ips) | Dosage (mj/cm$^2$) | 1/Speed | Exposure Time(sec) - |
|---|---|---|---|
| 0.078 | 117 | 12.8 | 51.3 |
| 0.237 | 37 | 4.2 | 16.9 |
| 0.47 | 17 | 2.1 | 8.5 |
| 0.9871 | 6.5 | 1.0 | 4.1 |

Example 15

Figure 16A:
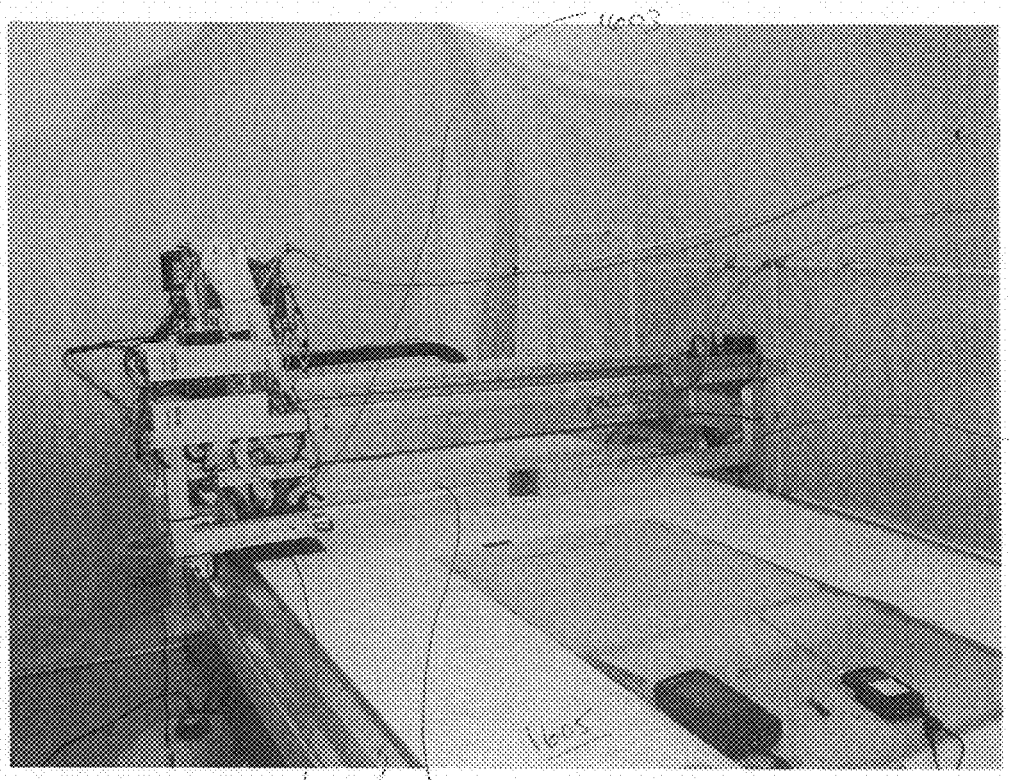
FIG. 16A: Photograph illustrating a Perspective View of Symmetrical Light Sources.

FIG. 16A is a photograph showing a perspective view of one embodiment of the present invention. A carriage holder assembly (1600) supports a first light source (1601) and a second light source (1602) (not shown in this view). The light sources, depending on the embodiment, are an ultraviolet (U.V.) light source and disposed symmetrically on either side of a print carriage (1603) that is also supported by the carriage holder. At least one blocker (1604) is disposed about the print carriage to prevent reflected light from reaching the underside of the print carriage that would prematurely cure any U.V. sensitive composition that is being dispensed from jet nozzles beneath the print carriage.

A table represented by reference numeral (1606) supports the carriage holder assembly (1600) and a substrate represented by reference numeral (1605). The substrate and composition delivered by the print carriage may vary depending on the embodiment. In an ink jet printer, for example, the print carriage is adapted to apply an amount of a coating or ink composition onto a substrate. Depending on the embodiment, the composition can include, but is not limited to cationic ink delivered by an ink jet printer and the substrate includes, but is not limited to an acidic substrate. For U.V. cured coatings and ink, the first and second light sources utilized to produce a light can have a wavelength in the ultraviolet range of about 100 nm to about 1200 nm and intensity in a range of about 0.0003 W/cm$^2$/nm to about 0.05 W/cm$^2$/nm. The lights are arranged to expose at least a portion of the coating composition to the light.

In one embodiment, the first and second light sources are positioned parallel to an axis in the direction of print carriage motion. The first and second light sources are disposed, for example, on opposite sides relative to a print carriage for illuminating a print surface. This embodiment is see in FIG. 16B. In this figure a photograph taken in the direction of the print cartridge motion shows symmetrical light sources (1601) and (1602) in relation to the print carriage (1603). Other positioning of the light sources may also be utilized. In addition, the invention may utilize just one light source instead of two light sources. The advantage of using two light sources is to obtain a better uniformity of light exposure on the substrate on either side of a print carriage or print cartridge.

Blockers (1604) prevent light from reaching underneath the print carriage. A substrate (1605) can be placed on table (1606) for coating or printing depending on the embodiment. Reflectors (1607) allow the light sources to focus it light energy towards the working surface or substrate to maximize the amount of energy available for curing the composition delivered by the print carriage.

Figure 16B:
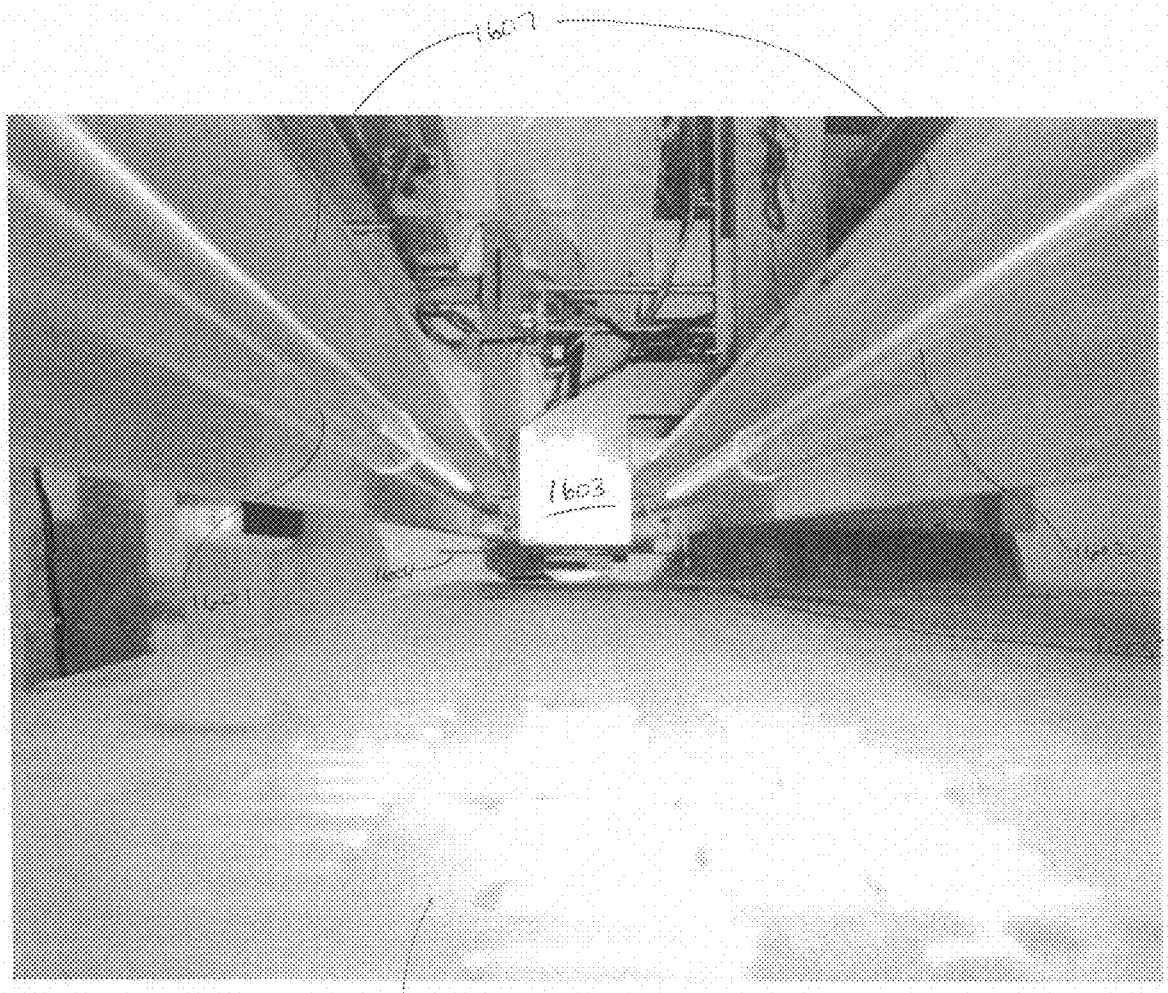
FIG. 16B: Photograph illustrating a Side View of Symmetrical Light Sources.
Figure 16C:
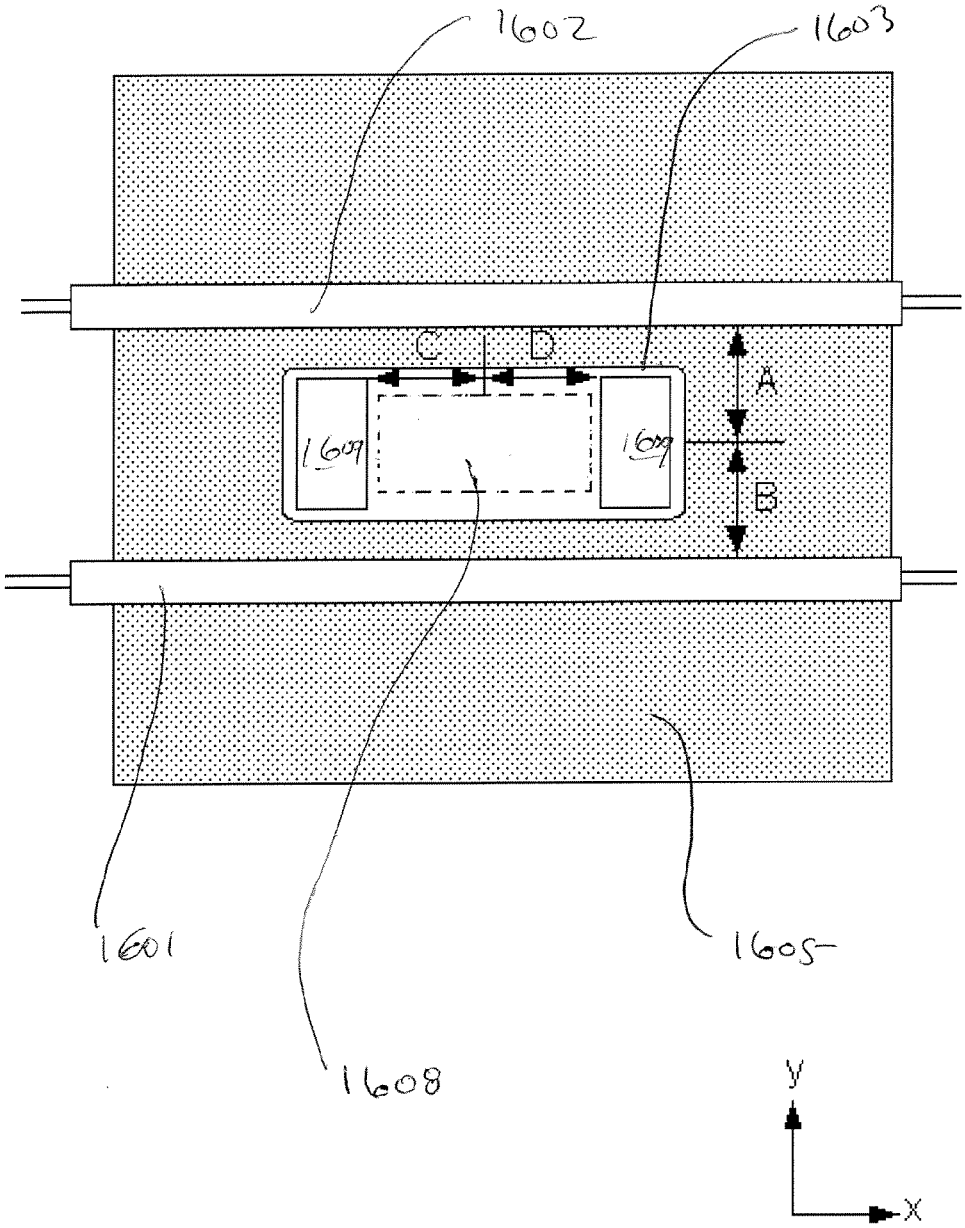
FIG. 16C: Top View of Symmetrical Light Sources

FIG. 16C is a top view of the symmetrical light arrangement illustrated in FIGS. 16A-B. In this embodiment, light sources (1601) and (1602) are disposed on both sides of print carriage (1603). The distance from the edge of each light source to the middle of the print carriage is denoted by dimensions "A" and "B", which are equal in distance. Dimensions "C" and "D" denote the distance from print head carriage lamps (1609) to the center of the print carriage. The print head carriage lamps in this embodiment are also symmetrical and the dimensions "C" and "D" are equal in length. In one embodiment, the print head carriage mounted lamps (1609), can be off during printing for ink flow. In another embodiment, the print head carriage mounted lamps (1609), can be on. In yet another embodiment, one print head carriage mounted lamp (1609), can be on, while the other print head carriage mounted lamp (1609), can be off. Beneath the print carriage (1608) is the printing area (1608) where the composition or ink is transferred.

Figure 17:
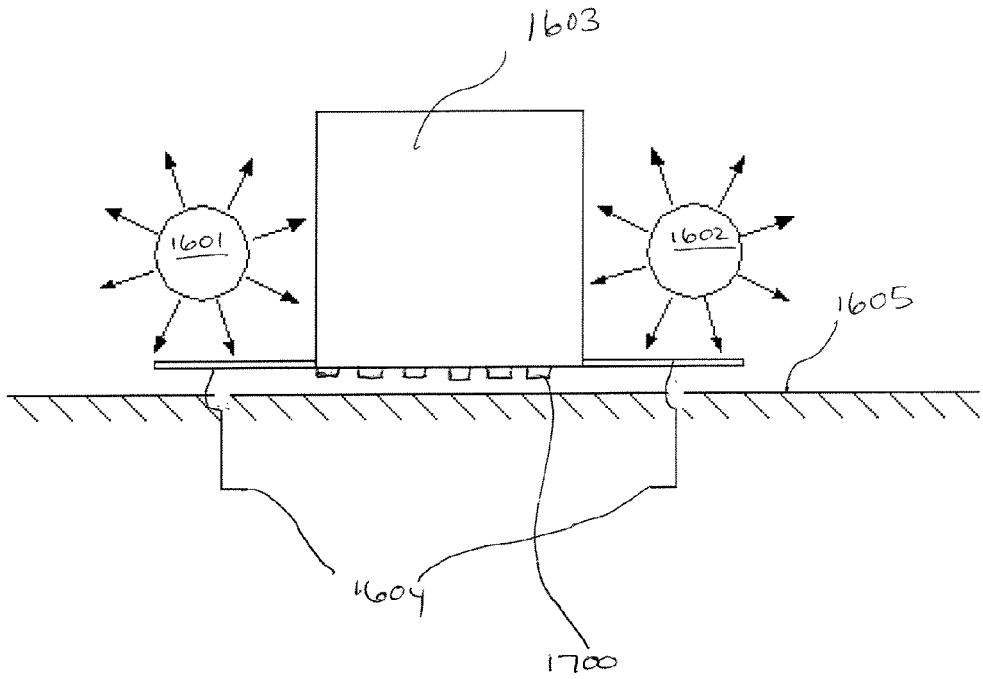
FIG. 17: Moving Shadow of Print Carriage.

Averting to FIG. 17, illustrated in this embodiment is a print carriage providing a "moving shadow" from the light source. Preferably the light source is an ultraviolet light. Ultraviolet light is uniformly distributed over the printing area or a print zone. Effectively UV light is uniform in all areas of print zone, expect for a moving shadow under the print carriage. The moving shadow prevents UV from reaching nozzles of the print carriage head causing cure in the nozzles which effectively clogs the nozzles. The print zone is defined by a path of carriage motion illuminated by the first and second light sources. The print carriage (1603) blocks ultraviolet light to allow jetted ink or other compositions such as a coating to reach the print surface in absence of ultraviolet light. The print carriage, depending on the embodiment, can block ultraviolet light further to prevent ultraviolet light from curing ink inside ink jet nozzles of the printing cartridge. Depending on the embodiment the print carriage can further include blockers (1604) that can further prevent the light from being reflected to the underneath of the print carriage. In addition the print carriage can include one or more applicators (1700). Depending on the embodiment, the applicator can be a jet nozzle, or any other kind of delivery device known to those skilled in the art.

Figure 18:
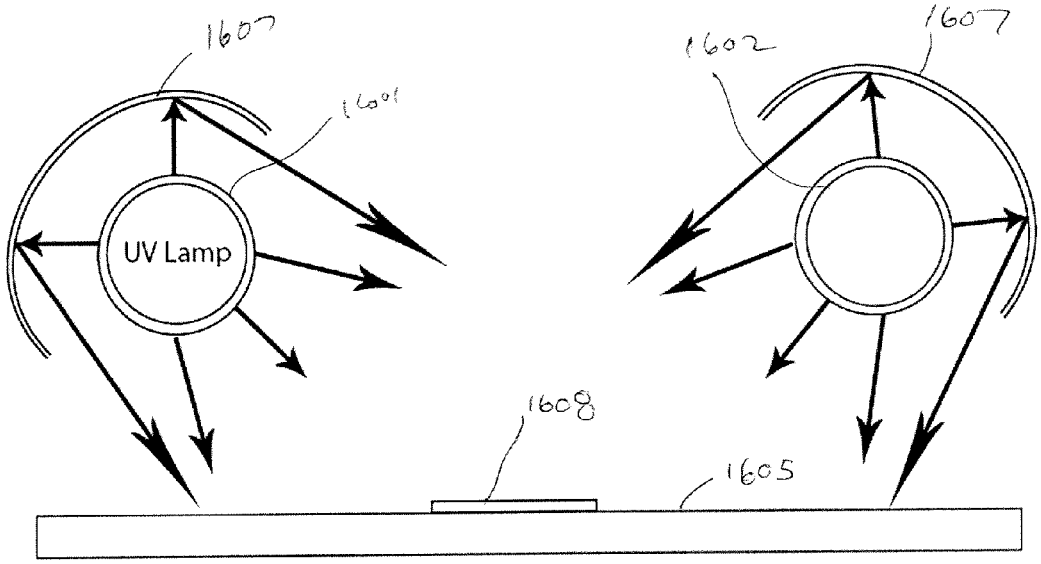
FIG. 18: Reflector on Print Cartridge.

FIG. 18 illustrates a reflector on a printer cartridge. In this embodiment, the reflector is to provide uniform ultraviolet light intensity within the print zone (1608) on substrate (1605). Reflectors (1607) reflect light from light sources (1601) and (1602) that are positioned symmetrical about the print carriage in this embodiment. Depending on the embodiment, the light sources may be disposed asymmetrically depending on the desired effect of the light curing radiation of the light sources.

Figure 19A:
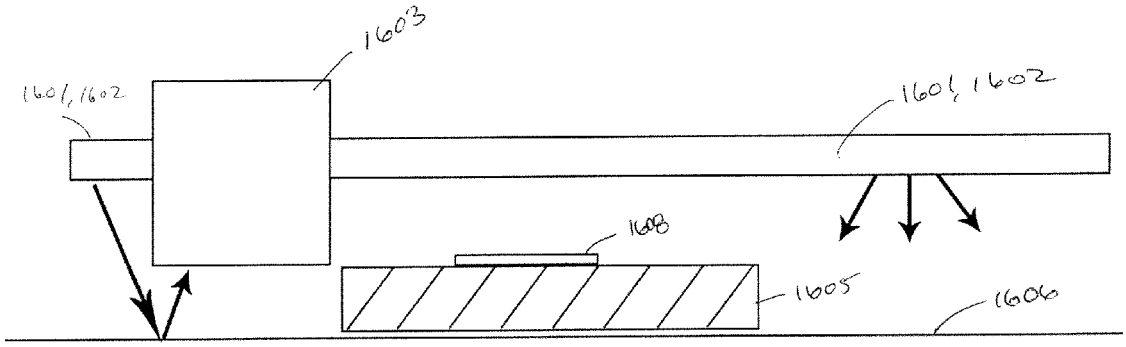
FIG. 19A: Reflected UV Light Striking Underside of Ink Jet Head.

FIG. 19A shows reflected UV light reaching the underside of the print carriage (1603) when no light blocking is used while printing on rigid media. Again, the print carriage can be an ink jet print head, or any other type of printing or delivery device known to those skilled in the art. Rigid media for purposes of this embodiment is any media that contains a thickness approximately 0.010 inch or greater. (ie. thick media).

Figure 19B:
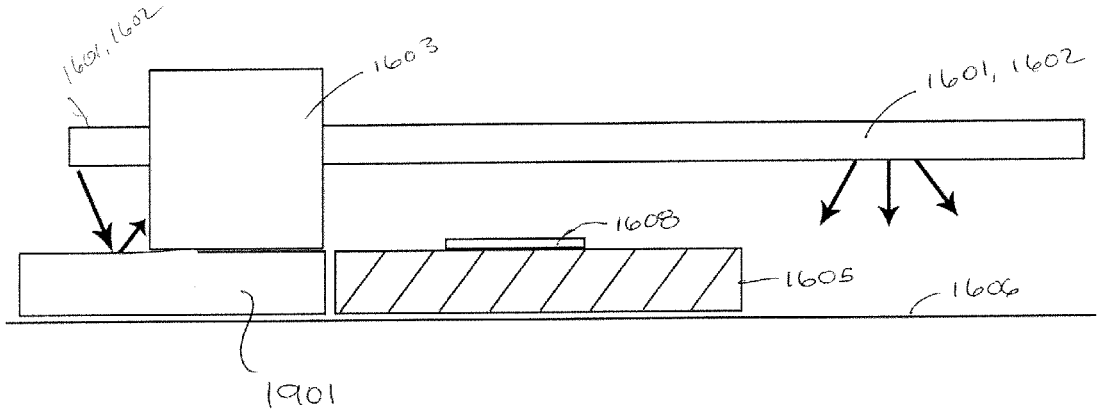
FIG. 19B: Positionable Light Block Over an Edge Rigid Media.

FIG. 19B shows one illustration of a light block (1901) that can be positioned adjacent to the rigid substrate (1605) that is being printed on. This light block material is preferably about the same thickness and width as the rigid substrate and prevents reflected U.V. light from reaching the print head or printing carriage nozzles.

Figure 19C:
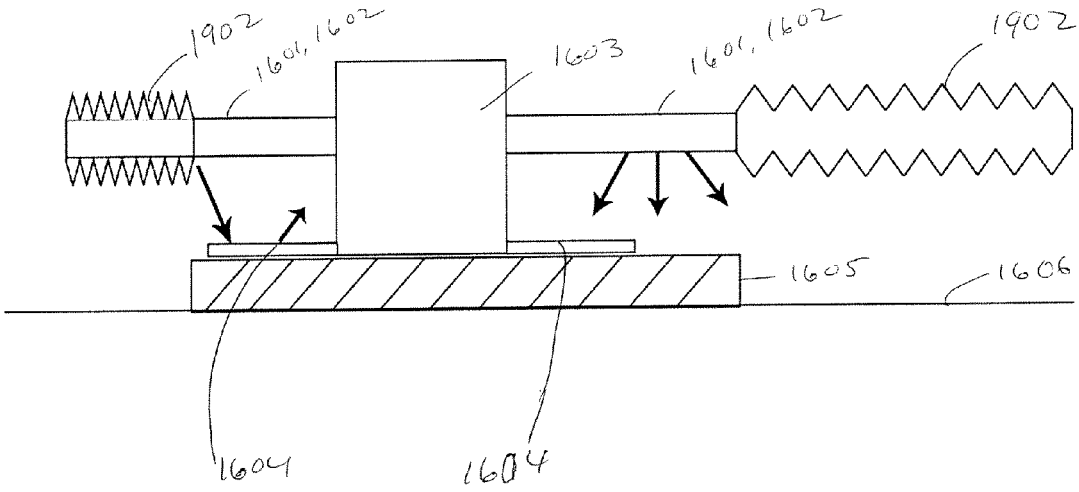
FIG. 19C: Light Blocking Blind disposed Over Portion of Light Source.

FIG. 19C shows another embodiment of preventing reflected U.V. light or any other type of light source from reaching the underside of the print heads. A lamp cover (1902) is placed over the lamp to prevent U.V. light from being delivered to regions other than the printed surface of the rigid media. This serves to prevent ultraviolet light from reaching the underside of the print carriage.

Heat is produced from the first light source and second light source that lowers humidity within a print zone to allow for curing of cationic ink, or other such compositions, in environments with a relative humidity above 60%. Heat produced from the first and second light sources are kept low enough to keep surface temperature of a heat sensitive rigid media from deforming. In addition, the heat produced by the light sources can be controlled to prevent an ink jet print head or printing cartridge from striking the media during printing. Typically the media is a heat sensitive rigid media depending on the implementation of the invention. Such media easily deforms when exposed to heat and may deform to an extent where the printing head would make contact with the media. By controlling the heat of the light sources this potential defect is controlled.

As previously described, the first and second light sources can generate ultraviolet light. The ultraviolet light intensity can be adjusted to produce gloss and matte finishes on flexible or rigid print media. Lower intensity is used for producing a gloss finish relative to a higher intensity used to produce matte finishes. The ultraviolet light intensity can be adjusted low enough to produce a more flexible ink that is less prone to cracking and more prone to media stretching.

The first and second light sources can be, but are not limited to, low pressure mercury vapor lamps. These lamps can be used for curing cationic ink jet ink on flexible and rigid substrates. The advantages of using low pressure mercury vapor lamps include use for lower cost, higher life, lower power density and subsequent heat generation, and less susceptibility to failure from contact with impurities such as oil on ones skin that transfers to the quart tubing after touching the quartz tube with a finger.

Although the invention has been described in conjunction with specific embodiments, many alternatives and variations can be apparent to those skilled in the art in light of this description and the annexed drawings. Accordingly, the invention is intended to embrace all of the alternatives and variations that fall within the spirit and the scope of the appended claims.

We claim:

1. An ink jet printer, comprising:

an applicator disposed on a print carriage, said applicator adapted to apply an amount of a coating composition to a substrate;

a first light source producing a light having a wavelength in a range of about 100 nm to about 1200 nm and an intensity in a range of about 0.0003 $W/cm^2/nm$ to about 0.05 $W/cm^2/nm$ and arranged to expose at least a portion of the coating composition to the light;

a second light source producing a light having a wavelength in a range of about 100 nm to about 1200 nm symmetrical with the first light source, and both the first and second light sources positioned parallel to an axis in the direction of print carriage motion; and the first and second light sources disposed on opposite sides relative to the print carriage for illuminating a print surface, wherein said first and second light sources are not mounted on said carriage, and wherein light from said first and second light sources provides substantially all energy required to cure said coating composition.

2. The ink jet printer according to claim 1, wherein the print carriage provides a moving shadow blocking ultraviolet light to allow jetted ink to reach the print surface in absence of ultraviolet light; the ultraviolet light being distributed over a print zone defined by a path of carriage motion illuminated by the first and second light sources.

3. The ink jet printer according to claim 2, wherein the print carriage blocking ultraviolet light is further to prevent ultraviolet light from curing ink inside ink jet nozzles of the printing cartridge.

4. The ink jet printer according to claim 1, further having a reflector to provide uniform ultraviolet light intensity within a print zone.

5. The ink jet printer according to claim 1, wherein heat produced from the first and second light sources lower humidity within a print zone to allow for curing of cationic ink in environments with a relative humidity above 60%.

6. The ink jet printer according to claim 5, wherein heat produced from the first and second light sources are kept low enough to keep surface temperature of a heat sensitive rigid media from deforming to prevent an ink jet print head from striking the heat sensitive rigid media during printing.

7. The ink jet printer according to claim 1, wherein ultraviolet light intensity can be adjusted to produce gloss and matte finishes on flexible rigid print media.

8. The ink jet printer according to claim 7, wherein gloss finish is produced by using lower ultraviolet light intensity relative to intensity used to produce the matte finish.

9. The ink jet printer according to claim 7, wherein the ultraviolet light intensity is adjusted low enough to produce a more flexible ink that is less prone to cracking and more prone to media stretching.

10. The ink jet printer according to claim 1, wherein the first and second light sources are low pressure mercury vapor lamps for curing cationic ink jet ink on flexible and rigid substrates.

11. The ink jet printer according to claim 10, wherein low pressure mercury vapor lamps are used for lower cost, higher life, and less susceptibility to failure from impurities by making contact with the surface of a quartz tube of traditional medium pressure lamps.

12. An ink jet printer, comprising:

an applicator disposed on a print carriage, said applicator adapted to apply an amount of a coating composition to a substrate;

a first fluorescent light source producing a light having a wavelength in a range of 100 nm to 1200 nm and an intensity in a range of 0.0003 W/cm$^2$/nm to 0.05 W/cm$^2$/nm and arranged to expose at least a portion of the coating composition to the light;

a second fluorescent light source producing a light having a wavelength in a range of 100 nm to 1200 nm symmetrical with the first light source, and both the first and second light sources positioned parallel to an axis in the direction of print carriage motion;

the first and second light sources disposed relative to the print carriage for illuminating a print surface, the print carriage providing a moving shadow from ultraviolet light distributed over a print zone defined by a path of carriage motion illuminated by the first and second light source, wherein said first and second light sources are not mounted on said carriage;

wherein light from said first and second light sources provides substantially all energy required to cure said coating composition; and wherein the print carriage blocks ultraviolet light to allow jetted ink to reach the print surface in absence of ultraviolet light.

13. The ink jet printer according to claim 12, wherein the print carriage blocking ultraviolet light is further to prevent ultraviolet light from curing ink inside ink jet nozzles of the printing cartridge.

14. The ink jet printer according to claim 12, further having a reflector to provide uniform ultraviolet light intensity within a print zone.

15. The ink jet printer according to claim 12, wherein heat produced from the first and second light sources lower humidity within a print zone to allow for curing of cationic ink in environments with a relative humidity above 60%.

16. The ink jet printer according to claim 15, wherein heat produced from the first and second light sources are kept low enough to keep surface temperature of a heat sensitive rigid media from deforming to prevent an ink jet print head from striking the heat sensitive rigid media during printing.

17. The ink jet printer according to claim 12, wherein ultraviolet light intensity can be adjusted to produce gloss and matte finishes on flexible rigid print media.

18. The ink jet printer according to claim 17, wherein gloss finish is produced by using lower ultraviolet light intensity relative to intensity used to produce the matte finish.

19. The ink jet printer according to claim 17, wherein the ultraviolet light intensity is adjusted low enough to produce a more flexible ink that is less prone to cracking and more prone to media stretching.

20. A method of curing a composition delivered from an ink jet printer, comprising:

applying an amount of a coating composition to a substrate;

providing a first fluorescent and a second fluorescent light source producing a light having a wavelength in a range of 100 nm to 1200 nm and an intensity in a range of 0.0003 W/cm$^2$/nm to 0.05 W/cm$^2$/nm;

arranging the first and second light sources relative to a print cartridge on a carriage to expose at least a portion of the coating composition to the light, wherein said first and second light sources are not mounted on said carriage, and wherein light from said first and second light sources provides substantially all energy required to cure said coating composition;

illuminating a print surface with the print carriage providing a moving shadow to allow the composition to reach the substrate in absence of ultraviolet light.

21. The ink jet printer according to claim 20, wherein the composition is jetted ink.

22. The ink jet printer according to claim 20, wherein both the first and second light sources are positioned parallel to an axis in the direction of print carriage motion.

23. The ink jet printer according to claim 20, wherein the composition is cationic ink jet ink and the substrate is either a flexible or rigid substrate.

24. The ink jet printer according to claim 20 further includes providing a reflector to provide uniform ultraviolet light intensity within a print zone.

25. The ink jet printer according to claim 20 further includes producing heat from the first and second light sources to lower humidity within a print zone and to allow for curing of cationic ink in environments with a relative humidity above 60%.

26. An ink jet printer, comprising:

an applicator disposed on a print carriage, said applicator adapted to apply an amount of a coating composition to a substrate;

a first light source producing a light having a wavelength in a range of 100 nm to 1200 nm and an intensity in a range of 0.0003 W/cm$^2$/nm to 0.05 W/cm$^2$/nm and arranged to expose at least a portion of the coating composition to the light;

a second light source producing a light having a wavelength in a range of 100 nm to 1200 nm symmetrical with the first light source, and both the first and second light sources positioned parallel to an axis in the direction of print carriage motion;

the first and second light sources disposed relative to the print carriage for illuminating a print surface, the print carriage providing a moving shadow from ultraviolet light distributed over a print zone defined by a path of carriage motion illuminated by the first and second light source, wherein said first and second light sources are not mounted on said carriage;

wherein light from said first and second light sources provides substantially all energy required to cure said coating composition; and wherein the print carriage blocks ultraviolet light to allow jetted cationic ink to reach the print surface in absence of ultraviolet light.

27. The ink jet printer according to claim 26, wherein the first and second light sources are low pressure mercury vapor lamps for curing the cationic ink jet ink on flexible and rigid substrates.

28. The ink jet printer according to claim 27, wherein low pressure mercury vapor lamps are used for lower cost, higher life, and less susceptibility to failure from impurities by making contact with the surface of a quartz tube of traditional medium pressure lamps.

29. The ink jet printer according to claim 27, wherein the substrate is heat sensitive.

* * * * *